US012180564B2

(12) United States Patent
Tokuda et al.

(10) Patent No.: US 12,180,564 B2
(45) Date of Patent: Dec. 31, 2024

(54) PLATED STEEL SHEET

(71) Applicant: NIPPON STEEL CORPORATION, Tokyo (JP)

(72) Inventors: Kohei Tokuda, Tokyo (JP); Mamoru Saito, Tokyo (JP); Yuto Fukuda, Tokyo (JP); Yasuto Goto, Tokyo (JP); Yasuhiro Majima, Tokyo (JP); Naoyuki Yamato, Tokyo (JP); Fumiaki Nakamura, Tokyo (JP); Hidetoshi Shindo, Tokyo (JP); Koji Kawanishi, Tokyo (JP); Kenichiro Matsumura, Tokyo (JP); Hiroshi Takebayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/703,998

(22) PCT Filed: Aug. 16, 2022

(86) PCT No.: PCT/JP2022/030932
§ 371 (c)(1),
(2) Date: Apr. 23, 2024

(87) PCT Pub. No.: WO2023/074088
PCT Pub. Date: May 4, 2023

(65) Prior Publication Data

US 2024/0336996 A1 Oct. 10, 2024

(30) Foreign Application Priority Data

Oct. 26, 2021 (JP) ..... 2021-174676

(51) Int. Cl.
*C22C 18/04* (2006.01)
*C23C 30/00* (2006.01)

(52) U.S. Cl.
CPC ..... *C22C 18/04* (2013.01); *C23C 30/005* (2013.01)

(58) Field of Classification Search
None
See application file for complete search history.

(56) References Cited

U.S. PATENT DOCUMENTS 6,235,410 B1 5/2001 Komatsu et al.
6,465,114 B1 10/2002 Honda et al.
(Continued)

FOREIGN PATENT DOCUMENTS

EP 1199376 A1 * 4/2002 ..... C23C 2/02
JP 10-226865 A 8/1998
(Continued)

OTHER PUBLICATIONS

Written Opinion of the International Searching Authority for PCT/JP2022/030932 (PCT/ISA/237) mailed on Oct. 18, 2022.

*Primary Examiner* — Brian D Walck
(74) *Attorney, Agent, or Firm* — Birch, Stewart, Kolasch & Birch, LLP

(57) ABSTRACT

A plated steel sheet comprises a plated layer on a surface of a steel sheet, in which in the plated layer, the total amount ΣA of Sn, Bi, and In is less than 0.75%, the total amount ΣB of Ca, Y, La, and Ce is 0.03 to 0.60%, the total amount ΣC of Cr, Ti, Ni, Co, V, Nb, Cu, and Mn is 0 to 1.00%, Sn≤Si, and 20.0≤Mg/Si are satisfied, and in an X-ray diffraction pattern of a surface of the plated layer, an X-ray diffraction peak of $Al_{2.15}Zn_{1.85}Ca$, an X-ray diffraction peak of $CaZn_2$, and an X-ray diffraction peak of η'-$MgZn_2$ satisfy a predetermined relationship.

7 Claims, 1 Drawing Sheet

(56) References Cited

U.S. PATENT DOCUMENTS

| | | | |
|---|---|---|---|
| 2019/0390303 | A1 | 12/2019 | Tokuda et al. |
| 2020/0002798 | A1 | 1/2020 | Tokuda et al. |
| 2022/0145425 | A1 | 5/2022 | Mitsunobu et al. |

FOREIGN PATENT DOCUMENTS

| | | | |
|---|---|---|---|
| JP | 2017-66523 | A | 4/2017 |
| JP | 2021-4403 | A | 1/2021 |
| WO | WO 00/71773 | A1 | 11/2000 |
| WO | WO 2018/139619 | A1 | 8/2018 |
| WO | WO 2018/139620 | A1 | 8/2018 |
| WO | WO 2020/213686 | A1 | 10/2020 |

* cited by examiner

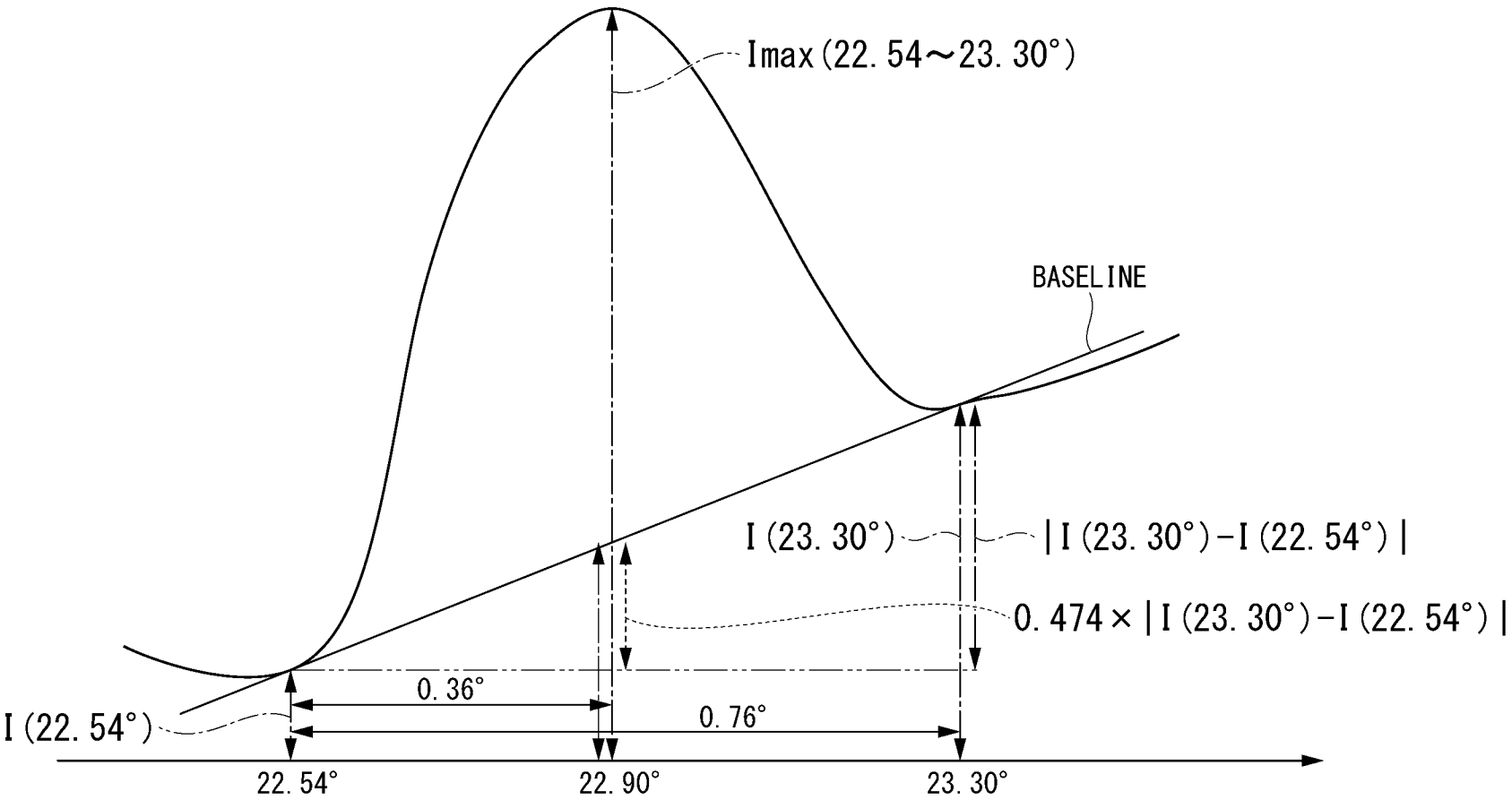
Imax (22. 54～23. 30°)
BASELINE
| I (23. 30°) − I (22. 54°) |
0. 474 × | I (23. 30°) − I (22. 54°) |
I (23. 30°)
0. 76°
0. 36°
23. 30°
22. 90°
22. 54°
I (22. 54°)

PLATED STEEL SHEET

TECHNICAL FIELD OF THE INVENTION

The present invention relates to a plated steel sheet.

The present application claims priority based on Japanese Patent Application No. 2021-174676 filed in Japan on Oct. 26, 2021, the contents of which are incorporated herein by reference.

BACKGROUND ART

Plated steel sheets are used in various building material fields. Since the life of a building depends on the wear rate of a plated layer, it is preferable to use a highly corrosion-resistant plated steel sheet as a building material. For example, plated steel sheets described in Patent Documents 1 to 3 are known as a steel sheet exhibiting high corrosion resistance.

There are various environments in Japan, and in areas where volcanic gas is generated, industrial areas, and the like, SOx gas in the atmosphere dissolves into rainwater and becomes acid rain, which may greatly impair the life of the plated steel sheets. Al-based plated steel sheets, commonly known as galvalume steel sheets (registered trademark), have relatively good corrosion resistance in an acidic environment but low corrosion resistance in an alkaline environment. Therefore, since the Al-based plated steel sheets have small corrosion resistance and sacrificial corrosion resistance in an alkaline environment such as an atmosphere of ammonia gas generated from a compost house such as a cow house or a pig house, the use range thereof is limited.

Therefore, the Zn-based plated steel sheets as shown in Patent Documents 1 to 3 have a wider application range. However, the Zn-based plated steel sheets tend to have lower corrosion resistance in an acidic environment than the Al-based plated steel sheets, and improvement in corrosion resistance in an acidic environment is required. That is, the plated steel sheet is required to have high corrosion resistance in all regions from the acid side to the alkali side.

CITATION LIST

Patent Document

[Patent Document 1]
Japanese Unexamined Patent Application, First Publication No. H10-226865
[Patent Document 2]
PCT International Publication No. WO 2000/71773
[Patent Document 3]
PCT International Publication No. WO 2018/139619

SUMMARY OF INVENTION

Problems to be Solved by the Invention

The present invention has been made in view of the above circumstances, and an object of the present invention is to provide a plated steel sheet exhibiting high corrosion resistance in an acidic to alkaline environment.

Means for Solving the Problem

[1] A plated steel sheet comprising a plated layer on a surface of a steel sheet, wherein the plated layer has an average chemical composition comprising, in mass %, Al: more than 15.0% and 30.0% or less,
Mg: more than 5.0% and 15.0% or less,
Sn: 0 to 0.70%,
Bi: 0 to 0.35%,
In: 0 to 0.35%,
Ca: 0.03 to 0.60%,
Y: 0 to 0.30%,
La: 0 to 0.30%,
Ce: 0 to 0.30%,
Si: 0.01 to 0.75%,
Cr: 0 to 0.25%,
Ti: 0 to 0.25%,
Ni: 0 to 1.00%,
Co: 0 to 0.25%,
V: 0 to 0.25%,
Nb: 0 to 0.25%,
Cu: 0 to 0.25%,
Mn: 0 to 0.25%,
Fe: 0 to 5.0%,
Sr: 0 to 0.5%,
Sb: 0 to 0.5%,
Pb: 0 to 0.5%,
B: 0 to 0.5%,
Li: 0 to 0.5%,
Zr: 0 to 0.5%,
Mo: 0 to 0.5%,
W: 0 to 0.5%,
Ag: 0 to 0.5%,
P: 0 to 0.5%, and a remainder of Zn and impurities, a total amount ΣA of Sn, Bi and In is 0% or more and less than 0.75%, a total amount ΣB of Ca, Y, La, and Ce is 0.03 to 0.60%, a total amount ΣC of Cr, Ti, Ni, Co, V, Nb, Cu, and Mn is 0 to 1.00%, Sn≤Si and 20.0≤Mg/Si are satisfied, and when $I_1$ to $I_3$ determined from X-ray diffraction peaks of $Al_{2.15}Zn_{1.85}Ca$, $I_4$ determined from an X-ray diffraction peak of $CaZn_2$, and $I_5$ and $I_6$ determined from X-ray diffraction peaks of η'-$MgZn_2$ are defined by the following Formulas (1) to (6) in an X-ray diffraction pattern of a surface of the plated layer, measured under conditions of an X-ray output of 40 kV and 150 mA using a Cu-Kα ray, the following Formulas (A) and (B) are satisfied:

$$I_1 = \frac{I\max(22.54 \sim 23.30°)}{I(22.54°) + 0.474\{|I(23.30°) - I(22.54°)|\}} \quad (1)$$

$$I_2 = \frac{I\max(31.00 \sim 32.00°)}{I(31.00°) + 0.62\{|I(32.00°) - I(31.00°)|\}} \quad (2)$$

$$I_3 = \frac{I\max(43.80 \sim 44.30°)}{I(43.50°) + 0.48\{|I(44.30°) - I(43.80°)|\}} \quad (3)$$

$$I_4 = \frac{I\max(33.00 \sim 33.80°)}{I(33.00°) + 0.4375\{|I(33.80°) - I(33.00°)|\}} \quad (4)$$

$$I_5 = \frac{I\max(26.00 \sim 26.40°)}{I(26.00°) + 0.375\{|I(26.40°) - I(26.00°)|\}} \quad (5)$$

-continued $$I_6 = \frac{I\max(49.00 \sim 49.60°)}{I(49.00°) + 0.367\{|I(49.60°) - I(49.00°)|\}} \quad (6)$$

$$4.05 \leq I_1 + I_2 + I_3 + I_4 \quad (A)$$

$$2.05 \leq I_5 + I_6 \quad (B)$$

wherein, in Formulas (1) to (6), Imax (k to m°) is a maximum value of an X-ray diffraction intensity at a diffraction angle 2θ between k to m°, I (n°) is an X-ray diffraction intensity at a diffraction angle 2θ of n°, and k, m, and n are diffraction angles 2θ each shown in Formulas (1) to (6).

[2] The plated steel sheet according to [1], wherein the average chemical composition of the plated layer satisfies 20.0≤Mg/Si≤38.0 and 3.00≤Al/Mg≤4.00, and when $I_7$ to $I_9$ determined from X-ray diffraction peaks of MgAlSi are defined by the following Formulas (7) to (8) in an X-ray diffraction pattern of a surface of the plated layer, measured under conditions of an X-ray output of 40 kV and 150 mA using a Cu-Kα ray, the following Formula (C) is satisfied:

$$I_7 = \frac{I\max(24.30 \sim 24.90°)}{I(24.30°) + 0.60\{|I(24.90°) - I(24.30°)|\}} \quad (7)$$

$$I_8 = \frac{I\max(46.10 \sim 46.40°)}{I(46.10°) + 0.60\{|I(46.40°) - I(46.10°)|\}} \quad (8)$$

$$I_9 = \frac{I\max(49.00 \sim 49.60°)}{I(49.00°) + 0.25\{|I(49.60°) - I(49.00°)|\}} \quad (9)$$

$$3.05 \leq I_7 + I_8 + I_9 \quad (C)$$

wherein, in Formulas (7) to (9), Imax (k to m°) is a maximum value of an X-ray diffraction intensity at a diffraction angle 2θ between k to m°, I (n°) is an X-ray diffraction intensity at a diffraction angle 2θ of n°, and k, m, and n are diffraction angles 2θ each shown in Formulas (7) to (9).

[3] The plated steel sheet according to [1] or [2], wherein the average chemical composition of the plated layer satisfies 0.01≤Sn, and when $I_{10}$ determined from an X-ray diffraction peak of $Mg_9Sn_5$ is defined by the following Formula (10) in an X-ray diffraction pattern of a surface of the plated layer, measured under conditions of an X-ray output of 40 kV and 150 mA using a Cu-Kα ray, the following Formula (D) is satisfied:

$$I_{10} = \frac{I\max(23.10 \sim 23.80°)}{I(23.10°) + 0.43\{|I(23.80°) - I(23.10°)|\}} \quad (10)$$

$$1.04 \leq I_{10} \quad (D)$$

wherein, in Formula (10), Imax (23.10 to 23.80°) is a maximum value of an X-ray diffraction intensity at a diffraction angle 2θ between 23.10 to 23.80°, I (23.10°) is an X-ray diffraction intensity at a diffraction angle 2θ of 23.10°, and I (23.80°) is an X-ray diffraction intensity at a diffraction angle 2θ of 23.80°.

[4] The plated steel sheet according to any one of [1] to [3], wherein when $I_{11}$ to $I_{13}$ determined from X-ray diffraction peaks of a metal oxide are defined by the following Formulas (11) to (13) in an X-ray diffraction pattern of a surface of the plated layer, measured under conditions of an X-ray output of 40 kV and 150 mA using a Cu-Kα ray, the following Formula (E) is satisfied:

$$I_{11} = \frac{I\max(10.30 \sim 10.70°)}{I(10.30°) + 0.375\{|1(10.70°) - I(10.30°)|\}} \quad (11)$$

$$I_{12} = \frac{I\max(12.30 \sim 13.30°)}{I(12.30°) + 0.53\{|I(13.30°) - I(12.30°)|\}} \quad (12)$$

$$I_{13} = \frac{I\max(17.10 \sim 17.50°)}{I(17.10°) + 0.65\{|I(17.50°) - I(17.10°)|\}} \quad (13)$$

$$3.04 \leq I_{11} + I_{12} + I_{13} \quad (E)$$

wherein, in Formulas (11) to (13), Imax (k to m°) is a maximum value of an X-ray diffraction intensity at a diffraction angle 2θ between k to m°, I (n°) is an X-ray diffraction intensity at a diffraction angle 2θ of n°, and k, m, and n are diffraction angles 2θ each shown in Formulas (11) to (13).

[5] The plated steel sheet according to any one of [1] to [4], wherein the plated layer contains a Zn phase, an Al phase, an Al—Zn phase, an η'-$MgZn_2$ phase, and a $MgZn_2$ phase.

Effects of the Invention

According to the present invention, it is possible to provide a plated steel sheet exhibiting high corrosion resistance in an acidic to alkaline environment.

BRIEF DESCRIPTION OF THE DRAWING

FIG. 1 is a schematic view for explaining Formula (1).

EMBODIMENT OF THE INVENTION

When a Zn phase and an Al phase are present as a single metal phase in the plated layer, the properties of an amphoteric metal tend to appear in the plated layer. In addition, the corrosion resistance of the plated layer is changed by changing the presence form of the phases contained in the plated layer. Furthermore, Al and Zn have close atomic radii, and thus easily dissolve each other in the plated layer. Therefore, in addition to the Zn phase and the Al phase, an Al—Zn phase (Al: 15 mass to 25 mass %, about 20 mass % of Al is preferably contained) is easily formed in the plated layer containing Zn and Al. However, since the Zn phase and the Al—Zn phase are phases having low corrosion resistance and have extremely low corrosion resistance particularly in an acidic environment and an alkaline environment, it is necessary to reduce the contents of these phases. In addition, a phase containing Mg generally has high corrosion resistance in an alkaline environment, but does not have very high corrosion resistance in an acidic environment.

In order to improve corrosion resistance in an acidic environment, the present inventors have found that it is effective to eliminate the Al—Zn phase, reduce the amount of the Zn phase, or form an intermetallic compound containing Al and Zn by containing other additive elements. In particular, with regard to the intermetallic compound, Zn and Al usually each form a fine single phase and are separated into two phases in the Al—Zn phase, and therefore, the present inventors have found that it is effective to contain a Ca element in the plated layer as an element that generates an intermetallic compound of Zn and Al. When Ca is contained in the plated layer, a Ca—Al—Zn compound is formed, and the Al—Zn phase including a fine Zn phase and Al phase is reduced. The Ca—Al—Zn compound is a compound having a natural potential nobler than that of Al, and has a corrosion rate lower than that of the Al phase, and thus can improve corrosion resistance.

Meanwhile, when corrosion resistance in an acidic environment is improved by reducing the amount of the Zn phase in the plated layer, corrosion resistance in an alkaline environment is reduced. As a countermeasure, it is conceivable to reduce the Al phase. Since corrosion resistance in an alkaline environment is improved by reducing the Al phase, it is possible to prevent deterioration of corrosion resistance in an alkaline environment due to the reduction of the Zn phase.

In order to reliably improve corrosion resistance in an alkaline environment, it is conceivable to eliminate the Al—Zn phase or increase a $MgZn_2$ phase containing Mg. The $MgZn_2$ phase has good corrosion resistance in an alkaline environment. In order to further improve corrosion resistance in an alkaline environment, it is preferable to introduce a compound having more excellent alkali corrosion resistance than the $MgZn_2$ phase into the plated layer.

Examples of such a compound include an η'-$MgZn_2$ phase having a crystal structure different from that of the $MgZn_2$ phase. The η'-$MgZn_2$ phase has high corrosion resistance particularly in an alkaline environment, and the amount of element does not increase or decrease even when the $MgZn_2$ phase is transformed to the η'-$MgZn_2$ phase. Thus, the corrosion resistance in an alkaline environment can be improved without impairing corrosion resistance in an acidic environment. As described above, inclusion of the $MgZn_2$ phase and the η'-$MgZn_2$ phase makes it possible to form a plated layer having improved corrosion resistance in both an acidic environment and an alkaline environment. Hereinafter, the plated steel sheet according to an embodiment of the present invention will be described.

The plated steel sheet according to an embodiment of the present invention (hereinafter, plated steel sheet according to the present embodiment) is a plated steel sheet comprising a plated layer on a surface of a steel sheet, wherein the plated layer has an average chemical composition comprising, in mass %, Al: more than 15.0% and 30.0% or less, Mg: more than 5.0% and 15.0% or less, Sn: 0 to 0.70%, Bi: 0 to 0.35%, In: 0 to 0.35%, Ca: 0.03 to 0.60%, Y: 0 to 0.30%, La: 0 to 0.30%, Ce: 0 to 0.30%, Si: 0.01 to 0.75%, Cr: 0 to 0.25%, Ti: 0 to 0.25%, Ni: 0 to 1.00%, Co: 0 to 0.25%, V: 0 to 0.25%, Nb: 0 to 0.25%, Cu: 0 to 0.25%, Mn: 0 to 0.25%, Fe: 0 to 5.0%, Sr: 0 to 0.5%, Sb: 0 to 0.5%, Pb: 0 to 0.5%, B: 0 to 0.5%, Li: 0 to 0.5%, Zr: 0 to 0.5%, Mo: 0 to 0.5%, W: 0 to 0.5%, Ag: 0 to 0.5%, P: 0 to 0.5%, and a remainder of Zn and impurities, a total amount ΣA of Sn, Bi and In is 0% or more and less than 0.75%, a total amount ΣB of Ca, Y, La, and Ce is 0.03 to 0.60%, a total amount ΣC of Cr, Ti, Ni, Co, V, Nb, Cu, and Mn is 0 to 1.00%, Sn≤Si and 20.0≤Mg/Si are satisfied, and when $I_1$ to $I_3$ determined from X-ray diffraction peaks of $Al_{2.15}Zn_{1.85}Ca$, $I_4$ determined from an X-ray diffraction peak of $CaZn_2$, and Is and $I_6$ determined from X-ray diffraction peaks of η'-$MgZn_2$ are defined by the following Formulas (1) to (6) in an X-ray diffraction pattern of a surface of the plated layer, measured under conditions of an X-ray output of 40 kV and 150 mA using a Cu-Kα ray, the following Formulas (A) and (B).

$$I_1 = \frac{I\max(22.54 \sim 23.30°)}{I(22.54°) + 0.474\{|I(23.30°) - I(22.54°)|\}} \quad (1)$$

$$I_2 = \frac{I\max(31.00 \sim 32.00°)}{I(31.00°) + 0.62\{|I(32.00°) - I(31.00°)|\}} \quad (2)$$

$$I_3 = \frac{I\max(43.80 \sim 44.30°)}{I(43.50°) + 0.48\{|I(44.30°) - I(43.80°)|\}} \quad (3)$$

$$I_4 = \frac{I\max(33.00 \sim 33.80°)}{I(33.00°) + 0.4375\{|I(33.80°) - I(33.00°)|\}} \quad (4)$$

$$I_5 = \frac{I\max(26.00 \sim 26.40°)}{I(26.00°) + 0.375\{|I(26.40°) - I(26.00°)|\}} \quad (5)$$

$$I_6 = \frac{I\max(49.00 \sim 49.60°)}{I(49.00°) + 0.367\{|I(49.60°) - I(49.00°)|\}} \quad (6)$$

$$4.05 \leq I_1 + I_2 + I_3 + I_4 \quad (A)$$

$$2.05 \leq I_5 + I_6 \quad (B)$$

In Formulas (1) to (6), Imax (k to m°) is the maximum value of the X-ray diffraction intensity at a diffraction angle 2θ between k to m°, I (n°) is the X-ray diffraction intensity at a diffraction angle 2θ of n°, and k, m, and n are the diffraction angles 2θ each shown in Formulas (1) to (6).

Note that in the following description, the expression "%" of the content of each element in a chemical composition means "mass %". In addition, a numerical range represented by "to" means a range including numerical values described before and after "to" as a lower limit value and an upper limit value. A numerical range in which "more than" or "less than" is attached to a numerical value means a range not including these numerical values as the lower limit or the upper limit.

The "corrosion resistance" indicates a property that the plated steel sheet itself is hardly corroded. The Zn-based plated layer has a sacrificial corrosion protection effect action on a steel material. In the corrosion process of a plated steel sheet having a Zn-based plated layer, the plated layer corrodes and turns into white rust before the steel sheet corrodes, and after the plated layer turns into white rust and disappears, the steel sheet corrodes and generates red rust.

A steel sheet to be plated will be described.

The shape of the steel sheet is mainly a sheet material, but the size thereof is not particularly limited. Examples of the plated steel sheet in which a plated layer is formed on a sheet material include plated steel sheets manufactured in a normal hot-dip galvanizing step. Plated steel sheets manufactured in a step of immersing a sheet material in a molten metal and solidifying the molten metal, such as a continuous hot-dip galvanizing line (CGL) or a batch type hot-dip galvanizing step, correspond to these plated steel sheets. When the plated steel sheet manufactured by such a method is processed (including welding) and combined, the plated steel sheet can be processed into various products, and a steel structural member excellent in corrosion resistance can be manufactured.

The material of the original sheet of the steel sheet is not particularly limited. For example, a hot-rolled steel sheet shown in JIS G 3193:2019 and a cold-rolled steel sheet shown in JIS G 3141:2021 are the most common original sheets to be plated. Furthermore, for example, various steel sheets, such as general steel (SS material (rolled steel material for general structure)), pre-plated steel in which various metals are thinly plated (JIS G 3302:2019), Al-killed steel, ultra-low carbon steel, high carbon steel, various high tensile strength steels (JIS G 3135:2018), and some high-alloy steels (steels containing an element for reinforcing corrosion resistance, such as Ni or Cr, JIS G 3114:2016, etc.) are applicable. In addition, conditions of the steel sheet, such as a method of making a steel material (blast furnace material, electric furnace material) and a method of manufacturing a steel sheet (hot rolling method, pickling method, cold rolling method, and the like) are not particularly limited. Furthermore, in the case of applying a steel sheet material that is difficult to plate, a pre-plated steel sheet in which a plated layer of Zn, Ni, Sn, Fe, or an alloy of these elements is pre-plated with a thickness of 30 μm or less on the surface of the steel sheet may be used. When such a pre-plated steel sheet is used, the metal elements in the pre-plated layer are replaced with the metal elements in the plating bath at the time of immersing the pre-plated steel sheet in a plating bath, and bare spots (portions where the plated metal is repelled by an oxide film or the like) are eliminated.

Next, the plated layer will be described. The plated layer according to the present embodiment includes a Zn—Al—Mg alloy layer. When an alloying element such as Al or Mg is added to Zn, corrosion resistance is improved. Therefore, such an alloy layer has corrosion resistance equivalent to that of a normal Zn plated layer even when it is a thin film, for example, half of the normal Zn plated layer. Therefore, also in the present embodiment, corrosion resistance equal to or higher than that of the normal Zn plated layer is ensured by the thin film plated layer. The plated layer may include an Al—Fe alloy layer.

The Zn—Al—Mg-based alloy layer is made of a Zn—Al—Mg-based alloy. The Zn—Al—Mg-based alloy means a ternary alloy containing Zn, Al, and Mg.

The Al—Fe alloy layer is an interface alloy layer between the steel sheet and the Zn—Al—Mg alloy layer.

That is, the plated layer according to the present embodiment may have a single-layer structure of the Zn—Al—Mg alloy layer or a multi-layer structure including the Zn—Al—Mg alloy layer and the Al—Fe alloy layer. In addition, when a pre-plated material coated with a metal having a high melting point (higher than 600° C.) is used as a plating base material, depending on the thickness of the original plated layer, traces may remain in any forms, such as a layer including the metal layer, with a thickness of less than 1 μm on the Fe surface, or a substitution compound of an Al—Fe intermetallic compound. The trace of metals dissolved at a temperature around the plating bath temperature hardly remains. In the case of the multi-layer structure, the Zn—Al—Mg alloy layer is preferably a layer constituting the surface of the plated layer. However, on the outermost surface of the plated layer, an oxide film of an element constituting the plated layer may be formed with a thickness of about less than 1 pin. Since an element contained in the plated layer is usually bonded to oxygen on the surface of the plated layer, there is a thin oxide film in which a bond of Zn—O, Mg—O, Al—O, Si—O, Ca—O, or the like is confirmed by surface analysis such as XPS (X-ray photoelectron spectroscopy). An element that is relatively easily oxidized tends to be present on the plating surface.

When the plated layer has a multi-layer structure including the Zn—Al—Mg alloy layer and the Al—Fe alloy layer, the steel material and the Zn—Al—Mg-based alloy layer are bonded via the Al—Fe alloy layer. The thickness of the interface alloy layer can be controlled by the plating bath temperature and the plating bath immersion time at the time of manufacturing the plated steel sheet. In the manufacturing method of a hot-dip plated steel sheet, such as the Sendzimir method, the Zn—Al—Mg alloy layer serves as a main body of the plated layer, and the thickness of the Al—Fe alloy layer is sufficiently small, and thus the influence on the corrosion resistance of the plated layer is small. In addition, the Al—Fe alloy layer is formed in the vicinity of the interface, and thus has almost no influence on the corrosion resistance in the initial stage of corrosion or the appearance of the plated layer.

When displacement plating such as two-stage plating or pre-plating is formed, elements contained in the pre-plated layer may be contained in the Al—Fe alloy layer depending on the thickness of the pre-plated layer. After plating is applied on the Fe surface, the elements may remain as the pre-plated layer, and an interface alloy layer may be formed thereon. In addition, when the plating elements are actively diffused and the plating components are diffused toward the Fe side, the Al—Fe alloy layer may be formed under the pre-plated layer. The Al—Fe alloy layer may be partially generated due to reactivity, and thus the position of the layer cannot be strictly defined. However, the performance change due to these layers is not large because the thicknesses thereof are thin.

Since the thickness of the entire plated layer depends on plating conditions, the thickness of the entire plated layer is not particularly limited. The thickness of the entire plated layer depends on, for example, the viscosity and specific gravity of the plating bath in a normal hot-dip plating method. Furthermore, the plating amount is adjusted by the basis weight according to the drawing speed of the steel sheet (original sheet to be plated) and the intensity of the wiping. The maximum value of the thickness of the plated layer formed by a normal hot-dip plating method is often 100 μm or less in continuous hot-dip plating and 200 μm or less in batch type plating.

The Al—Fe alloy layer is formed on the surface of the steel sheet (specifically, between the steel sheet and the Zn—Al—Mg alloy layer), and is a layer having an $Al_5Fe_2$ phase as a main phase in the microstructure. The Al—Fe alloy layer is formed by mutual atomic diffusion of a base metal (steel sheet) and a plating bath. When a hot-dip plating method is used as a method of forming a plated layer, the Al—Fe alloy layer is easily formed in a plated layer containing an Al element. In the manufacturing method described later, a certain concentration or more of Al is contained in the plating bath, and thus the $Al_5Fe_2$ phase is formed most. However, when Fe is bonded to Al in the interface alloy layer, a solid phase is generated in the plating bath. Unlike a liquid such as a plating bath, atomic diffusion of Al and Fe in the intermetallic compound takes time. As a result, a rate determining step of Al and Fe component concentrations occurs in the vicinity of the interface alloy layer. Therefore, a plurality of intermetallic compounds having different atom blending ratios are formed in the Al—Fe alloy layer, and generally, the closer to the interface, the higher the Fe concentration. However, depending on the degree of diffusion, there may be layers in which the contents of the Al component and the Fe component are temporarily low in the Al—Fe layer. Therefore, in addition to the $Al_5Fe_2$ phase, a small amount of an AlFe phase, an $Al_3Fe$ phase, and the like may be partially contained in the Al—Fe alloy layer. In addition, since a certain concentration of Zn is also contained in the plating bath, a small amount of Zn is also contained in the Al—Fe alloy layer. A small amount of Si that is likely to accumulate at the interface is also contained in the Al—Fe alloy layer.

When Si is contained in the plated layer, Si is particularly easily incorporated into the Al—Fe alloy layer, so that the Al—Fe alloy layer may be an Al—Fe—Si intermetallic compound phase. Examples of the intermetallic compound phase identified in the Al—Fe—Si intermetallic compound phase include an AlFeSi phase, and α, β, q1, q2-AlFeSi phases and the like exist as isomers. Therefore, these AlFeSi phases and the like may be detected in the Al—Fe alloy layer. A layer containing these AlFeSi phases and the like is referred to as an Al—Fe—Si alloy layer.

That is, the plated layer according to the present embodiment may include a Zn—Al—Mg alloy layer, may include a Zn—Al—Mg alloy layer and an Al—Fe alloy layer, or may include a Zn—Al—Mg alloy layer and an Al—Fe—Si alloy layer. In the Al—Fe alloy layer, Zn and the like having an atomic radius close to Al are inevitably partially incorporated as a substituent, and transition metals such as Ni, Cr, and Co having an atomic radius close to Fe are also inevitably incorporated as a substituent into these intermetallic compounds, but the main structure can be treated as the Al—Fe alloy layer.

Next, the average chemical composition of the plated layer will be described. When the plated layer has a single-layer structure of the Zn—Al—Mg alloy layer, the average chemical composition of the entire plated layer is the average chemical composition of the Zn—Al—Mg alloy layer. When the plated layer has a multi-layer structure of the Al—Fe alloy layer and the Zn—Al—Mg alloy layer, the average chemical composition of the entire plated layer is the average chemical composition of total of the Al—Fe alloy layer and the Zn—Al—Mg alloy layer. When the plated layer has a multi-layer structure of the Al—Fe—Si alloy layer and the Zn—Al—Mg alloy layer, the average chemical composition of the entire plated layer is the average chemical composition of total of the Al—Fe—Si alloy layer and the Zn—Al—Mg alloy layer.

In the hot-dip plating method, the chemical composition of the Zn—Al—Mg alloy layer is usually almost the same as that of the plating bath because the formation reaction of the plated layer is almost completed in the plating bath. In the hot-dip plating method, the Al—Fe alloy layer is instantaneously formed and grown immediately after immersion in the plating bath. Then, formation and growth reaction of the Al—Fe alloy layer are completed in the plating bath or after pulling up from the plating bath until the temperature reached around 550° C. in the subsequent plating solidification reaction. The thickness of the Al—Fe alloy layer is also sufficiently smaller than that of the Zn—Al—Mg alloy layer in many cases. Therefore, unless a special heat treatment such as a heat alloying treatment is performed after plating, the average chemical composition of the entire plated layer is substantially equal to the chemical composition of the Zn—Al—Mg alloy layer, and the components of the Al—Fe alloy layer can be ignored. Similarly to the Al—Fe alloy layer, the components of the Al—Fe—Si alloy layer can also be ignored.

First, elements contained in the plated layer according to the present embodiment will be described.

Al: More than 15.0% and 30.0% or Less

Similarly to Zn, Al is an element mainly constituting the plated layer. In the Zn—Al—Mg-based plating, an Al phase is mainly formed in the plated layer. When the Al content is 15.0% or less, corrosion resistance in an acidic environment is not sufficient. Therefore, the Al content is more than 15.0%. The Al content is preferably 18.0% or more. The Al content is more preferably 20% or more. On the other hand, when the Al content is more than 30.0%, corrosion resistance in an alkaline environment is not sufficient. Therefore, the Al content is 30.0% or less. The Al content is preferably 25.0% or less. Incidentally, when the Al content in the plated layer increases, the Zn content relatively decreases and the sacrificial corrosion resistance decreases. Therefore, the Al content should be more than 15.0% and 30.0% or less in order to ensure the sacrificial corrosion resistance as a plated steel sheet. However, in this composition range, an Al—Zn phase (phase containing about 20 mass % of Al) having low corrosion resistance is formed. Therefore, in the present embodiment, the Al—Zn phase is reduced by adopting a manufacturing method described later. As a result, corrosion resistance is improved, and corrosion resistance in an acidic environment and an alkaline environment is easily ensured.

Mg: More than 5.0% and 15.0% or Less

Similarly to Zn, Mg is an element mainly constituting the plated layer. When Mg is insufficient, corrosion resistance in an alkaline environment tends to be low, and thus the Mg content is more than 5.0%. The Mg content is preferably 7.0% or more. On the other hand, when the Mg content is more than 15.0%, corrosion resistance in an acidic environment deteriorates. Therefore, the Mg content is 15.0% or less. The Mg content is preferably 13.0% or less, and more preferably 10.0% or less.

Element Group A

Sn: 0 to 0.70%
Bi: 0 to 0.35%
In: 0 to 0.35%
Total amount ΣA of Sn, Bi and In: 0% or more and less than 0.75%

Since each element of the element group A (Sn, Bi, In) is an element that can be optionally contained, the content of each element is 0% or more. Sn is an element necessary for formation of $Mg_9Sn_5$ that significantly improves corrosion resistance of the plated layer in an acidic environment and an alkaline environment. Since the minimum Sn content required for the formation of $Mg_9Sn_5$ is 0.01%, the Sn content may be 0.01% or more.

Furthermore, elements exhibiting the same effect as Sn are Bi and In, and these elements form an intermetallic compound that improves corrosion resistance in an alkaline environment. $Bi_2Mg_3$, $InMg_3$, and the like correspond to such an intermetallic compound. Since Sn, Bi, and In form mutual substitution compounds, Sn may be contained in a range of 0.70% or less, and Bi and In may each be contained in a range of 0.35% or less. The elements of the element group A are effective in corrosion resistance in an alkaline environment, but when the contents of these elements exceed the upper limit, corrosion resistance in an acidic environment extremely deteriorates.

In addition, even when the total amount of elements of the element group A is excessive, corrosion resistance in an acidic environment deteriorates. Therefore, the total amount ΣA of Sn, Bi, and In is 0% or more and less than 0.75%. The total amount ΣA is preferably 0.01% or less, more preferably 0.05% or less, and still more preferably 0.10% or more. The total amount ΣA is preferably 0.60% or less, and more preferably 0.50% or less.

The total amount ΣA of Sn, Bi, and In is the total content of Sn, Bi, and In.

Element Group B

Ca: 0.03 to 0.60%
Y: 0 to 0.30%
La: 0 to 0.30%
Ce: 0 to 0.30%
Total amount ΣB of Ca, Y, La, and Ce: 0.03 to 0.60%

Ca is not a main element in the plated layer, but is an element necessary for forming $Al_{2.15}Zn_{1.55}Ca$. Ca is also an element necessary for forming $CaZn_2$. Therefore, the minimum Ca content required for forming these intermetallic compounds is 0.03% or more, and thus the Ca content is 0.03% or more. Inclusion of these intermetallic compounds improves corrosion resistance in an acidic environment and an alkaline environment. The Ca content is preferably 0.05% or more, more preferably 0.10% or more, and still more preferably 0.20% or more. On the other hand, when the Ca content is more than 0.60%, corrosion resistance in an acidic environment and an alkaline environment deteriorates. Therefore, the Ca content is 0.60% or less. The Ca content is preferably 0.50% or less, and more preferably 0.40% or less.

Elements that play a role similar to that of Ca are Y, La, and Ce. Since these elements are optional additive elements, the content of each element is 0% or more. These elements tend to be substituted with Ca. However, when Ca is not contained, even when Y, La, and Ce are contained, sufficient performance is not exhibited. When Ca is contained in the above content and Y, La, and Ce are each contained in a range of 0.30% or less, mutual substitution compounds are formed to improve corrosion resistance in an alkaline environment. However, when the contents of Y, La, and Ce each exceed 0.30%, corrosion resistance in an alkaline environment extremely deteriorates. Therefore, the contents of Y, La, and Ce are each 0.30% or less.

In addition, even when the total amount of elements of the element group B is excessive, corrosion resistance in an alkaline environment deteriorates. Therefore, the total amount ΣB of Ca, Y, La, and Ce is 0.03 to 0.60%. The total amount ΣB is preferably 0.05% or more, more preferably 0.10% or more, and still more preferably 0.20% or more. The total amount ΣB is preferably 0.50% or less, and more preferably 0.40% or less.

The total amount ΣB of Ca, Y, La, and Ce is the total content of Ca, Y, La, and Ce.

Si: 0.01 to 0.75%

Si is an element necessary for forming an intermetallic compound in the plated layer. Since the plating composition in the present embodiment has a high melting point, the operating temperature at the time of the hot-dip plating is around 500° C. At this operating temperature, when the steel sheet is immersed in the plating bath, Al and Zn cause an active mutual diffusion phenomenon with Fe to form an intermetallic compound, and Si suppresses this excessive reaction. When the Si content is 0.01% or more, the diffusion reaction of Fe is greatly suppressed, and the formation of the intermetallic compound contained in the plated layer is easily controlled. However, when the Si content is less than 0.01%, Fe excessively is diffused into the plated layer. As a result, components of the plated layer become non-uniform, and corrosion resistance in an acidic environment and an alkaline environment extremely deteriorates. Therefore, the Si content is 0.01% or more. The Si content is preferably 0.10% or more, and more preferably 0.20% or more. Even when the Si content is excessive, corrosion resistance in an acidic environment and an alkaline environment deteriorates due to bonding of Si to constituent elements of the plated layer, and thus the Si content is 0.75% or less. The Si content is preferably 0.50% or less, and more preferably 0.40% or less.

Si is an element that is extremely easily bonded to Ca, and easily forms various Al—Ca—Si compounds such as CaAlSi, $Al_2CaSi_2$, $Ca_2Al_4Si_3$, and $Ca_2Al_3Si_4$. In the present embodiment, it is preferable to produce free Ca in order to ensure corrosion resistance in an acidic environment and an alkaline environment, but when the Si content is high, these intermetallic compounds are easily formed.

Element Group C

Cr: 0 to 0.25%
Ti: 0 to 0.25%
Ni: 0 to 1.00%
Co: 0 to 0.25%
V: 0 to 0.25%
Nb: 0 to 0.25%
Cu: 0 to 0.25%
Mn: 0 to 0.25%
Total amount ΣC of Cr, Ti, Ni, Co, V, Nb, Cu, and Mn: 0 to 1.00%

Since the elements of the element group C are optional additive elements in the plated layer, the content of each element is 0% or more. These metals are substituted with Al, Zn, or the like in the plated layer, and the potentials thereof tend to move nobler. Therefore, when these metals are contained in the above range of content, the corrosion resistance in an acidic environment tends to be improved. When the contents of these elements are excessive, intermetallic compounds containing these elements are formed. Thus, corrosion resistance in an acidic environment and an alkaline environment deteriorates. Therefore, the contents of Cr, Ti, Co, V, Nb, Cu, and Mn are each 0.25% or less. The content of Ni is 1.00% or less. Furthermore, when the total amount of the element group C is excessive, corrosion resistance in an acidic environment and an alkaline environment deteriorates, and thus the total amount ΣC of Cr, Ti, Ni, Co, V, Nb, Cu, and Mn is 1.00% or less. The total amount ΣC is preferably 0.80% or less, and more preferably 0.50% or less.

The total amount ΣC of Cr, Ti, Ni, Co, V, Nb, Cu, and Mn is the total content of Cr, Ti, Ni, Co, V, Nb, Cu, and Mn.

Fe: 0 to 5.0%

Since the plated steel sheet according to the present embodiment is a hot-dip plated steel sheet, Fe may be diffused into the plated layer from the steel sheet (original sheet to be plated) during manufacturing. Fe may be contained up to 5.0% in the plated layer, but a change in corrosion resistance due to inclusion of this element has not been confirmed. Therefore, the Fe content is 0 to 5.0%.

Element Group D

Sr: 0 to 0.5%
Sb: 0 to 0.5%
Pb: 0 to 0.5%
B: 0 to 0.5%
Li: 0 to 0.5%
Zr: 0 to 0.5%
Mo: 0 to 0.5%
W: 0 to 0.5%
Ag: 0 to 0.5%
P: 0 to 0.5%

Since the elements of the element group D are optional additive elements that may be contained in the plated layer, the content of each element is 0% or more. These elements have the same effect as the elements of the element group C described above, and are elements that are relatively more easily contained than the element group C. Therefore, the content of each element of the element group D is 0 to 0.5%. The total amount ΣD of Sr, Sb, Pb, B, Li, Zr, Mo, W, Ag, and P may be 0 to 0.5%.

The total amount ΣD of Sr, Sb, Pb, B, Li, Zr, Mo, W, Ag, and P is the total content of Sr, Sb, Pb, B, Li, Zr, Mo, W, Ag, and P.

Remainder: Zn and Impurities

Zn is preferably contained in a proportion of more than 50.00%. The plated steel sheet according to the present embodiment is a highly versatile Zn-based plated steel sheet, and imparts an appropriate sacrificial corrosion resistance to the steel sheet by containing a certain amount or more of Zn for the purpose of ensuring the sacrificial corrosion resistance. For example, even in an environment where the cut end surface of 1.6 mm or more is exposed, when the Zn content exceeds 50.0%, a sufficient sacrificial corrosion protection effect appears on the cut end surface portion, and high corrosion resistance can be maintained. In particular, when the Zn content is 50.00% or less, corrosion resistance in an alkaline environment extremely deteriorates, and thus the Zn content is preferably more than 50.00%. The Zn content is preferably 55.00% or more, more preferably 60.00% or more, and still more preferably 65.00% or more.

The impurity refers to a component that is contained in a raw material or mixed in a manufacturing process and not intentionally contained, and/or a component acceptable within a range not adversely affecting the plated steel sheet according to the present embodiment. For example, in the plated layer, a small amount of components other than Fe may be mixed as the impurity due to mutual atomic diffusion between the steel sheet (base metal) and the plating bath.

Sn≤Si

The Si content needs to be equal to or more than the Sn content. When the Si content is less than the Sn content, excessive Fe is diffused from the steel sheet into the plated layer, and it becomes difficult to form a target intermetallic compound. As a result, corrosion resistance in an acidic environment and an alkaline environment deteriorates.

Sn and Si in "Sn≤Si" represent the contents of Sn and Si in mass % in the plated layer, respectively.

20.0≤Mg/Si

Furthermore, the Si content needs to satisfy 20.0≤Mg/Si. When the Si content is higher than the Mg content, a large amount of $Mg_2Si$ is formed in the plated layer, and corrosion resistance in an acidic environment cannot be sufficiently exhibited. In addition, when the Si content is higher than the Mg content, formation of the Al—Ca—Si compound is promoted, and the intermetallic compound ($Al_{2.15}Zn_{1.55}Ca$) is not formed. When Mg/Si exceeds 38.0, MgAlSi is not formed in the plated layer as described later. Therefore, when MgAlSi is formed in the plated layer, Mg/Si is preferably 38.0 or less. Mg and Si in "Mg/Si" represent the contents of Mg and Si in mass % in the plated layer, respectively.

3.00≤Al/Mg≤4.00

The Al content and the Mg content may satisfy 3.00≤Al/Mg≤4.00. When 3.00≤Al/Mg≤4.00 is satisfied, MgAlSi can be formed in the plated layer. Al and Mg in "Al/Mg" represent the contents of Al and Mg in mass % in the plated layer, respectively.

A method for identifying the average chemical composition of the plated layer will be described. First, an acid solution is obtained by peeling and dissolving the plated layer with an acid containing an inhibitor that suppresses corrosion of base metal (steel sheet). Next, the average chemical composition of the plated layer can be obtained by measuring the obtained acid solution by ICP emission spectrometry or ICP-MS. The acid species is not particularly limited as long as it is an acid capable of dissolving the plated layer. If the area and weight before and after peeling are measured, the plating adhesion amount ($g/m^2$) can also be obtained at the same time.

Next, the intermetallic compound contained in the plated layer will be described. Since the plated layer according to the present embodiment is formed by Zn—Al—Mg-based alloy plating, the plated layer contains a Zn phase, an Al phase, an Al—Zn phase, an η'-$MgZn_2$ phase, and a $MgZn_2$ phase as main phases. Although corrosion resistance varies depending on the content of each phase, by controlling the microstructure of the plating, such as inclusion of the intermetallic compound, a difference between corrosion resistance in an acidic environment at a pH of less than 3.5 and corrosion resistance in an alkaline environment at a pH of more than 11.5 is reduced, so that corrosion resistance can be ensured. The phases excluding the main phase are an Al—Ca—Si compound, a Mg—Sn compound, and the like, which are the intermetallic compounds described above based on the elements that are added in addition to Zn, Al, and Mg elements.

Zn Phase (η Phase: In Zn—Al Phase Diagram)

The Zn phase is present in the plated layer, and mainly present in the ternary eutectic structure (Zn/Al/$MgZn_2$ ternary eutectic structure). The Zn phase includes a Zn phase containing less than about 20 mass % of Al. The Zn phase in the plated layer can ensure corrosion resistance in an environment of pH 5.0 to 11.5, and the amount of corrosion in this range is small, but the corrosion rate in the other ranges is high.

Al Phase (α Phase: In Zn—Al Phase Diagram)

The Al phase is present in a massive form as an Al primary phase in the plated layer, and is also contained in a certain amount in the ternary eutectic structure. The Al phase in the plated layer can ensure corrosion resistance in an environment of pH 3.5 to 10.5, and the amount of corrosion in this range is small, but the corrosion rate in a range deviating from pH 3.5 to 10.5 is high.

The Al phase contains about 90 mass % of Al and the remainder Zn. Therefore, the Al phase strongly exhibits properties as Al, and the Al content thereof is different from that of the Al—Zn phase described later.

Al—Zn Phase (Constituent Components that Contain Al and Zn in Zn—Al Phase Diagram and Phase Other than α Phase and η Phase) and η'-$MgZn_2$ Phase The Al—Zn phase is a Zn phase containing about 20 mass % or more of Al, and exhibits properties of both the Al phase and the Zn phase. The Al—Zn phase is naturally generated when the plated layer according to the present embodiment is produced. The Al—Zn phase referred to herein is different from both the Al phase and the Zn phase, and is a phase composed of two elements of Al and Zn.

The Al—Zn phase is a phase generated by separation of the Zn phase from the Al phase during solidification of the plated layer, and is formed mainly due to a decrease in the solubility limit of the Al phase in the process of reaching room temperature. When the crystal size of the Al—Zn phase is confirmed, the Al—Zn phase is a microstructure in which fine crystal grains of several nm to about 3 μm are gathered. The reason why the Al—Zn phase exhibits performance of both the Zn phase and the Al phase is that the Al—Zn phase has an aggregate of the Zn phase and the Al phase in units of fine crystal grains therein. Therefore, the Al—Zn phase does not have any special property. Meanwhile, in the fine phase, a coupling reaction is promoted at crystal grain boundaries or adjacent phases having different potentials. Therefore, corrosion resistance of this phase tends to be inferior to corrosion resistance of the Al phase (α) and the Zn phase (η) in the plated layer.

The Al—Zn phase extremely deteriorates corrosion resistance in an acidic environment and an alkaline environment. However, the Al—Zn phase can be reduced by an appropriate heat treatment (heat treatment for forming the η'-$MgZn_2$ phase). Thus, there is no concern of deterioration of corrosion resistance in an acidic environment and an alkaline environment. By the heat treatment, the Al—Zn phase is reduced to generate η'-$MgZn_2$, so that corrosion resistance in a pH range of 3.5 10.5 is improved.

$MgZn_2$ Phase

The $MgZn_2$ phase is present in the plated layer and present in a massive form as the $MgZn_2$ phase. The $MgZn_2$ phase is also contained in a certain amount in a dendritic structure formed when the $MgZn_2$ phase is solidified together with the Al phase on an Al—$MgZn_2$ eutectic line, and a ternary eutectic structure (Zn/Al/$MgZn_2$). The $MgZn_2$ phase in the plated layer can improve corrosion resistance in a range of pH 5.0 to pH 11.5, and can reduce the amount of corrosion in this range. However, the $MgZn_2$ phase can hardly change the corrosion rate in other pH ranges. Since the $MgZn_2$ phase is the phase present in the largest amount among the phases included in the plated layer, the pH range in which corrosion resistance can be ensured by changing the ratio of the phase constitution is 3.5 to 11.5, and it is difficult to ensure corrosion resistance outside this range.

As a result of improving the plated layer for the purpose of ensuring corrosion resistance outside the pH range of 3.5 to 11.5, the present inventors have found that corrosion resistance outside the pH range of 3.5 to 11.5 can be ensured by formation of a specific intermetallic compound. In order to determine inclusion of the specific intermetallic compound in the plated layer, X-ray diffraction is preferably used. In this detection method, average information of the plated layer is obtained as compared with SEM observation, TEM observation, or the like, and the selectivity of the measurement site (field of view) is small and the quantification is excellent. If the measurement conditions are defined, when a specific intermetallic compound is present, a diffraction peak intensity is obtained at a fixed ratio at the same angle (2θ). Therefore, the internal structure of the plated layer can be easily estimated.

Conditions for obtaining an X-ray diffraction image are as follows.

As an X-ray source, X-ray diffraction targeting Cu is most convenient because average information of constituent phases in the plated layer can be obtained. As an example of measurement conditions, a Cu-Kα ray is used, and an X-ray output is set to a voltage of 40 kV and a current of 150 mA. The X-ray diffractometer is not particularly limited, and for example, a sample horizontal strong X-ray diffractometer RINT-TTR III manufactured by Rigaku Corporation can be used.

Intermetallic Compound: $Al_{2.15}Zn_{1.85}Ca$ $Al_{2.15}Zn_{1.85}Ca$ is a substance indicated by the database number (ICDD-JCPDS powder diffraction database) 01-078-9051. Ca—Al—Zn-based intermetallic compounds are widely introduced, for example, in (Z, Kristallogr. 224 (2009) 397 to 406), and form a structure similar to $Al_4Ca$ (partially Zn-substitution compound). Examples of the substance having the same structure as these compounds include substances which have been partially substituted with Zn (0 to 2.25) at the Al position, such as $Al_4Ca$, $Ca_{0.5}Zn_{3.5}$, $Al_3CaZn$, $Al_{2.5}CaZn_{1.5}$, $Al_{2.06}CaZn_{1.62}$, $Al_2CaZn_2$, and $Al_{1.75}CaZn_{2.25}$. These substances also exhibit a similar structure, and thus are estimated to have the same type of properties. However, since these substances are substitution compounds having different atomic radii, diffraction peaks thereof are not necessarily obtained at the same position. On the other hand, in the present embodiment, since a diffraction peak is obtained as $Al_{2.15}Zn_{1.85}Ca$ at a specific angle, this substance is regarded as being contained.

In the plating composition of the present embodiment, there are three angles that are convenient for detecting $Al_{2.15}Zn_{1.85}Ca$. That is, the angles are diffraction angles 2θ of 22.890 (101 plane), 31.670 (103 plane), and 43.94° (200 plane). The diffraction peaks appearing at these diffraction angles are convenient for quantification and determination of the content because these diffraction peaks do not overlap with the diffraction peaks of the main crystal structures of the plated layer. That is, when a diffraction peak at which the diffraction intensity exceeds a certain amount is obtained at these diffraction angles, it can be said that the intended intermetallic compound is reliably contained.

However, in the plated layer studied by the present inventors, a shift of the diffraction peak is slightly observed because the manufacturing situation of the intermetallic compound is not necessarily the same as and different from that of the JCPDS data. The diffraction angle corresponding to 22.890 (101 plane) is 22.90°, the diffraction angle corresponding to 31.670 (103 plane) is 31.62°, and the diffraction angle corresponding to 43.94° (200 plane) is 44.04°.

Intermetallic Compound: $CaZn_2$

This intermetallic compound is a substance indicated by (ICDD-JCPDS powder diffraction database) 01-072-5741. As a substitution compound, $Ca(Al_{1.7}Zn_{0.3})$ (JCPDS card 01-077-6005) is assumed. However, this substitution compound is a different substance mainly having a $CaAl_2$ structure and has a diffraction peak position different from that of $CaZn_2$, and thus is not a target in the present embodiment.

In the plating composition range of the present embodiment, an angle that is convenient for detecting $CaZn_2$ is only one angle, and is a diffraction angle 2θ of 33.35° (121 plane) (strongest line). The diffraction peak at this diffraction angle is convenient for quantification and determination of the content because the diffraction peak does not overlap with the diffraction peaks of the main crystal structures of the plated layer. That is, when a diffraction peak at which the diffraction intensity exceeds a certain amount is obtained at this diffraction angle, it can be said that the intended intermetallic compound is reliably contained. However, in the plated layer studied by the present inventors, a shift of the diffraction peak is slightly observed because the manufacturing situation of the intermetallic compound is not necessarily the same as and different from that of the JCPDS data, but a target diffraction peak may be the peak at 33.35°.

These intermetallic compounds of $Al_{2.15}Zn_{1.85}Ca$ and $CaZn_2$ form the plated layer of the plating composition in the present embodiment, and are formed by performing a special heat treatment. The intermetallic compounds are formed by substituting a part of $Al_4Ca$ with Zn originally precipitated as a Zn phase, or combining Ca, which is easily incorporated into another intermetallic compound as Al—Ca—Si, with Al and Zn.

In addition, as a result of individually examining the properties of these intermetallic compounds, it has been found that corrosion resistance at pH 3.0 (acidic environment) is improved. It is presumed that these intermetallic compounds are stable to acids, and thus improve corrosion resistance in an acidic environment.

On the other hand, since inclusion of these intermetallic compounds decreases the amount of the Zn phase in the plated layer, the corrosion resistance in an alkaline environment tends to slightly decrease in a pH of 10.0 or more.

In order to ensure corrosion resistance outside the pH range of 3.5 to 11.5, the following Formula (A) needs to be satisfied when $I_1$ to $I_3$ determined from X-ray diffraction peaks of $Al_{2.15}Zn_{1.85}Ca$ and 14 determined from an X-ray diffraction peak of $CaZn_2$ are defined by the following Formulas (1) to (4), respectively in an X-ray diffraction pattern of the surface of the plated layer, obtained by performing X-ray diffraction on the surface of the plated layer under conditions of an X-ray output of 40 kV and 150 mA using a Cu-Kα ray.

$$I_1 = \frac{I\max(22.54 \sim 23.30°)}{I(22.54°) + 0.474\{|I(23.30°) - I(22.54°)|\}} \quad (1)$$

$$I_2 = \frac{I\max(31.00 \sim 32.00°)}{I(31.00°) + 0.62\{|I(32.00°) - I(31.00°)|\}} \quad (2)$$

$$I_3 = \frac{I\max(43.80 \sim 44.30°)}{I(43.50°) + 0.48\{|I(44.30°) - I(43.80°)|\}} \quad (3)$$

$$I_4 = \frac{I\max(33.00 \sim 33.80°)}{I(33.00°) + 0.4375\{|I(33.80°) - I(33.00°)|\}} \quad (4)$$

$$4.05 \leq I_1 + I_2 + I_3 + I_4 \quad (A)$$

In the above Formulas (1) to (4), Imax (k to m°) is the maximum value of the X-ray diffraction intensity at a diffraction angle 2θ between k to m°, I (n°) is the X-ray diffraction intensity at a diffraction angle 2θ of n°, and k, m, and n are the diffraction angles 2θ each shown in the above Formulas (1) to (4).

That is, Imax (22.54 to 23.30°) in the above Formula (1) is the maximum value of the X-ray diffraction intensity at a diffraction angle 2θ between 22.54° to 23.30°, and I (22.54°) and I (23.30°) are the X-ray diffraction intensities at diffraction angles 2θ between 22.54° and 23.30°, respectively.

Imax (31.00 to 32.00°) in the above Formula (2) is the maximum value of the X-ray diffraction intensity at a diffraction angle 2θ between 31.00° to 32.00°, and I (31.00°) and I (32.00°) are the X-ray diffraction intensities at diffraction angles 2θ of 31.00° and 32.00°, respectively.

Imax (43.80 to 44.30°) in Formula (3) is the maximum value of the X-ray diffraction intensity at a diffraction angle 2θ between 43.80 to 44.30°, and I (43.80°) and I (44.30°) are the X-ray diffraction intensities at diffraction angles 2θ of 43.80° and 44.30°, respectively.

Imax (33.00 to 33.80°) in Formula (4) is the maximum value of the X-ray diffraction intensity at a diffraction angle 2θ between 33.00 to 33.80°, and I (33.00°) and I (33.80°) are the X-ray diffraction intensities at diffraction angles 2θ of 33.00° and 33.80°, respectively.

Formula (1) is a formula relating to the intensity of the diffraction peak of $Al_{2.15}Zn_{1.85}Ca$, and is a diffraction intensity ratio of the diffraction peak corresponding to 2θ=22.890 (101 plane) to the background intensity at 22.89°. Hereinafter, the denominator and the numerator of Formula (1) will be described.

The denominator (Imax (22.54 to 23.30°)) of Formula (1) is an intensity corresponding to the diffraction peak at 2θ=22.90° (101 plane) of the intermetallic compound $Al_{2.15}Zn_{1.55}Ca$, and is the maximum diffraction intensity of the diffraction peak including the background intensity. Since the diffraction angle 2θ of the (101) plane may deviate from 22.90° due to a measurement error of X-ray diffraction, a maximum value between 22.54 to 23.30° is acquired.

The numerator of Formula (1) is the background intensity at a diffraction angle 2θ of 22.90°, determined by calculation from the diffraction intensities at 22.54° and 23.30°. That is, as shown in FIG. 1, a straight line connecting the diffraction line at 22.540 and the diffraction line at 23.30° is drawn. This straight line is the baseline of the diffraction peak. Next, I (23.30°)−1 (22.54°) is obtained. In addition, the ratio (0.36/0.76=0.474) of the difference (0.36°) between 22.54° and 22.90° at the diffraction angle 2θ to the difference (0.76°) between 22.54° and 23.30° at the diffraction angle 2θ is obtained. Then, the background intensity at a diffraction angle 2θ of 22.89° is calculated by the formula described in the denominator of the above Formula (1).

By setting Formula (1) as described above, the intensity of the diffraction peak of the intermetallic compound $Al_{2.15}Zn_{1.55}Ca$ at 2θ=22.90° (101) can be accurately measured even when a measurement error or a fluctuation in the background occurs due to a difference in measurement conditions.

Although Formula (1) has been described, Formulas (2) to (4) and Formulas (5) to (13) described below are also set based on the same idea as Formula (1).

As shown in the above Formula (A), when the total of $I_1$, $I_2$, $I_3$ and L4 is 4.05 or more, corrosion resistance in an acidic environment is improved. The total of $I_1$, 12, 13 and 14 is more preferably 4.10 or more. On the other hand, since corrosion resistance in an alkaline environment tends to be poor as corrosion resistance in an acidic environment is improved, the total of $I_1$ to $I_4$ is preferably 4.15 or less.

Regarding the above Formula (A), when the Ca content is higher than the Si content of the plated layer, $Al_{2.15}Zn_{1.85}Ca$ and $CaZn_2$ are easily formed, and thus the Ca/Si ratio may be 0.40 to 0.70. In order to satisfy the above Formula (A), the chemical composition of the plated layer needs to satisfy the scope of the present invention, and an appropriate heat treatment needs to be performed in the manufacturing method.

Intermetallic Compound: η'-$MgZn_2$

η'-$MgZn_2$ is a substance indicated by (ICDD-JCPDS powder diffraction database) 01-073-2566. This intermetallic compound is widely introduced, for example, in (ACTA, METALLURGICA VOL, 18 Aug. 1970 881 to 890), but is a substance having a crystal structure different from that of $MgZn_2$ as a main phase. In the composition range of the plated layer according to the present embodiment, there are two diffraction angles 2θ that are convenient for detecting the intermetallic compound, and the diffraction angles 2θ are 26.20° (100 plane) and 49.220 (−221 plane). The diffraction peaks at these diffraction angles are convenient for quantification and determination of the content because these diffraction peaks do not overlap with the diffraction peaks of the main crystal structures of the plated layer. That is, when a diffraction peak at which the diffraction intensity exceeds a certain amount is obtained at these diffraction angles, it can be said that the intended intermetallic compound is reliably contained. However, in the plated layer studied by the present inventors, a shift of the diffraction peak is slightly observed because the manufacturing situation of the intermetallic compound is not necessarily the same as and different from that of the JCPDS data. The diffraction angle corresponding to 26.20° (100 plane) is 26.15°, and the diffraction angle corresponding to 49.220 (−221 plane) may be 49.22° as it is.

In order to ensure corrosion resistance outside the pH range of 3.5 to 11.5, the following Formula (B) needs to be satisfied when Is and I determined from X-ray diffraction peaks of η'-$MgZn_2$ are defined by the following Formulas (5) and (6) in an X-ray diffraction pattern of the surface of the plated layer, obtained by performing X-ray diffraction on the surface of the plated layer under conditions of an X-ray output of 40 kV and 150 mA using a Cu-Kα ray.

$$I_5 = \frac{I\max(26.00 \sim 26.40°)}{I(26.00°) + 0.375\{|I(26.40°) - I(26.00°)|\}} \quad (5)$$

-continued $$I_6 = \frac{I\max(49.00 \sim 49.60°)}{I(49.00°) + 0.367\{|I(49.60°) - I(49.00°)|\}} \quad (6)$$

$$2.05 \leq I_5 + I_6 \quad (B)$$

In the above Formulas (5) and (6), Imax (k to m°) is the maximum value of the X-ray diffraction intensity at a diffraction angle 2θ between k to m°, I (n°) is the X-ray diffraction intensity at a diffraction angle 2θ of n°, and k, m, and n are the diffraction angles 2θ each shown in the above Formulas (5) and (6).

That is, Imax (26.00° to 26.40°) in the above Formula (5) is the maximum value of the X-ray diffraction intensity at a diffraction angle 2θ of 26.00° to 26.40°, and I (26.00°) and I (26.40°) are the X-ray diffraction intensities at diffraction angles 2θ of 26.00° and 26.40°, respectively.

Imax (49.00° to 49.60°) in the above Formula (6) is the maximum value of the X-ray diffraction intensity at a diffraction angle 2θ of 49.00° to 46.60°, and I (49.00°) and I (49.60°) are the X-ray diffraction intensities at diffraction angles 2θ of 49.00° and 49.60°, respectively.

As shown in the above Formula (B), when the total of $I_5$ and $I_6$ is 2.05 or more, corrosion resistance in an acidic environment at pH 3.0 and an alkaline environment at pH 11.8 is improved. η'-$MgZn_2$ has higher corrosion resistance than normal $MgZn_2$. The total of 15 and $I_6$ is preferably a large value, but is preferably 2.30 or less.

Regarding the above Formula (B), when the Ca content is higher than the Si content of the plated layer, η'-$MgZn_2$ is easily formed, and thus the Ca/Si ratio is preferably 0.40 to 0.70. In order to satisfy the above Formula (B), the chemical composition of the plated layer needs to satisfy the scope of the present invention, and an appropriate heat treatment needs to be performed in the manufacturing method.

η'-$MgZn_2$ tends to form simultaneously with $Al_{2.15}Zn_{1.85}Ca$ and $Al_4Ca$, and it is considered that the complex and special crystal structure of η'-$MgZn_2$ affects the formation of the surrounding intermetallic compounds. The simultaneous formation of these intermetallic compounds improves both corrosion resistance in an acidic environment and an alkaline environment.

Intermetallic Compound: MgAlSi

Furthermore, when the plated layer has a specific component composition and satisfies specific manufacturing conditions, an intermetallic compound MgAlSi is formed in the plated layer. That is, when the average chemical composition of the plated layer satisfies 20.0≤Mg/Si≤38.0 and 3.00≤Al/Mg≤4.00, and the plated layer is held for a sufficient time in a temperature range where η'-$MgZn_2$ is easily formed, MgAlSi is formed.

This intermetallic compound MgAlSi is a substance indicated by (ICDD-JCPDS powder diffraction database) 01-074-9054. In the composition range of the plated layer according to the present embodiment, there are three diffraction angles that are convenient for detecting the intermetallic compound, and the diffraction angles are diffraction angles 2θ of 24.66° (011 plane), 46.35° (302 plane), and 49.150 (213 plane). The diffraction peaks at these diffraction angles are convenient for quantification and determination of the content because these diffraction peaks do not overlap with the diffraction peaks of the main crystal structures of the plated layer. That is, when a diffraction peak at which the diffraction intensity exceeds a certain amount is obtained at these diffraction angles, it can be said that the intended intermetallic compound is reliably contained. However, in the plated layer studied by the present inventors, a shift of the diffraction peak is slightly observed because the manufacturing situation of the intermetallic compound is not necessarily the same as and different from that of the JCPDS data. The diffraction angle 24.66° (011 plane) may be 24.660 as it is, the diffraction angle corresponding to 46.350 (302 plane) is 46.28°, and the diffraction angle 49.150 (213 plane) may be 49.15° as it is.

When $I_7$ to $I_9$ determined from X-ray diffraction peaks of MgAlSi are defined by the following Formulas (7) to (8) in an X-ray diffraction pattern of the surface of the plated layer, measured under conditions of an X-ray output of 40 kV and 150 mA using a Cu-Kα ray, the following Formula (C) is preferably satisfied.

$$I_7 = \frac{I\max(24.30 \sim 24.90°)}{I(24.30°) + 0.60\{|I(24.90°) - I(24.30°)|\}} \quad (7)$$

$$I_8 = \frac{I\max(46.10 \sim 46.40°)}{I(46.10°) + 0.60\{|I(46.40°) - I(46.10°)|\}} \quad (8)$$

$$I_9 = \frac{I\max(49.00 \sim 49.60°)}{I(49.00°) + 0.25\{|I(49.60°) - I(49.00°)|\}} \quad (9)$$

$$3.05 \leq I_7 + I_8 + I_9 \quad (C)$$

In the above Formulas (7) to (9), Imax (k to m°) is the maximum value of the X-ray diffraction intensity at a diffraction angle 2θ between k to m°, I (n°) is the X-ray diffraction intensity at a diffraction angle 2θ of n°, and k, m, and n are the diffraction angles 2θ each shown in the above Formulas (7) to (9).

That is, Imax (24.30° to 24.90°) in Formula (7) is the maximum value of the X-ray diffraction intensity at a diffraction angle 2θ between 24.30° to 24.90°, and I (24.30°) and I (24.90°) are the X-ray diffraction intensities at diffraction angles 2θ of 24.30° and 24.90°, respectively.

Imax (46.10° to 46.40°) in the above Formula (8) is the maximum value of the X-ray diffraction intensity at a diffraction angle 2θ between 46.10° to 46.40°, and I (46.10°) and I (46.40°) are the X-ray diffraction intensities at diffraction angles 2θ of 46.10° and 46.40°, respectively.

Imax (49.00° to 49.60°) in the above Formula (9) is the maximum value of the X-ray diffraction intensity at a diffraction angle 2θ between 49.00° to 49.60°, and I (49.00°) and I (49.60°) are the X-ray diffraction intensities at diffraction angles 2θ of 49.00° and 49.60°, respectively.

As shown in the above Formula (C), when the total of $I_7$, $I_8$ and $I_9$ is 3.05 or more, corrosion resistance in an alkaline environment at a pH of more than 11.5 is further improved.

The total of 7, Is and $I_9$ may be 3.10 or less.

Intermetallic Compound: $Mg_9Sn_5$

Furthermore, when the average chemical composition of the plated layer satisfies 0.01≤Sn and the plated layer is held for a sufficient time in a temperature range where η'-$MgZn_2$ is easily formed, $Mg_9Sn_5$ is generated in the plated layer.

This intermetallic compound $Mg_9Sn_5$ is a substance indicated by (ICDD-JCPDS powder diffraction database) 01-072-8010. Usually, when Sn is contained in the Zn—Al—Mg-based plated steel sheet, for example, $Mg_2Sn$ (00-031-0812 or 01-080-4461) is formed, but $Mg_9Sn_5$ has a crystal structure completely different from those of these intermetallic compounds.

In the composition range of the plated layer according to the present embodiment, there is one diffraction angle that is convenient for detecting the intermetallic compound, and the diffraction angle is only a diffraction angle 2θ of 23.29°

(300 plane). The diffraction peak at this diffraction angle is convenient for quantification and determination of the content because the diffraction peak does not overlap with the diffraction peaks of the main crystal structures of the plated layer. That is, when a diffraction peak at which the diffraction intensity exceeds a certain amount is obtained at these diffraction angles, it can be said that the intended intermetallic compound is reliably contained. However, in the plated layer studied by the present inventors, a shift of the diffraction peak is slightly observed because the manufacturing situation of the intermetallic compound is not necessarily the same as and different from that of the JCPDS data. The diffraction angle corresponding to 23.29° (300 plane) is 23.40°.

When $I_{10}$ determined from an X-ray diffraction peak of $Mg_9Sn_5$ is defined by the following Formula (10) in an X-ray diffraction pattern of the surface of the plated layer, measured under conditions of an X-ray output of 40 kV and 150 mA using a Cu-Kα ray, the following Formula (D) is preferably satisfied.

$$I_{10} = \frac{I\max(23.10 \sim 23.80°)}{I(23.10°) + 0.43\{|I(23.80°) - I(23.10°)|\}} \quad (10)$$

$$1.04 \leq I_{10} \quad (D)$$

In the above Formula (10), Imax (23.10° to 23.80°) is the maximum value of the X-ray diffraction intensity at a diffraction angle 2θ between 23.10° to 23.80°, I (23.10°) is the X-ray diffraction intensity at a diffraction angle 2θ of 23.10°, and I (23.80°) is the X-ray diffraction intensity at a diffraction angle 2θ of 23.80°.

As shown in the above Formula (D), when $I_{10}$ is 1.04 or more, corrosion resistance in an alkaline environment at a pH of more than 11.5 is improved. The number of bonds between Sn and Mg is smaller in $Mg_9Sn_5$ than in $Mg_2Sn$. Thus, $Mg_9Sn_5$ has a natural potential slightly nobler than that of $Mg_2Sn$, and has a stable corrosion resistance in an alkaline environment.

$I_{10}$ may be 1.10 or less.

Metal Oxide

When the plated layer is held in a high-temperature region for a long time in order to form η'-$MgZn_2$ in the air environment, an oxide film may be formed on the surface of the plated layer. The presence or absence of formation of the oxide film is changed by heating in a nitrogen atmosphere.

Although the compound in this oxide film cannot be sufficiently specified, some diffraction peaks appear at a diffraction angle 2θ of 0 to 20° in X-ray diffraction. Thus, these peaks are assumed to be an oxide film caused by a metal oxide. The diffraction peaks at diffraction angles 2θ of 10.45°, 12.83°, and 17.360 are convenient for quantification and determination of the content because these diffraction peaks do not overlap with the diffraction peaks of the main crystal structures of the plated layer. That is, when a diffraction peak at which the diffraction intensity exceeds a certain amount is obtained at these diffraction angles, it can be said that the intended metal oxide is reliably contained.

When $I_{11}$ to $I_{13}$ determined from X-ray diffraction peaks of the metal oxide are defined by the following Formulas (11) to (13) in an X-ray diffraction pattern of the surface of the plated layer, measured under conditions of an X-ray output of 40 kV and 150 mA using a Cu-Kα ray, the following Formula (E) is preferably satisfied.

$$I_{11} = \frac{I\max(10.30 \sim 10.70°)}{I(10.30°) + 0.375\{|1(10.70°) - I(10.30°)|\}} \quad (11)$$

$$I_{12} = \frac{I\max(12.30 \sim 13.30°)}{I(12.30°) + 0.53\{|I(13.30°) - I(12.30°)|\}} \quad (12)$$

$$I_{13} = \frac{I\max(17.10 \sim 17.50°)}{I(17.10°) + 0.65\{|I(17.50°) - I(17.10°)|\}} \quad (13)$$

$$3.04 \leq I_{11} + I_{12} + I_{13} \quad (E)$$

In the above Formulas (11) to (13), Imax (k to m°) is the maximum value of the X-ray diffraction intensity at a diffraction angle 2θ between k to m°, I (n°) is the X-ray diffraction intensity at a diffraction angle 2θ of n°, and k, m, and n are the diffraction angles 2θ each shown in the above Formulas (11) to (13).

That is, Imax (10.30° to 10.70°) in the above Formula (11) is the maximum value of the X-ray diffraction intensity at a diffraction angle 2θ between 10.30° to 10.70°, and I (10.30°) and I (10.70°) are the X-ray diffraction intensities at diffraction angles 2θ of 10.30° and 10.70°, respectively.

Imax (12.30° to 13.30°) in the above Formula (12) is the maximum value of the X-ray diffraction intensity at a diffraction angle 2θ between 12.30° to 13.30°, and I (12.30°) and I (13.30°) are the X-ray diffraction intensities at diffraction angles 2θ of 12.30° and 13.30°, respectively.

Imax (17.10° to 17.50°) in the above Formula (13) is the maximum value of the X-ray diffraction intensity at a diffraction angle 2θ between 17.10° to 17.50°, and I (17.10°) and I (17.50°) are the X-ray diffraction intensities at diffraction angles 2θ of 17.10° and 17.50°, respectively.

As shown in the above Formula (E), when the total of $I_{11}$, $I_{12}$ and $I_{13}$ is 3.04 or more, corrosion resistance on an alkaline environment side at a pH of more than 11.5 is improved.

The total of $I_1$, $I_{12}$, and $I_{13}$ may be 3.10 or less.

Next, a manufacturing method of a plated steel sheet according to the present embodiment will be described.

The plated steel sheet according to the present embodiment includes a steel sheet and a plated layer formed on a surface of the steel sheet. Zn—Al—Mg-based plating usually forms a plated layer by metal deposition and solidification reaction. The easiest means for forming the plated layer is to form the plated layer on the surface of the steel sheet by a hot-dip plating method. The plated layer can be formed by, for example, a Sendzimir method, or a flux method.

Hereinafter, a case where the plated steel sheet according to the present embodiment is manufactured by a hot-dip plating method will be described. The plated steel sheet according to the present embodiment can be manufactured by either an immersion type plating method (batch type) or a continuous type plating method.

The size, shape, surface morphology, and the like of the steel sheet to be plated are not particularly limited. Normal steel sheets, stainless steels, and the like can be applicable as long as they are steel sheets. Steel strips of general structural steel are most preferred. The surface of the steel sheet may be finished by shot blasting or the like in advance. There is no problem even if plating is performed after a metal film or an alloy film of Ni, Fe, or Zn plating, or the like is adhered in an adhesion amount of 3 g/$m^2$ or less to the surface. It is also possible to use a plated base sheet or a zinc-plated sheet (hot-dip Zn-plated steel sheet or electroplated steel sheet) of 150 g/m$^2$ or less. In addition, as a pretreatment, it is preferable to sufficiently clean the steel sheet by degreasing and pickling.

After the surface of the steel sheet is sufficiently heated and reduced by a reducing gas such as $H_2$, the steel sheet is immersed in a plating bath prepared to have predetermined components.

In the case of the hot-dip plating method, the components of the plated layer can be controlled by the components of the plating bath to be prepared. The plating bath is prepared by mixing predetermined amounts of pure metals by a dissolution method under an inert atmosphere, for example.

By immersing a steel sheet whose surface has been reduced in a plating bath maintained at a predetermined concentration, a plated layer having substantially the same components as that of the plating bath is formed. When the immersion time is prolonged or it takes a long time to complete solidification, the formation of the interface alloy layer becomes active, so that the Fe content in the plated layer may increase. When the bath temperature of the plating bath is lower than 500° C., the reaction between the steel sheet and the plated layer is rapidly slowed, so that the content of Fe contained in the plated layer usually falls within less than 5.0%.

In order to form the plated layer, it is preferable to immerse the reduced steel sheet in the plating bath at 500 to 650° C. for several seconds. On the surface of the reduced steel sheet, Fe diffuses into the plating bath and reacts with the components in the plating bath to form an interface alloy layer (mainly an Al—Fe alloy layer) at the interface between the plated layer and the steel sheet. The interface alloy layer metal-chemically bonds the steel sheet below and the plated layer above the interface alloy layer.

After the steel sheet is immersed in the plating bath for a predetermined time, the steel sheet is pulled up from the plating bath. When the metal adhered to the surface is in a molten state, $N_2$ wiping is performed, whereby the thickness of the plated layer is adjusted to a predetermined thickness. The thickness of the plated layer is preferably adjusted to 3 to 80 kin. When the above thickness is converted into the adhesion amount of the plated layer, the adhesion amount is 10 to 500 g/m$^2$ (one surface). The thickness of the plated layer may also be adjusted to 5 to 70 μm. When the above thickness is converted into the adhesion amount of the plated layer, the adhesion amount is 20 to 400 g/m$^2$ (one surface).

After preparing the adhesion amount of the plated layer, the adhered molten metal is solidified. Cooling means in the solidification of the plating may be performed by blowing nitrogen, air, or a mixed gas of hydrogen and helium, mist cooling, or immersion in water. The cooling means in the solidification of the plating is preferably mist cooling, and more preferably mist cooling in which water is contained in nitrogen. The cooling rate may be adjusted by the content of water. When it is desired to form an oxide film or the like on the plating surface, manufacturing may be performed by cooling under an air environment. Meanwhile, in order to avoid formation of the oxide film and the like, it is preferable to perform cooling with $N_2$ gas by cooling in, for example, a $N_2$ replacement furnace in which the oxygen concentration is lowered to less than 20 ppm.

As preferable conditions for manufacturing the plated layer according to the present embodiment, the average cooling rate at 500 to 480° C. is preferably 30° C./sec or more in cooling during plating solidification. Since intermetallic compounds such as Al—Ca—Si or $Mg_2Si$ are easily formed at 500 to 480° C., rapid cooling in this temperature range makes it difficult to precipitate these compounds. Specifically, when cooling is performed by means of cooling at an extremely high cooling rate, such as immersion in a refrigerant (for example, water) having a temperature of about 30° C. (room temperature), corrosion resistance in an acidic environment and an alkaline environment tends to increase.

Next, an aging treatment is performed. The formation of the intermetallic compounds of $Al_{2.5}Zn_{1.85}Ca$, $CaZn_2$, η'-$MgZn_2$, MgAlSi, and $Mg_9Sn_5$, which are important in the present embodiment, is performed by an aging treatment involving holding at a low temperature for a long time. The temperature in the aging treatment needs to be strictly limited to the lower limit and the upper limit.

The temperature range of the aging treatment is 80 to 140° C., and more preferably 90 to 110° C. When the temperature is lower than 80° C., the temperature is too low to form desired intermetallic compounds, and the Al—Zn phase (about 20 mass % of Al) remains to deteriorate corrosion resistance. When the temperature exceeds 140° C., the phases other than desired intermetallic compounds are actively formed, and particularly the Al—Zn phase (about 20 mass % of Al) is stabilized, so that corrosion resistance further deteriorates. In addition, the $MgZn_2$ phase is more stabilized than the η'-$MgZn_2$ phase, and the η'-$MgZn_2$ phase is not formed.

The holding time of the aging treatment is 72 to 750 hours. The intermetallic compounds can be formed by aging for 72 hours or more. In addition, excessive oxidation and deterioration of corrosion resistance of the plated layer can be prevented by aging for 750 hours or less. More preferably, the holding time is 250 hours or more and 500 hours or less.

The atmosphere in the aging treatment is not particularly limited. The aging treatment may be performed in the air or in an inert atmosphere such as a nitrogen or argon atmosphere.

The $Mg_2Zn_{11}$ phase may be formed in the plated layer in addition to the η'-$MgZn_2$ phase by the aging treatment, but deterioration of corrosion resistance due to the formation of the $Mg_2Zn_{11}$ phase has not been confirmed. It is assumed that the $Mg_2Zn_{11}$ phase is formed as a by-product by the crystal structure to η'-$MgZn_2$.

When the aging treatment is performed, MgAlSi is further formed if the contents of Mg, Al, and Si satisfy a desired relationship. When desired amounts of Sn and the like are contained in the plated layer, $Mg_9Sn_5$ is easily formed. Furthermore, when the aging treatment is performed in the air environment, the metal oxide is formed on the surface.

Thus, the plated layer of the plated steel sheet defined in the present embodiment is completed.

After the aging treatment, various chemical conversion treatments and coating treatments may be performed. It is also possible to apply a plated layer of Cr, Ni, Au, or the like by utilizing an uneven pattern on the plating surface, and further apply coating to impart a design. In addition, in order to further enhance the corrosion resistance, repair touch-up paint, thermal spraying treatment, and the like may be performed in a welded portion, a processed portion, and the like.

In the plated steel sheet according to the present embodiment, a coating may be formed on the plated layer. A coating composed of a single layer or two or more layers may be formed. Examples of the type of the coating immediately above the plated layer include a chromate coating, a phosphate coating, and a chromate-free coating. The chromate treatment, the phosphating treatment, and the chromate-free treatment for forming these coatings can be performed by known methods.

The chromate treatment includes an electrolytic chromate treatment in which a chromate coating is formed by electrolysis, a reaction type chromate treatment in which a coating is formed by utilizing a reaction with a material and then an excess treatment liquid is washed away, and an application type chromate treatment in which a coating is formed by applying a treatment liquid to an object to be coated and drying the treatment liquid without washing with water. Any treatment may be adopted. When a coating is provided on the surface of the plated layer, the above X-ray diffraction is performed after the coating is completely removed by wet polishing or the like so that heat is not applied to the plated layer by mechanical removal.

Examples of the electrolytic chromate treatment include electrolytic chromate treatments using chromic acid, a silica sol, a resin (phosphate, acrylic resin, vinyl ester resin, vinyl acetate acrylic emulsion, carboxylated styrene-butadiene latex, diisopropanolamine-modified epoxy resin, and the like), and hard silica.

Examples of the phosphating treatment include zinc phosphate treatment, zinc calcium phosphate treatment, and manganese phosphate treatment.

The chromate-free treatment which does not impose a burden on the environment is particularly suitable. The chromate-free treatment includes an electrolytic chromate-free treatment in which a chromate-free coating is formed by electrolysis, a reaction type chromate-free treatment in which a coating is formed by utilizing a reaction with a material and then an excess treatment liquid is washed away, and an application type chromate-free treatment in which a coating is formed by applying a treatment liquid to an object to be coated and drying the treatment liquid without washing with water. Any treatment may be adopted.

Furthermore, an organic resin coating composed of a single layer or two or more layers may be provided on the coating immediately above the plated layer. The organic resin is not limited to a specific type, and examples thereof include polyester resins, polyurethane resins, epoxy resins, acrylic resins, polyolefin resins, and modified products of these resins. Here, the modified product refers to a resin obtained by reacting a reactive functional group included in the structure of these resins with another compound (a monomer, a crosslinking agent, or the like) having a functional group capable of reacting with the functional group in the structure.

As such an organic resin, one type or two or more types of organic resins (unmodified organic resins) may be mixed and used, or one type or two or more types of organic resins obtained by modifying, in the presence of at least one type of organic resin, at least one type of another organic resin may be mixed and used. The organic resin coating may contain any coloring pigment or rust preventive pigment. It is also possible to use a water-based pigment prepared by dissolving or dispersing these pigments in water.

In the present embodiment, corrosion resistance in an acidic environment and an alkaline environment is measured and evaluated as follows.

Method for Measuring Corrosion Resistance in Acidic Environment

Pure water is adjusted to pH 3.0 by dropwise addition of dilute sulfuric acid (0.4 vol %) to prepare 1 liter of an acid solution (normal temperature: 23° C.).

A test piece is immersed in the acid solution for 1 second, pulled up, and then left standing in an open-to-air drying furnace set at a temperature of 50° C. and a humidity of less than 10% for 24 hours.

This operation is defined as 1 cycle, and 60 cycles are repeated.

After 60 cycles, the test piece is immersed in 30 wt % chromic acid (VI) (normal temperature: 23° C.) to remove corrosion products formed on the surface of the plated layer. The corrosion loss before and after the test is measured to determine superiority or inferiority of corrosion resistance in an acidic environment (evaluation is performed in 6 grades). When the evaluation is D to S+, it can be determined that corrosion resistance in an acidic environment is excellent.

A case where the corrosion loss after 60 cycles is less than 5 g/m$^2$ is evaluated as corrosion resistance "S+" on an acidic environment side.

A case where the corrosion loss after 60 cycles is 5 g/m$^2$ or more and less than 10 g/m$^2$ is evaluated as corrosion resistance "S" in an acidic environment.

A case where the corrosion loss after 60 cycles is 10 g/m$^2$ or more and less than 15 g/m$^2$ is evaluated as corrosion resistance "A+" in an acidic environment.

A case where the corrosion loss after 60 cycles is 15 g/n$^2$ or more and less than 20 g/m$^2$ is evaluated as corrosion resistance "A" in an acidic environment.

A case where the corrosion loss after 60 cycles is 20 g/m$^2$ or more and less than 30 g/m$^2$ is evaluated as corrosion resistance "B" in an acidic environment.

A case where the corrosion loss after 60 cycles is 30 g/m$^2$ or more and less than 40 g/m$^2$ is evaluated as corrosion resistance "C" in an acidic environment.

A case where the corrosion loss after 60 cycles is 40 g/m$^2$ or more and less than 50 g/m$^2$ is evaluated as corrosion resistance "D" in an acidic environment.

A case where the corrosion loss after 60 cycles is 50 g/m$^2$ or more is evaluated as corrosion resistance "E" in an acidic environment.

Method for Measuring Corrosion Resistance in Alkaline Environment

Pure water is adjusted to pH 11.8 by dropwise addition of aqueous ammonia (3 vol %) to prepare 1 liter of an alkaline solution (normal temperature: 23° C.).

A test piece is immersed in the alkaline solution for 1 second, pulled up, and then left standing in an open-to-air drying furnace set at a temperature of 50° C. and a humidity of less than 10% for 24 hours.

This operation is defined as 1 cycle, and 60 cycles are repeated.

After 60 cycles, the test piece is immersed in 30 wt % chromic acid (VI) (normal temperature: 23° C.) to remove corrosion products formed on the surface of the plated layer. The corrosion loss before and after the test is measured to determine superiority or inferiority of corrosion resistance in an alkaline environment. When the evaluation is D to S+, it can be determined that corrosion resistance in an alkaline environment is excellent.

A case where the corrosion loss after 60 cycles is less than 5 g/m$^2$ is evaluated as corrosion resistance "S+" in an alkaline environment.

A case where the corrosion loss after 60 cycles is 5 g/m$^2$ or more and less than 10 g/m$^2$ is evaluated as corrosion resistance "S" in an alkaline environment.

A case where the corrosion loss after 60 cycles is 10 g/m$^2$ or more and less than 15 g/m$^2$ is evaluated as corrosion resistance "A+" in an alkaline environment.

A case where the corrosion loss after 60 cycles is 15 g/m$^2$ or more and less than 20 g/m$^2$ is evaluated as corrosion resistance "A" in an alkaline environment.

A case where the corrosion loss after 60 cycles is 20 g/m$^2$ or more and less than 30 g/m$^2$ is evaluated as corrosion resistance "B+" in an alkaline environment.

A case where the corrosion loss after 60 cycles is 30 g/m$^2$ or more and less than 35 g/m$^2$ is evaluated as corrosion resistance "B" in an alkaline environment.

A case where the corrosion loss after 60 cycles is 35 g/m$^2$ or more and less than 40 g/m$^2$ is evaluated as corrosion resistance "C" in an alkaline environment.

A case where the corrosion loss after 60 cycles is 40 g/m$^2$ or more and less than 50 g/m$^2$ is evaluated as corrosion resistance "D" in an alkaline environment.

A case where the corrosion loss after 60 cycles is 50 g/m$^2$ or more is evaluated as corrosion resistance "E" in an alkaline environment.

EXAMPLES

Next, the effects of one aspect of the present invention will be more specifically described with reference to Examples, but the conditions in Examples are one condition example adopted to confirm the feasibility and effects of the present invention, and the present invention is not limited to this one condition example. The present invention can adopt various conditions as long as the object of the present invention is achieved without departing from the gist of the present invention.

Plated steel sheets shown in Tables 2A-1 to 6B-2 were manufactured, and the performance was evaluated.

Various plating baths were prepared by mixing pure metals. An Fe powder was added to the components of the plating alloy after preparation of the plating bath so that the Fe concentration did not increase during the test.

The value described as "0" in the table indicates that the value was less than 0.005% (detection limit value) in ICP.

As the steel sheet of the plated steel sheet, a steel sheet (1.6 mm) having a size of 180×100 was used. A cold-rolled steel sheet shown in JIS G 3141:2021 was used. A batch-type hot-dip plating simulator (manufactured by our company) was used for forming the plated layer. A K thermocouple was attached to a part of the plated steel sheet, and annealing was performed by heating and holding the steel sheet at 800° C. in an atmosphere of a mixed gas of $N_2$ (95 vol %) and $H_2$ (5 vol %), to thereby sufficiently reduce the surface of the steel sheet. Thereafter, the steel sheet was immersed in a plating bath having a bath temperature of 500 to 650° C. for 3 seconds, and then pulled up. The thickness of the plated layer was adjusted to 25 to 30 μm by $N_2$ gas wiping.

In the heat treatment after the $N_2$ gas wiping, the following three patterns of cooling were performed. In Tables 1A-1 to 1B-2, the pattern of cooling is described as "plating method".

A: After $N_2$ gas wiping, cooling was performed by immersing the plated sheet in water from 500° C. (cooling rate: 100° C./sec or more: the temperature reached water temperature (about 30° C.) within 2 seconds).

B: After $N_2$ gas wiping, cooling was performed by blowing $N_2$ gas so that the average cooling rate at 500 to 480° C. was 40° C./sec, and then blowing $N_2$ gas so that the average cooling rate at 480 to 50° C. was 10 to 20° C./sec.

C: After $N_2$ gas wiping, cooling was performed by blowing $N_2$ gas so that the average cooling rate at 500 to 50° C. was 10 to 20° C./sec.

Thereafter, as shown in Tables 1A-1 to 1B-2, each sample was subjected to a heat treatment (aging treatment). In Tables 1A-1 to 1B-2, "atmosphere" represents an atmosphere during the aging treatment, "reheating temperature" represents a heating temperature during the aging treatment, and "time" represents a holding time during the aging treatment.

The obtained plated steel sheet was cut into a 20 mm square, and the X-ray diffraction pattern of the surface of the plated layer was analyzed using a sample horizontal strong X-ray diffractometer (model number: RINT-TTR III) manufactured by Rigaku Corporation. Specifically, measurement was performed using a Cu-Kα ray under conditions of X-ray output: 40 kV and 150 mA, copper target, goniometer TTR (horizontal goniometer), slit width of KP filter: 0.05 mm, longitudinal limiting slit width: 2 mm, light receiving slit width: 8 mm, and light receiving slit 2: open, and under the measurement conditions of scan speed: 5 deg./min, step width: 0.01 deg, and scan axis: 2θ (5 to 90°), to obtain X-ray diffraction intensity at each angle.

The corrosion resistance in an acidic environment and an alkaline environment was measured and evaluated as follows. The results are shown in Tables 7A-1 to 7B-2.

Method for Measuring Corrosion Resistance in Acidic Environment

Pure water was adjusted to pH 3.0 by dropwise addition of dilute sulfuric acid (0.4 vol %) to prepare 1 liter of an acid solution (normal temperature: 23° C.). Next, a test piece was immersed in the acid solution for 1 second, pulled up, and then left standing in an open-to-air drying furnace set at a temperature of 50° C. and a humidity of less than 10% for 24 hours. This operation was defined as 1 cycle, and 60 cycles were repeated. After 60 cycles, the test piece was immersed in 30 wt % chromic acid (VI) (normal temperature: 23° C.) to remove corrosion products formed on the surface of the plated layer. The corrosion loss before and after the test was measured to determine superiority or inferiority of corrosion resistance in an acidic environment (evaluation was performed in 6 grades).

Cases where the evaluation was D to S+ were determined to be acceptable as being excellent in corrosion resistance in an acidic environment. On the other hand, a case where the evaluation was E was determined to be unacceptable as being inferior in corrosion resistance in an acidic environment.

A case where the corrosion loss after 60 cycles was less than 5 g/m$^2$ was evaluated as corrosion resistance "S+" on an acidic environment side.

A case where the corrosion loss after 60 cycles was 5 g/m$^2$ or more and less than 10 g/m$^2$ was evaluated as corrosion resistance "S" on an acidic environment side.

A case where the corrosion loss after 60 cycles was 10 g/m$^2$ or more and less than 15 g/m$^2$ was evaluated as corrosion resistance "A+" in an acidic environment.

A case where the corrosion loss after 60 cycles was 15 g/m$^2$ or more and less than 20 g/m$^2$ was evaluated as corrosion resistance "A" in an acidic environment.

A case where the corrosion loss after 60 cycles was 20 g/m$^2$ or more and less than 30 g/m$^2$ was evaluated as corrosion resistance "B" in an acidic environment.

A case where the corrosion loss after 60 cycles was 30 g/m$^2$ or more and less than 40 g/m$^2$ was evaluated as corrosion resistance "C" in an acidic environment.

A case where the corrosion loss after 60 cycles was 40 g/m$^2$ or more and less than 50 g/m$^2$ was evaluated as corrosion resistance "D" in an acidic environment.

A case where the corrosion loss after 60 cycles was 50 g/m$^2$ or more was evaluated as corrosion resistance "E" in an acidic environment.

Method for measuring corrosion resistance in alkaline environment Pure water was adjusted to pH 11.8 by dropwise addition of aqueous ammonia (3 vol %) to prepare 1 liter of an alkaline solution (normal temperature: 23° C.). Next, a test piece was immersed in the alkaline solution for 1 second, pulled up, and then left standing in an open-to-air drying furnace set at a temperature of 50° C. and a humidity of less than 10% for 24 hours. This operation was defined as 1 cycle, and 60 cycles were repeated. After 60 cycles, the test piece was immersed in 30 wt % chromic acid (VI) (normal temperature: 23° C.) to remove corrosion products formed on the surface of the plated layer. The corrosion loss before and after the test was measured to determine superiority or inferiority of corrosion resistance.

A case where the corrosion loss after 60 cycles was less than 5 g/m$^2$ was evaluated as corrosion resistance "S+" on an alkaline environment side.

A case where the corrosion loss after 60 cycles was 5 g/m$^2$ or more and less than 10 g/m$^2$ was evaluated as corrosion resistance "S" on an alkaline environment side.

A case where the corrosion loss after 60 cycles was 10 g/m$^2$ or more and less than 15 g/m$^2$ was evaluated as corrosion resistance "A+" in an alkaline environment.

A case where the corrosion loss after 60 cycles was 15 g/m$^2$ or more and less than 20 g/m$^2$ was evaluated as corrosion resistance "A" in an alkaline environment.

A case where the corrosion loss after 60 cycles was 20 g/m$^2$ or more and less than 30 g/m$^2$ was evaluated as corrosion resistance "B+" in an alkaline environment.

A case where the corrosion loss after 60 cycles was 30 g/m$^2$ or more and less than 35 g/m$^2$ was evaluated as corrosion resistance "B" in an alkaline environment.

A case where the corrosion loss after 60 cycles was 35 g/m$^2$ or more and less than 40 g/m$^2$ was evaluated as corrosion resistance "C" in an alkaline environment.

A case where the corrosion loss after 60 cycles was 40 g/m$^2$ or more and less than 50 g/m$^2$ was evaluated as corrosion resistance "D" in an alkaline environment.

A case where the corrosion loss after 60 cycles was 50 g/m$^2$ or more was evaluated as corrosion resistance "B" in an alkaline environment.

In the following test examples, the chemical composition of the plated layer fell within the scope of the present invention, and the manufacturing conditions fell within the preferred ranges, and thus corrosion resistance was excellent in both an acidic environment and an alkaline environment. The plated layers of these test examples contained a Zn phase, an Al phase, an Al—Zn phase, an η'-$MgZn_2$ phase, and a $MgZn_2$ phase as main phases.

Nos. 2 to 16, 18 to 28, 30 to 33, 35, 37, 42, 43, 45, 48 to 50, 52 to 56, 58, 60, 63, 65, 67, 69, 71, 75, 76, 78, 79, 81, 82, 84, 85, 87, 88, 90, 91, 93, 94, 96, 97, 99, 100, 102, 103, 105, 109 to 114, 117, 118, 120 to 124, 128 to 132.

On the other hand, in the following test examples, the chemical composition of the plated layer was outside the scope of the present invention and Formulas (A) and (B) were not satisfied, and thus the evaluation was E in both an acidic environment and an alkaline environment, and the corrosion resistance was poor.

Nos. 1, 17, 29, 34, 36, 38 to 41, 44, 46, 47, 51, 57, 59, 61, 62, 64, 66, 68, 70, 72 to 74, 77, 80, 83, 86, 89, 92, 95, 98, 101, 104, 106, 136, 137.

In addition, in the following test examples, the chemical composition of the plated layer fell within the scope of the present invention, but the manufacturing conditions fell outside the preferred ranges, and thus Formulas (A) and (B) were not satisfied, and the evaluation was E in both an acidic environment and an alkaline environment, and the corrosion resistance was poor.

Nos. 107, 108, 115, 116, 119, 125 to 127, 133 to 135, 138.

TABLE 1A-1

| | | | Heat treatment | | |
|---|---|---|---|---|---|
| No. | Item | Plating method | Atmosphere | Reheating temperature ° C. | Time hr |
| 1 | Comparative Example | A | Air | 100 | 350 |
| 2 | Example | B | Air | 100 | 350 |
| 3 | Example | B | Air | 100 | 350 |
| 4 | Example | B | Air | 100 | 350 |
| 5 | Example | B | Air | 100 | 350 |
| 6 | Example | B | Air | 100 | 350 |
| 7 | Example | B | Air | 100 | 350 |
| 8 | Example | B | Air | 100 | 350 |
| 9 | Example | B | Air | 100 | 350 |
| 10 | Example | B | Air | 100 | 350 |
| 11 | Example | B | Air | 100 | 350 |
| 12 | Example | B | Air | 100 | 350 |
| 13 | Example | B | Air | 100 | 350 |
| 14 | Example | B | Air | 100 | 350 |
| 15 | Example | B | Air | 100 | 350 |
| 16 | Example | B | Air | 100 | 350 |
| 17 | Comparative Example | B | Air | 100 | 350 |
| 18 | Example | A | Air | 90 | 500 |
| 19 | Example | A | Air | 90 | 500 |
| 20 | Example | A | Air | 90 | 500 |
| 21 | Example | A | Air | 90 | 500 |
| 22 | Example | A | Air | 90 | 500 |
| 23 | Example | A | Air | 90 | 500 |
| 24 | Example | A | Air | 90 | 500 |
| 25 | Example | A | Air | 90 | 500 |
| 26 | Example | A | Air | 90 | 500 |
| 27 | Example | A | Air | 90 | 500 |
| 28 | Example | A | Air | 90 | 500 |
| 29 | Comparative Example | A | Air | 100 | 350 |
| 30 | Example | A | Air | 100 | 350 |
| 31 | Example | A | Air | 100 | 350 |
| 32 | Example | A | Air | 100 | 350 |
| 33 | Example | A | Air | 100 | 350 |
| 34 | Comparative Example | A | Air | 100 | 350 |
| 35 | Example | A | Air | 100 | 350 |

The underline indicates that the value is outside the range of preferred manufacturing conditions.

TABLE 1A-2

| | | | Heat treatment | | |
|---|---|---|---|---|---|
| No. | Item | Plating method | Atmosphere | Reheating temperature ° C. | Time hr |
| 36 | Comparative Example | A | Air | 100 | 350 |
| 37 | Example | A | Air | 100 | 350 |
| 38 | Comparative Example | A | Air | 100 | 350 |
| 39 | Comparative Example | A | Air | 100 | 350 |

TABLE 1A-2-continued

| No. | Item | Plating method | Heat treatment Atmosphere | Heat treatment Reheating temperature ° C. | Heat treatment Time hr |
|---|---|---|---|---|---|
| 40 | Comparative Example | A | Air | 100 | 350 |
| 41 | Comparative Example | A | Air | 100 | 350 |
| 42 | Example | A | Air | 100 | 350 |
| 43 | Example | A | Air | 100 | 350 |
| 44 | Comparative Example | A | Air | 100 | 350 |
| 45 | Example | A | Air | 100 | 350 |
| 46 | Comparative Example | A | Air | 100 | 350 |
| 47 | Comparative Example | A | Air | 100 | 350 |
| 48 | Example | A | Air | 100 | 350 |
| 49 | Example | A | Air | 100 | 350 |
| 50 | Example | A | Air | 100 | 350 |
| 51 | Comparative Example | A | Air | 100 | 250 |
| 52 | Example | A | Air | 100 | 250 |
| 53 | Example | A | Air | 100 | 250 |
| 54 | Example | A | Air | 100 | 350 |
| 55 | Example | A | Air | 100 | 350 |
| 56 | Example | A | Air | 100 | 350 |
| 57 | Comparative Example | A | Air | 100 | 350 |
| 58 | Example | A | Air | 100 | 350 |
| 59 | Comparative Example | A | Air | 100 | 350 |
| 60 | Example | A | Air | 100 | 350 |
| 61 | Comparative Example | A | Air | 100 | 350 |
| 62 | Comparative Example | A | Air | 100 | 350 |
| 63 | Example | A | Air | 100 | 350 |
| 64 | Comparative Example | A | Air | 100 | 350 |
| 65 | Example | A | Air | 100 | 350 |
| 66 | Comparative Example | A | Air | 100 | 350 |
| 67 | Example | A | Air | 100 | 350 |
| 68 | Comparative Example | A | Air | 100 | 350 |
| 69 | Example | A | Air | 100 | 350 |
| 70 | Comparative Example | A | Air | 100 | 350 |

The underline indicates that the value is outside the range of preferred manufacturing conditions.

TABLE 1B-1

| No. | Item | Plating method | Heat treatment Atmosphere | Heat treatment Reheating temperature ° C. | Heat treatment Time hr |
|---|---|---|---|---|---|
| 71 | Example | A | Air | 100 | 350 |
| 72 | Comparative Example | A | Air | 100 | 350 |
| 73 | Comparative Example | A | Air | 100 | 350 |
| 74 | Comparative Example | A | Air | 100 | 350 |
| 75 | Example | B | Nitrogen replacement furnace | 100 | 350 |
| 76 | Example | B | Nitrogen replacement furnace | 100 | 350 |
| 77 | Comparative Example | B | Nitrogen replacement furnace | 100 | 350 |

TABLE 1B-1-continued

| No. | Item | Plating method | Heat treatment Atmosphere | Heat treatment Reheating temperature ° C. | Heat treatment Time hr |
|---|---|---|---|---|---|
| 78 | Example | B | Nitrogen replacement furnace | 100 | 350 |
| 79 | Example | B | Nitrogen replacement furnace | 100 | 350 |
| 80 | Comparative Example | B | Nitrogen replacement furnace | 100 | 350 |
| 81 | Example | B | Nitrogen replacement furnace | 100 | 350 |
| 82 | Example | B | Nitrogen replacement furnace | 100 | 350 |
| 83 | Comparative Example | B | Nitrogen replacement furnace | 100 | 350 |
| 84 | Example | B | Nitrogen replacement furnace | 100 | 350 |
| 85 | Example | B | Nitrogen replacement furnace | 100 | 350 |
| 86 | Comparative Example | B | Nitrogen replacement furnace | 100 | 350 |
| 87 | Example | B | Nitrogen replacement furnace | 100 | 350 |
| 88 | Example | B | Nitrogen replacement furnace | 100 | 350 |
| 89 | Comparative Example | B | Nitrogen replacement furnace | 100 | 350 |
| 90 | Example | B | Nitrogen replacement furnace | 100 | 350 |
| 91 | Example | B | Nitrogen replacement furnace | 100 | 350 |
| 92 | Comparative Example | B | Nitrogen replacement furnace | 100 | 350 |
| 93 | Example | B | Nitrogen replacement furnace | 100 | 350 |
| 94 | Example | B | Nitrogen replacement furnace | 100 | 350 |
| 95 | Comparative Example | B | Nitrogen replacement furnace | 100 | 350 |
| 96 | Example | B | Nitrogen replacement furnace | 100 | 350 |
| 97 | Example | B | Nitrogen replacement furnace | 100 | 350 |
| 98 | Comparative Example | B | Nitrogen replacement furnace | 100 | 350 |
| 99 | Example | B | Nitrogen replacement furnace | 100 | 350 |
| 100 | Example | B | Nitrogen replacement furnace | 100 | 350 |
| 101 | Comparative Example | B | Nitrogen replacement furnace | 100 | 350 |
| 102 | Example | B | Nitrogen replacement furnace | 100 | 350 |
| 103 | Example | B | Nitrogen replacement furnace | 100 | 350 |
| 104 | Comparative Example | B | Nitrogen replacement furnace | 100 | 350 |
| 105 | Example | A | Air | 100 | 350 |

The underline indicates that the value is outside the range of preferred manufacturing conditions.

TABLE 1B-2

| No. | Item | Plating method | Heat treatment Atmosphere | Heat treatment Reheating temperature ° C. | Heat treatment Time hr |
|---|---|---|---|---|---|
| 106 | Comparative Example | A | Air | 100 | 350 |
| 107 | Comparative Example | A | Air | 75 | 750 |
| 108 | Comparative Example | A | Air | 80 | 70 |

TABLE 1B-2-continued

| No. | Item | Plating method | Heat treatment: Atmosphere | Heat treatment: Reheating temperature ° C. | Heat treatment: Time hr |
|---|---|---|---|---|---|
| 109 | Example | A | Air | 80 | 72 |
| 110 | Example | A | Air | 80 | 200 |
| 111 | Example | A | Air | 80 | 250 |
| 112 | Example | A | Air | 80 | 500 |
| 113 | Example | A | Air | 80 | 550 |
| 114 | Example | A | Air | 80 | 750 |
| 115 | Comparative Example | A | Air | 80 | 760 |
| 116 | Comparative Example | A | Air | 140 | 760 |
| 117 | Example | A | Air | 140 | 750 |
| 118 | Example | A | Air | 140 | 72 |
| 119 | Comparative Example | A | Air | 140 | 70 |
| 120 | Example | A | Air | 100 | 350 |
| 121 | Example | B | Air | 100 | 350 |
| 122 | Example | C | Air | 100 | 350 |
| 123 | Example | C | Air | 100 | 550 |
| 124 | Example | C | Air | 80 | 150 |
| 125 | Comparative Example | A | — | - | - |
| 126 | Comparative Example | B | — | - | - |
| 127 | Comparative Example | C | — | - | - |
| 128 | Example | A | Air | 100 | 350 |

TABLE 1B-2-continued

| No. | Item | Plating method | Heat treatment: Atmosphere | Heat treatment: Reheating temperature ° C. | Heat treatment: Time hr |
|---|---|---|---|---|---|
| 129 | Example | B | Air | 100 | 350 |
| 130 | Example | C | Air | 100 | 350 |
| 131 | Example | C | Air | 100 | 550 |
| 132 | Example | C | Air | 140 | 150 |
| 133 | Comparative Example | A | — | - | - |
| 134 | Comparative Example | B | — | - | - |
| 135 | Comparative Example | C | — | - | - |
| 136 | Comparative Example | A | Air | 100 | 350 |
| 137 | Comparative Example | B | Nitrogen replacement furnace | 100 | 350 |
| 138 | Comparative Example | A | Air | 150 | 72 |

The underline indicates that the value is outside the range of preferred manufacturing conditions.

TABLE 2A-1

| No. | Chemical composition (mass %): Zn | Al | Mg | Element group A: Sn | Bi | In | ΣA | Element group B: Ca | Y | La | Ce | ΣB |
|---|---|---|---|---|---|---|---|---|---|---|---|---|
| 1 | 78.60 | 14.5 | 6.0 | 0 | 0 | 0 | 0 | 0.20 | 0 | 0 | 0 | 0.20 |
| 2 | 76.87 | 15.5 | 7.0 | 0.05 | 0.03 | 0 | 0.08 | 0.05 | 0 | 0 | 0 | 0.05 |
| 3 | 75.09 | 16.5 | 7.0 | 0.05 | 0.03 | 0.03 | 0.11 | 0.40 | 0.10 | 0 | 0 | 0.50 |
| 4 | 74.07 | 17.5 | 7.0 | 0.05 | 0 | 0.03 | 0.08 | 0.40 | 0.10 | 0.10 | 0 | 0.60 |
| 5 | 73.05 | 18.5 | 7.0 | 0.05 | 0 | 0 | 0.05 | 0.30 | 0.10 | 0.10 | 0.10 | 0.60 |
| 6 | 72.30 | 19.5 | 7.0 | 0.05 | 0 | 0 | 0.05 | 0.20 | 0 | 0.10 | 0.10 | 0.40 |
| 7 | 70.90 | 20.5 | 7.0 | 0.05 | 0 | 0 | 0.05 | 0.20 | 0 | 0 | 0.10 | 0.30 |
| 8 | 69.80 | 21.5 | 7.0 | 0.05 | 0 | 0 | 0.05 | 0.20 | 0 | 0.10 | 0 | 0.30 |
| 9 | 68.80 | 22.5 | 7.0 | 0.05 | 0 | 0 | 0.05 | 0.20 | 0 | 0 | 0 | 0.20 |
| 10 | 68.80 | 23.5 | 7.0 | 0.05 | 0 | 0 | 0.05 | 0.20 | 0 | 0 | 0 | 0.20 |
| 11 | 67.35 | 24.5 | 7.0 | 0.05 | 0 | 0 | 0.05 | 0.20 | 0 | 0 | 0 | 0.20 |
| 12 | 66.60 | 25.5 | 7.0 | 0.05 | 0 | 0 | 0.05 | 0.20 | 0 | 0 | 0 | 0.20 |
| 13 | 65.45 | 26.5 | 7.0 | 0.05 | 0 | 0 | 0.05 | 0.20 | 0 | 0 | 0 | 0.20 |
| 14 | 64.60 | 27.5 | 7.0 | 0.05 | 0 | 0 | 0.05 | 0.20 | 0 | 0 | 0 | 0.20 |
| 15 | 63.45 | 28.5 | 7.0 | 0.05 | 0 | 0 | 0.05 | 0.20 | 0 | 0 | 0 | 0.20 |
| 16 | 62.50 | 29.5 | 7.0 | 0.05 | 0 | 0 | 0.05 | 0.20 | 0 | 0 | 0 | 0.20 |
| 17 | 61.50 | 30.5 | 7.0 | 0.05 | 0 | 0 | 0.05 | 0.20 | 0 | 0 | 0 | 0.20 |
| 18 | 74.00 | 20.0 | 5.1 | 0 | 0 | 0 | 0 | 0.10 | 0 | 0 | 0 | 0.10 |
| 19 | 73.45 | 20.0 | 5.5 | 0 | 0 | 0 | 0 | 0.10 | 0 | 0 | 0 | 0.10 |
| 20 | 72.60 | 20.0 | 6.5 | 0 | 0 | 0 | 0 | 0.10 | 0 | 0 | 0 | 0.10 |
| 21 | 71.36 | 20.0 | 7.5 | 0 | 0 | 0 | 0 | 0.10 | 0.03 | 0.03 | 0.03 | 0.19 |
| 22 | 69.70 | 20.0 | 8.5 | 0 | 0 | 0 | 0 | 0.10 | 0 | 0 | 0 | 0.10 |
| 23 | 69.20 | 20.0 | 9.5 | 0 | 0 | 0 | 0 | 0.10 | 0 | 0 | 0 | 0.10 |
| 24 | 67.70 | 20.0 | 10.5 | 0 | 0 | 0 | 0 | 0.10 | 0 | 0 | 0 | 0.10 |
| 25 | 66.70 | 20.0 | 11.5 | 0 | 0 | 0 | 0 | 0.10 | 0 | 0 | 0 | 0.10 |
| 26 | 66.20 | 20.0 | 12.5 | 0 | 0 | 0 | 0 | 0.10 | 0 | 0 | 0 | 0.10 |
| 27 | 65.70 | 20.0 | 13.5 | 0 | 0 | 0 | 0 | 0.10 | 0 | 0 | 0 | 0.10 |
| 28 | 64.70 | 20.0 | 14.5 | 0 | 0 | 0 | 0 | 0.10 | 0 | 0 | 0 | 0.10 |
| 29 | 63.70 | 20.0 | 15.5 | 0 | 0 | 0 | 0 | 0.10 | 0 | 0 | 0 | 0.10 |
| 30 | 55.05 | 28.0 | 15.0 | 0.20 | 0 | 0 | 0.20 | 0.50 | 0 | 0 | 0 | 0.50 |
| 31 | 54.95 | 28.0 | 15.0 | 0.30 | 0 | 0 | 0.30 | 0.50 | 0 | 0 | 0 | 0.50 |
| 32 | 54.85 | 28.0 | 15.0 | 0.40 | 0 | 0 | 0.40 | 0.50 | 0 | 0 | 0 | 0.50 |
| 33 | 54.55 | 28.0 | 15.0 | 0.70 | 0 | 0 | 0.70 | 0.50 | 0 | 0 | 0 | 0.50 |
| 34 | 54.50 | 28.0 | 15.0 | 0.75 | 0 | 0 | 0.75 | 0.50 | 0 | 0 | 0 | 0.50 |
| 35 | 54.55 | 28.0 | 15.0 | 0.35 | 0.35 | 0 | 0.70 | 0.50 | 0 | 0 | 0 | 0.50 |

The underline indicates that the value is outside the scope of the present invention.

TABLE 2A-2

| | Chemical composition (mass %) | | | | | | | | | | | |
|---|---|---|---|---|---|---|---|---|---|---|---|---|
| | | | | Element group A | | | | Element group B | | | | |
| No. | Zn | Al | Mg | Sn | Bi | In | ΣA | Ca | Y | La | Ce | ΣB |
| 36 | 54.50 | 28.0 | 15.0 | 0.25 | 0.25 | 0.25 | 0.75 | 0.50 | 0 | 0 | 0 | 0.50 |
| 37 | 54.55 | 28.0 | 15.0 | 0.35 | 0 | 0.35 | 0.70 | 0.50 | 0 | 0 | 0 | 0.50 |
| 38 | 54.50 | 28.0 | 15.0 | 0.25 | 0.25 | 0.25 | 0.75 | 0.50 | 0 | 0 | 0 | 0.50 |
| 39 | 54.65 | 28.0 | 15.0 | 0 | 0.60 | 0 | 0.60 | 0.50 | 0 | 0 | 0 | 0.50 |
| 40 | 54.65 | 28.0 | 15.0 | 0 | 0 | 0.60 | 0.60 | 0.50 | 0 | 0 | 0 | 0.50 |
| 41 | 66.30 | 18.0 | 15.0 | 0 | 0 | 0 | 0 | 0.00 | 0 | 0 | 0 | 0.00 |
| 42 | 75.30 | 18.0 | 5.5 | 0 | 0 | 0 | 0 | 0.50 | 0 | 0 | 0 | 0.50 |
| 43 | 75.20 | 18.0 | 5.5 | 0 | 0 | 0 | 0 | 0.60 | 0 | 0 | 0 | 0.60 |
| 44 | 75.10 | 18.0 | 5.5 | 0 | 0 | 0 | 0 | 0.70 | 0 | 0 | 0 | 0.70 |
| 45 | 75.20 | 18.0 | 5.5 | 0 | 0 | 0 | 0 | 0.30 | 0.10 | 0.10 | 0.10 | 0.60 |
| 46 | 75.10 | 18.0 | 5.5 | 0 | 0 | 0 | 0 | 0.40 | 0.10 | 0.10 | 0.10 | 0.70 |
| 47 | 75.15 | 18.0 | 5.5 | 0 | 0 | 0 | 0 | 0.20 | 0.15 | 0.15 | 0.15 | 0.65 |
| 48 | 75.20 | 18.0 | 5.5 | 0 | 0 | 0 | 0 | 0.30 | 0.30 | 0 | 0 | 0.60 |
| 49 | 75.20 | 18.0 | 5.5 | 0 | 0 | 0 | 0 | 0.30 | 0 | 0.30 | 0 | 0.60 |
| 50 | 75.20 | 18.0 | 5.5 | 0 | 0 | 0 | 0 | 0.30 | 0 | 0 | 0.30 | 0.60 |
| 51 | 65.20 | 26.0 | 8.0 | 0 | 0 | 0 | 0 | 0.30 | 0 | 0 | 0 | 0.30 |
| 52 | 64.89 | 26.0 | 8.0 | 0 | 0 | 0 | 0 | 0.60 | 0 | 0 | 0 | 0.60 |
| 53 | 64.85 | 26.0 | 8.0 | 0 | 0 | 0 | 0 | 0.60 | 0 | 0 | 0 | 0.60 |
| 54 | 57.60 | 26.0 | 15.0 | 0 | 0 | 0 | 0 | 0.60 | 0 | 0 | 0 | 0.60 |
| 55 | 57.45 | 26.0 | 15.0 | 0 | 0 | 0 | 0 | 0.60 | 0 | 0 | 0 | 0.60 |
| 56 | 57.15 | 26.0 | 15.0 | 0 | 0 | 0 | 0 | 0.60 | 0 | 0 | 0 | 0.60 |
| 57 | 57.10 | 26.0 | 15.0 | 0 | 0 | 0 | 0 | 0.60 | 0 | 0 | 0 | 0.60 |
| 58 | 75.75 | 16.0 | 7.0 | 0.10 | 0 | 0 | 0.10 | 0.30 | 0 | 0 | 0 | 0.30 |
| 59 | 75.60 | 16.0 | 7.0 | 0.10 | 0 | 0 | 0.10 | 0.30 | 0 | 0 | 0 | 0.30 |
| 60 | 75.75 | 16.0 | 7.0 | 0.10 | 0 | 0 | 0.10 | 0.30 | 0 | 0 | 0 | 0.30 |
| 61 | 75.05 | 16.0 | 7.0 | 0.10 | 0 | 0 | 0.10 | 0.30 | 0 | 0 | 0 | 0.30 |
| 62 | 74.80 | 16.0 | 7.0 | 0.10 | 0 | 0 | 0.10 | 0.30 | 0 | 0 | 0 | 0.30 |
| 63 | 75.75 | 16.0 | 7.0 | 0.10 | 0 | 0 | 0.10 | 0.30 | 0 | 0 | 0 | 0.30 |
| 64 | 75.60 | 16.0 | 7.0 | 0.10 | 0 | 0 | 0.10 | 0.30 | 0 | 0 | 0 | 0.30 |
| 65 | 75.75 | 16.0 | 7.0 | 0.10 | 0 | 0 | 0.10 | 0.30 | 0 | 0 | 0 | 0.30 |
| 66 | 75.60 | 16.0 | 7.0 | 0.10 | 0 | 0 | 0.10 | 0.30 | 0 | 0 | 0 | 0.30 |
| 67 | 75.75 | 16.0 | 7.0 | 0.10 | 0 | 0 | 0.10 | 0.30 | 0 | 0 | 0 | 0.30 |
| 68 | 75.60 | 16.0 | 7.0 | 0.10 | 0 | 0 | 0.10 | 0.30 | 0 | 0 | 0 | 0.30 |
| 69 | 75.75 | 16.0 | 7.0 | 0.10 | 0 | 0 | 0.10 | 0.30 | 0 | 0 | 0 | 0.30 |
| 70 | 75.60 | 16.0 | 7.0 | 0.10 | 0 | 0 | 0.10 | 0.30 | 0 | 0 | 0 | 0.30 |

The underline indicates that the value is outside the scope of the present invention.

TABLE 2B-1

| | Chemical composition (mass %) | | | | | | | | | | | |
|---|---|---|---|---|---|---|---|---|---|---|---|---|
| | | | | Element group A | | | | Element group B | | | | |
| No. | Zn | Al | Mg | Sn | Bi | In | ΣA | Ca | Y | La | Ce | ΣB |
| 71 | 75.75 | 16.0 | 7.0 | 0.10 | 0 | 0 | 0.10 | 0.30 | 0 | 0 | 0 | 0.30 |
| 72 | 75.60 | 16.0 | 7.0 | 0.10 | 0 | 0 | 0.10 | 0.30 | 0 | 0 | 0 | 0.30 |
| 73 | 74.85 | 16.0 | 7.0 | 0.10 | 0 | 0 | 0.10 | 0.30 | 0 | 0 | 0 | 0.30 |
| 74 | 59.96 | 29.0 | 5.5 | 0 | 0 | 0 | 0.00 | 0.03 | 0 | 0 | 0 | 0.03 |
| 75 | 70.69 | 22.5 | 6.0 | 0.05 | 0.01 | 0 | 0.06 | 0.10 | 0 | 0 | 0 | 0.10 |
| 76 | 70.39 | 22.5 | 6.0 | 0.05 | 0.01 | 0 | 0.06 | 0.10 | 0 | 0 | 0 | 0.10 |
| 77 | 70.29 | 22.5 | 6.0 | 0.05 | 0.01 | 0 | 0.06 | 0.10 | 0 | 0 | 0 | 0.10 |
| 78 | 70.69 | 22.5 | 6.0 | 0.05 | 0.01 | 0 | 0.06 | 0.10 | 0 | 0 | 0 | 0.10 |
| 79 | 70.39 | 22.5 | 6.0 | 0.05 | 0.01 | 0 | 0.06 | 0.10 | 0 | 0 | 0 | 0.10 |
| 80 | 70.29 | 22.5 | 6.0 | 0.05 | 0.01 | 0 | 0.06 | 0.10 | 0 | 0 | 0 | 0.10 |
| 81 | 70.69 | 22.5 | 6.0 | 0.05 | 0.01 | 0 | 0.06 | 0.10 | 0 | 0 | 0 | 0.10 |
| 82 | 70.39 | 22.5 | 6.0 | 0.05 | 0.01 | 0 | 0.06 | 0.10 | 0 | 0 | 0 | 0.10 |
| 83 | 70.29 | 22.5 | 6.0 | 0.05 | 0.01 | 0 | 0.06 | 0.10 | 0 | 0 | 0 | 0.10 |
| 84 | 70.69 | 22.5 | 6.0 | 0.05 | 0.01 | 0 | 0.06 | 0.10 | 0 | 0 | 0 | 0.10 |
| 85 | 70.39 | 22.5 | 6.0 | 0.05 | 0.01 | 0 | 0.06 | 0.10 | 0 | 0 | 0 | 0.10 |
| 86 | 70.29 | 22.5 | 6.0 | 0.05 | 0.01 | 0 | 0.06 | 0.10 | 0 | 0 | 0 | 0.10 |
| 87 | 70.69 | 22.5 | 6.0 | 0.05 | 0.01 | 0 | 0.06 | 0.10 | 0 | 0 | 0 | 0.10 |
| 88 | 70.39 | 22.5 | 6.0 | 0.05 | 0.01 | 0 | 0.06 | 0.10 | 0 | 0 | 0 | 0.10 |
| 89 | 70.29 | 22.5 | 6.0 | 0.05 | 0.01 | 0 | 0.06 | 0.10 | 0 | 0 | 0 | 0.10 |
| 90 | 70.69 | 22.5 | 6.0 | 0.05 | 0.01 | 0 | 0.06 | 0.10 | 0 | 0 | 0 | 0.10 |
| 91 | 70.39 | 22.5 | 6.0 | 0.05 | 0.01 | 0 | 0.06 | 0.10 | 0 | 0 | 0 | 0.10 |
| 92 | 70.29 | 22.5 | 6.0 | 0.05 | 0.01 | 0 | 0.06 | 0.10 | 0 | 0 | 0 | 0.10 |
| 93 | 70.69 | 22.5 | 6.0 | 0.05 | 0.01 | 0 | 0.06 | 0.10 | 0 | 0 | 0 | 0.10 |
| 94 | 70.39 | 22.5 | 6.0 | 0.05 | 0.01 | 0 | 0.06 | 0.10 | 0 | 0 | 0 | 0.10 |
| 95 | 70.29 | 22.5 | 6.0 | 0.05 | 0.01 | 0 | 0.06 | 0.10 | 0 | 0 | 0 | 0.10 |

TABLE 2B-1-continued

| | Chemical composition (mass %) | | | | | | | | | | | |
|---|---|---|---|---|---|---|---|---|---|---|---|---|
| | | | | Element group A | | | | Element group B | | | | |
| No. | Zn | Al | Mg | Sn | Bi | In | ΣA | Ca | Y | La | Ce | ΣB |
| 96 | 70.69 | 22.5 | 6.0 | 0.05 | 0.01 | 0 | 0.06 | 0.10 | 0 | 0 | 0 | 0.10 |
| 97 | 70.39 | 22.5 | 6.0 | 0.05 | 0.01 | 0 | 0.06 | 0.10 | 0 | 0 | 0 | 0.10 |
| 98 | 70.29 | 22.5 | 6.0 | 0.05 | 0.01 | 0 | 0.06 | 0.10 | 0 | 0 | 0 | 0.10 |
| 99 | 70.69 | 22.5 | 6.0 | 0.05 | 0.01 | 0 | 0.06 | 0.10 | 0 | 0 | 0 | 0.10 |
| 100 | 70.39 | 22.5 | 6.0 | 0.05 | 0.01 | 0 | 0.06 | 0.10 | 0 | 0 | 0 | 0.10 |
| 101 | 70.29 | 22.5 | 6.0 | 0.05 | 0.01 | 0 | 0.06 | 0.10 | 0 | 0 | 0 | 0.10 |
| 102 | 70.69 | 22.5 | 6.0 | 0.05 | 0.01 | 0 | 0.06 | 0.10 | 0 | 0 | 0 | 0.10 |
| 103 | 70.39 | 22.5 | 6.0 | 0.05 | 0.01 | 0 | 0.06 | 0.10 | 0 | 0 | 0 | 0.10 |
| 104 | 70.29 | 22.5 | 6.0 | 0.05 | 0.01 | 0 | 0.06 | 0.10 | 0 | 0 | 0 | 0.10 |
| 105 | 61.90 | 27.0 | 9.0 | 0.10 | 0 | 0 | 0.10 | 0.10 | 0 | 0 | 0 | 0.10 |

The underline indicates that the value is outside the scope of the present invention.

TABLE 2B-2

| | Chemical composition (mass %) | | | | | | | | | | | |
|---|---|---|---|---|---|---|---|---|---|---|---|---|
| | | | | Element group A | | | | Element group B | | | | |
| No. | Zn | Al | Mg | Sn | Bi | In | ΣA | Ca | Y | La | Ce | ΣB |
| 106 | 62.21 | 27.0 | 9.0 | 0.10 | 0 | 0 | 0.10 | 0.10 | 0 | 0 | 0 | 0.10 |
| 107 | 71.05 | 20.0 | 7.0 | 0.10 | 0 | 0 | 0.10 | 0.10 | 0 | 0 | 0 | 0.10 |
| 108 | 71.05 | 20.0 | 7.0 | 0.10 | 0 | 0 | 0.10 | 0.10 | 0 | 0 | 0 | 0.10 |
| 109 | 70.75 | 20.0 | 7.0 | 0.10 | 0 | 0 | 0.10 | 0.10 | 0 | 0 | 0 | 0.10 |
| 110 | 70.75 | 20.0 | 7.0 | 0.10 | 0 | 0 | 0.10 | 0.10 | 0 | 0 | 0 | 0.10 |
| 111 | 71.05 | 20.0 | 7.0 | 0.10 | 0 | 0 | 0.10 | 0.10 | 0 | 0 | 0 | 0.10 |
| 112 | 71.05 | 20.0 | 7.0 | 0.10 | 0 | 0 | 0.10 | 0.10 | 0 | 0 | 0 | 0.10 |
| 113 | 71.05 | 20.0 | 7.0 | 0.10 | 0 | 0 | 0.10 | 0.10 | 0 | 0 | 0 | 0.10 |
| 114 | 71.05 | 20.0 | 7.0 | 0.10 | 0 | 0 | 0.10 | 0.10 | 0 | 0 | 0 | 0.10 |
| 115 | 71.05 | 20.0 | 7.0 | 0.10 | 0 | 0 | 0.10 | 0.10 | 0 | 0 | 0 | 0.10 |
| 116 | 71.05 | 20.0 | 7.0 | 0.10 | 0 | 0 | 0.10 | 0.10 | 0 | 0 | 0 | 0.10 |
| 117 | 71.05 | 20.0 | 7.0 | 0.10 | 0 | 0 | 0.10 | 0.10 | 0 | 0 | 0 | 0.10 |
| 118 | 71.05 | 20.0 | 7.0 | 0.10 | 0 | 0 | 0.10 | 0.10 | 0 | 0 | 0 | 0.10 |
| 119 | 71.05 | 20.0 | 7.0 | 0.10 | 0 | 0 | 0.10 | 0.10 | 0 | 0 | 0 | 0.10 |
| 120 | 71.05 | 20.0 | 7.0 | 0.10 | 0 | 0 | 0.10 | 0.10 | 0 | 0 | 0 | 0.10 |
| 121 | 71.05 | 20.0 | 7.0 | 0.10 | 0 | 0 | 0.10 | 0.10 | 0 | 0 | 0 | 0.10 |
| 122 | 71.05 | 20.0 | 7.0 | 0.10 | 0 | 0 | 0.10 | 0.10 | 0 | 0 | 0 | 0.10 |
| 123 | 71.05 | 20.0 | 7.0 | 0.10 | 0 | 0 | 0.10 | 0.10 | 0 | 0 | 0 | 0.10 |

TABLE 2B-2-continued

| | Chemical composition (mass %) | | | | | | | | | | | |
|---|---|---|---|---|---|---|---|---|---|---|---|---|
| | | | | Element group A | | | | Element group B | | | | |
| No. | Zn | Al | Mg | Sn | Bi | In | ΣA | Ca | Y | La | Ce | ΣB |
| 124 | 71.05 | 20.0 | 7.0 | 0.10 | 0 | 0 | 0.10 | 0.10 | 0 | 0 | 0 | 0.10 |
| 125 | 71.05 | 20.0 | 7.0 | 0.10 | 0 | 0 | 0.10 | 0.10 | 0 | 0 | 0 | 0.10 |
| 126 | 71.05 | 20.0 | 7.0 | 0.10 | 0 | 0 | 0.10 | 0.10 | 0 | 0 | 0 | 0.10 |
| 127 | 71.05 | 20.0 | 7.0 | 0.10 | 0 | 0 | 0.10 | 0.10 | 0 | 0 | 0 | 0.10 |
| 128 | 66.05 | 23.0 | 9.0 | 0.10 | 0 | 0 | 0.10 | 0.10 | 0 | 0 | 0 | 0.10 |
| 129 | 66.05 | 23.0 | 9.0 | 0.10 | 0 | 0 | 0.10 | 0.10 | 0 | 0 | 0 | 0.10 |
| 130 | 66.05 | 23.0 | 9.0 | 0.10 | 0 | 0 | 0.10 | 0.10 | 0 | 0 | 0 | 0.10 |
| 131 | 66.05 | 23.0 | 9.0 | 0.10 | 0 | 0 | 0.10 | 0.10 | 0 | 0 | 0 | 0.10 |
| 132 | 66.05 | 23.0 | 9.0 | 0.10 | 0 | 0 | 0.10 | 0.10 | 0 | 0 | 0 | 0.10 |
| 133 | 71.05 | 20.0 | 7.0 | 0.10 | 0 | 0 | 0.10 | 0.10 | 0 | 0 | 0 | 0.10 |
| 134 | 71.05 | 20.0 | 7.0 | 0.10 | 0 | 0 | 0.10 | 0.10 | 0 | 0 | 0 | 0.10 |
| 135 | 71.05 | 20.0 | 7.0 | 0.10 | 0 | 0 | 0.10 | 0.10 | 0 | 0 | 0 | 0.10 |
| 136 | 76.60 | 18.0 | 4.5 | 0.00 | 0 | 0 | 0.00 | 0.20 | 0 | 0 | 0 | 0.20 |
| 137 | 65.50 | 28.0 | 5.0 | 0.10 | 0 | 0 | 0.00 | 0.20 | 0 | 0 | 0 | 0.20 |
| 138 | 71.05 | 20.0 | 7.0 | 0.10 | 0 | 0 | 0.10 | 0.10 | 0 | 0 | 0 | 0.10 |

The underline indicates that the value is outside the scope of the present invention.

TABLE 3A-1

| | Chemical composition (mass %) | | | | | | | | | |
|---|---|---|---|---|---|---|---|---|---|---|
| | | Element group C | | | | | | | | |
| No. | Si | Cr | Ti | Ni | Co | V | Nb | Cu | Mn | ΣC |
| 1 | 0.20 | 0 | 0 | 0 | 0 | 0 | 0 | 0 | 0 | 0 |
| 2 | 0.10 | 0.10 | 0 | 0 | 0 | 0 | 0 | 0 | 0 | 0.10 |
| 3 | 0.25 | 0.25 | 0 | 0 | 0 | 0 | 0 | 0 | 0 | 0.25 |
| 4 | 0.25 | 0 | 0.10 | 0 | 0 | 0 | 0 | 0 | 0 | 0.10 |
| 5 | 0.25 | 0 | 0.25 | 0 | 0 | 0 | 0 | 0 | 0 | 0.25 |
| 6 | 0.25 | 0 | 0 | 0.10 | 0 | 0 | 0 | 0 | 0 | 0.10 |
| 7 | 0.25 | 0 | 0 | 0.50 | 0 | 0 | 0 | 0 | 0 | 0.50 |
| 8 | 0.25 | 0 | 0 | 0.80 | 0 | 0 | 0 | 0 | 0 | 0.80 |
| 9 | 0.25 | 0 | 0 | 1.00 | 0 | 0 | 0 | 0 | 0 | 1.00 |
| 10 | 0.25 | 0 | 0 | 0 | 0.10 | 0 | 0 | 0 | 0 | 0.10 |
| 11 | 0.25 | 0 | 0 | 0 | 0.25 | 0 | 0 | 0 | 0 | 0.25 |
| 12 | 0.25 | 0 | 0 | 0 | 0 | 0.10 | 0 | 0 | 0 | 0.10 |
| 13 | 0.25 | 0 | 0 | 0 | 0 | 0.25 | 0 | 0 | 0 | 0.25 |
| 14 | 0.25 | 0 | 0 | 0 | 0 | 0 | 0.10 | 0 | 0 | 0.10 |
| 15 | 0.25 | 0 | 0 | 0 | 0 | 0 | 0.25 | 0 | 0 | 0.25 |
| 16 | 0.25 | 0 | 0 | 0 | 0 | 0 | 0 | 0 | 0 | 0 |
| 17 | 0.25 | 0 | 0 | 0 | 0 | 0 | 0 | 0 | 0 | 0 |
| 18 | 0.20 | 0 | 0 | 0 | 0 | 0 | 0 | 0.10 | 0 | 0.10 |
| 19 | 0.20 | 0 | 0 | 0 | 0 | 0 | 0 | 0.25 | 0 | 0.25 |
| 20 | 0.20 | 0 | 0 | 0 | 0 | 0 | 0 | 0 | 0.10 | 0.10 |
| 21 | 0.20 | 0 | 0 | 0 | 0 | 0 | 0 | 0 | 0.25 | 0.25 |
| 22 | 0.20 | 0.25 | 0 | 0.5 | 0 | 0 | 0 | 0.25 | 0 | 1.00 |
| 23 | 0.20 | 0.25 | 0 | 0 | 0 | 0 | 0 | 0.25 | 0 | 0.50 |

TABLE 3A-1-continued

| | Chemical composition (mass %) | | | | | | | | | |
|---|---|---|---|---|---|---|---|---|---|---|
| | | Element group C | | | | | | | | |
| No. | Si | Cr | Ti | Ni | Co | V | Nb | Cu | Mn | ΣC |
| 24 | 0.20 | 0 | 0.25 | 0.75 | 0 | 0 | 0 | 0 | 0 | 1.00 |
| 25 | 0.20 | 0 | 0 | 0.25 | 0 | 0.25 | 0 | 0.25 | 0.25 | 1.00 |
| 26 | 0.20 | 0 | 0 | 0 | 0.25 | 0 | 0.25 | 0 | 0 | 0.50 |
| 27 | 0.20 | 0 | 0 | 0 | 0 | 0 | 0 | 0 | 0 | 0 |
| 28 | 0.20 | 0 | 0 | 0 | 0 | 0 | 0 | 0 | 0 | 0 |
| 29 | 0.20 | 0 | 0 | 0 | 0 | 0 | 0 | 0 | 0 | 0 |
| 30 | 0.75 | 0 | 0 | 0 | 0 | 0 | 0 | 0 | 0 | 0 |
| 31 | 0.75 | 0 | 0 | 0 | 0 | 0 | 0 | 0 | 0 | 0 |
| 32 | 0.75 | 0 | 0 | 0 | 0 | 0 | 0 | 0 | 0 | 0 |
| 33 | 0.75 | 0 | 0 | 0 | 0 | 0 | 0 | 0 | 0 | 0 |
| 34 | 0.75 | 0 | 0 | 0 | 0 | 0 | 0 | 0 | 0 | 0 |
| 35 | 0.75 | 0 | 0 | 0 | 0 | 0 | 0 | 0 | 0 | 0 |

The underline indicates that the value is outside the scope of the present invention.

TABLE 3A-2

| | Chemical composition (mass %) | | | | | | | | | |
|---|---|---|---|---|---|---|---|---|---|---|
| | | Element group C | | | | | | | | |
| No. | Si | Cr | Ti | Ni | Co | V | Nb | Cu | Mn | ΣC |
| 36 | 0.75 | 0 | 0 | 0 | 0 | 0 | 0 | 0 | 0 | 0 |
| 37 | 0.75 | 0 | 0 | 0 | 0 | 0 | 0 | 0 | 0 | 0 |
| 38 | 0.75 | 0 | 0 | 0 | 0 | 0 | 0 | 0 | 0 | 0 |
| 39 | 0.75 | 0 | 0 | 0 | 0 | 0 | 0 | 0 | 0 | 0 |
| 40 | 0.75 | 0 | 0 | 0 | 0 | 0 | 0 | 0 | 0 | 0 |
| 41 | 0.20 | 0 | 0 | 0 | 0 | 0 | 0 | 0 | 0 | 0 |
| 42 | 0.20 | 0 | 0 | 0 | 0 | 0 | 0 | 0 | 0 | 0 |
| 43 | 0.20 | 0 | 0 | 0 | 0 | 0 | 0 | 0 | 0 | 0 |
| 44 | 0.20 | 0 | 0 | 0 | 0 | 0 | 0 | 0 | 0 | 0 |
| 45 | 0.20 | 0 | 0 | 0 | 0 | 0 | 0 | 0 | 0 | 0 |
| 46 | 0.20 | 0 | 0 | 0 | 0 | 0 | 0 | 0 | 0 | 0 |
| 47 | 0.20 | 0 | 0 | 0 | 0 | 0 | 0 | 0 | 0 | 0 |
| 48 | 0.20 | 0 | 0 | 0 | 0 | 0 | 0 | 0 | 0 | 0 |
| 49 | 0.20 | 0 | 0 | 0 | 0 | 0 | 0 | 0 | 0 | 0 |
| 50 | 0.20 | 0 | 0 | 0 | 0 | 0 | 0 | 0 | 0 | 0 |
| 51 | 0.00 | 0 | 0 | 0 | 0 | 0 | 0 | 0 | 0 | 0 |
| 52 | 0.01 | 0 | 0 | 0 | 0 | 0 | 0 | 0 | 0 | 0 |
| 53 | 0.05 | 0 | 0 | 0 | 0 | 0 | 0 | 0 | 0 | 0 |
| 54 | 0.30 | 0 | 0 | 0 | 0 | 0 | 0 | 0 | 0 | 0 |
| 55 | 0.45 | 0 | 0 | 0 | 0 | 0 | 0 | 0 | 0 | 0 |
| 56 | 0.75 | 0 | 0 | 0 | 0 | 0 | 0 | 0 | 0 | 0 |
| 57 | 0.80 | 0 | 0 | 0 | 0 | 0 | 0 | 0 | 0 | 0 |
| 58 | 0.20 | 0.15 | 0 | 0 | 0 | 0 | 0 | 0 | 0 | 0.15 |
| 59 | 0.20 | 0.30 | 0 | 0 | 0 | 0 | 0 | 0 | 0 | 0.30 |
| 60 | 0.20 | 0 | 0.15 | 0 | 0 | 0 | 0 | 0 | 0 | 0.15 |
| 61 | 0.20 | 0 | 0.30 | 0.55 | 0 | 0 | 0 | 0 | 0 | 0.85 |
| 62 | 0.20 | 0 | 0 | 1.10 | 0 | 0 | 0 | 0 | 0 | 1.10 |
| 63 | 0.20 | 0 | 0 | 0 | 0.15 | 0 | 0 | 0 | 0 | 0.15 |
| 64 | 0.20 | 0 | 0 | 0 | 0.30 | 0 | 0 | 0 | 0 | 0.30 |
| 65 | 0.20 | 0 | 0 | 0 | 0 | 0.15 | 0 | 0 | 0 | 0.15 |
| 66 | 0.20 | 0 | 0 | 0 | 0 | 0.30 | 0 | 0 | 0 | 0.30 |
| 67 | 0.20 | 0 | 0 | 0 | 0 | 0 | 0.15 | 0 | 0 | 0.15 |
| 68 | 0.20 | 0 | 0 | 0 | 0 | 0 | 0.30 | 0 | 0 | 0.30 |
| 69 | 0.20 | 0 | 0 | 0 | 0 | 0 | 0 | 0.15 | 0 | 0.15 |
| 70 | 0.20 | 0 | 0 | 0 | 0 | 0 | 0 | 0.30 | 0 | 0.30 |

The underline indicates that the value is outside the scope of the present invention.

TABLE 3B-1

| | Chemical composition (mass %) | | | | | | | | | |
|---|---|---|---|---|---|---|---|---|---|---|
| | | Element group C | | | | | | | | |
| No. | Si | Cr | Ti | Ni | Co | V | Nb | Cu | Mn | ΣC |
| 71 | 0.20 | 0 | 0 | 0 | 0 | 0 | 0 | 0 | 0.15 | 0.15 |
| 72 | 0.20 | 0 | 0 | 0 | 0 | 0 | 0 | 0 | 0.30 | 0.30 |
| 73 | 0.20 | 0 | 0 | 0.50 | 0.25 | 0.10 | 0.10 | 0.10 | 0 | 1.05 |
| 74 | 0.01 | 0 | 0 | 0 | 0 | 0 | 0 | 0 | 0 | 0 |
| 75 | 0.15 | 0 | 0 | 0 | 0 | 0 | 0 | 0 | 0 | 0 |
| 76 | 0.15 | 0 | 0 | 0 | 0 | 0 | 0 | 0 | 0 | 0 |
| 77 | 0.15 | 0 | 0 | 0 | 0 | 0 | 0 | 0 | 0 | 0 |
| 78 | 0.15 | 0 | 0 | 0 | 0 | 0 | 0 | 0 | 0 | 0 |
| 79 | 0.15 | 0 | 0 | 0 | 0 | 0 | 0 | 0 | 0 | 0 |
| 80 | 0.15 | 0 | 0 | 0 | 0 | 0 | 0 | 0 | 0 | 0 |
| 81 | 0.15 | 0 | 0 | 0 | 0 | 0 | 0 | 0 | 0 | 0 |
| 82 | 0.15 | 0 | 0 | 0 | 0 | 0 | 0 | 0 | 0 | 0 |
| 83 | 0.15 | 0 | 0 | 0 | 0 | 0 | 0 | 0 | 0 | 0 |
| 84 | 0.15 | 0 | 0 | 0 | 0 | 0 | 0 | 0 | 0 | 0 |
| 85 | 0.15 | 0 | 0 | 0 | 0 | 0 | 0 | 0 | 0 | 0 |
| 86 | 0.15 | 0 | 0 | 0 | 0 | 0 | 0 | 0 | 0 | 0 |
| 87 | 0.15 | 0 | 0 | 0 | 0 | 0 | 0 | 0 | 0 | 0 |
| 88 | 0.15 | 0 | 0 | 0 | 0 | 0 | 0 | 0 | 0 | 0 |
| 89 | 0.15 | 0 | 0 | 0 | 0 | 0 | 0 | 0 | 0 | 0 |
| 90 | 0.15 | 0 | 0 | 0 | 0 | 0 | 0 | 0 | 0 | 0 |
| 91 | 0.15 | 0 | 0 | 0 | 0 | 0 | 0 | 0 | 0 | 0 |
| 92 | 0.15 | 0 | 0 | 0 | 0 | 0 | 0 | 0 | 0 | 0 |
| 93 | 0.15 | 0 | 0 | 0 | 0 | 0 | 0 | 0 | 0 | 0 |
| 94 | 0.15 | 0 | 0 | 0 | 0 | 0 | 0 | 0 | 0 | 0 |
| 95 | 0.15 | 0 | 0 | 0 | 0 | 0 | 0 | 0 | 0 | 0 |
| 96 | 0.15 | 0 | 0 | 0 | 0 | 0 | 0 | 0 | 0 | 0 |
| 97 | 0.15 | 0 | 0 | 0 | 0 | 0 | 0 | 0 | 0 | 0 |
| 98 | 0.15 | 0 | 0 | 0 | 0 | 0 | 0 | 0 | 0 | 0 |
| 99 | 0.15 | 0 | 0 | 0 | 0 | 0 | 0 | 0 | 0 | 0 |
| 100 | 0.15 | 0 | 0 | 0 | 0 | 0 | 0 | 0 | 0 | 0 |
| 101 | 0.15 | 0 | 0 | 0 | 0 | 0 | 0 | 0 | 0 | 0 |
| 102 | 0.15 | 0 | 0 | 0 | 0 | 0 | 0 | 0 | 0 | 0 |
| 103 | 0.15 | 0 | 0 | 0 | 0 | 0 | 0 | 0 | 0 | 0 |
| 104 | 0.15 | 0 | 0 | 0 | 0 | 0 | 0 | 0 | 0 | 0 |
| 105 | 0.40 | 0 | 0 | 0 | 0 | 0 | 0 | 0 | 0 | 0 |

The underline indicates that the value is outside the scope of the present invention.

TABLE 3B-2

| | Chemical composition (mass %) | | | | | | | | | |
|---|---|---|---|---|---|---|---|---|---|---|
| | | Element group C | | | | | | | | |
| No. | Si | Cr | Ti | Ni | Co | V | Nb | Cu | Mn | ΣC |
| 106 | 0.09 | 0 | 0 | 0 | 0 | 0 | 0 | 0 | 0 | 0 |
| 107 | 0.25 | 0 | 0 | 0 | 0 | 0 | 0 | 0 | 0 | 0 |
| 108 | 0.25 | 0 | 0 | 0 | 0 | 0 | 0 | 0 | 0 | 0 |
| 109 | 0.25 | 0 | 0 | 0.20 | 0 | 0 | 0 | 0 | 0 | 0.20 |
| 110 | 0.25 | 0 | 0 | 0 | 0 | 0 | 0 | 0 | 0.20 | 0.20 |
| 111 | 0.25 | 0 | 0 | 0 | 0 | 0 | 0 | 0 | 0 | 0 |
| 112 | 0.25 | 0 | 0 | 0 | 0 | 0 | 0 | 0 | 0 | 0 |
| 113 | 0.25 | 0 | 0 | 0 | 0 | 0 | 0 | 0 | 0 | 0 |
| 114 | 0.25 | 0 | 0 | 0 | 0 | 0 | 0 | 0 | 0 | 0 |
| 115 | 0.25 | 0 | 0 | 0 | 0 | 0 | 0 | 0 | 0 | 0 |
| 116 | 0.25 | 0 | 0 | 0 | 0 | 0 | 0 | 0 | 0 | 0 |
| 117 | 0.25 | 0 | 0 | 0 | 0 | 0 | 0 | 0 | 0 | 0 |
| 118 | 0.25 | 0 | 0 | 0 | 0 | 0 | 0 | 0 | 0 | 0 |
| 119 | 0.25 | 0 | 0 | 0 | 0 | 0 | 0 | 0 | 0 | 0 |
| 120 | 0.25 | 0 | 0 | 0 | 0 | 0 | 0 | 0 | 0 | 0 |
| 121 | 0.25 | 0 | 0 | 0 | 0 | 0 | 0 | 0 | 0 | 0 |
| 122 | 0.25 | 0 | 0 | 0 | 0 | 0 | 0 | 0 | 0 | 0 |
| 123 | 0.25 | 0 | 0 | 0 | 0 | 0 | 0 | 0 | 0 | 0 |
| 124 | 0.25 | 0 | 0 | 0 | 0 | 0 | 0 | 0 | 0 | 0 |
| 125 | 0.25 | 0 | 0 | 0 | 0 | 0 | 0 | 0 | 0 | 0 |
| 126 | 0.25 | 0 | 0 | 0 | 0 | 0 | 0 | 0 | 0 | 0 |
| 127 | 0.25 | 0 | 0 | 0 | 0 | 0 | 0 | 0 | 0 | 0 |
| 128 | 0.25 | 0 | 0 | 0 | 0 | 0 | 0 | 0 | 0 | 0 |
| 129 | 0.25 | 0 | 0 | 0 | 0 | 0 | 0 | 0 | 0 | 0 |
| 130 | 0.25 | 0 | 0 | 0 | 0 | 0 | 0 | 0 | 0 | 0 |

TABLE 3B-2-continued

| | Chemical composition (mass %) | | | | | | | | | |
|---|---|---|---|---|---|---|---|---|---|---|
| | | Element group C | | | | | | | | |
| No. | Si | Cr | Ti | Ni | Co | V | Nb | Cu | Mn | ΣC |
| 131 | 0.25 | 0 | 0 | 0 | 0 | 0 | 0 | 0 | 0 | 0 |
| 132 | 0.25 | 0 | 0 | 0 | 0 | 0 | 0 | 0 | 0 | 0 |
| 133 | 0.25 | 0 | 0 | 0 | 0 | 0 | 0 | 0 | 0 | 0 |
| 134 | 0.25 | 0 | 0 | 0 | 0 | 0 | 0 | 0 | 0 | 0 |
| 135 | 0.25 | 0 | 0 | 0 | 0 | 0 | 0 | 0 | 0 | 0 |
| 136 | 0.20 | 0 | 0 | 0 | 0 | 0 | 0 | 0 | 0 | 0 |
| 137 | 0.20 | 0 | 0 | 0 | 0 | 0 | 0 | 0 | 0 | 0 |
| 138 | 0.25 | 0 | 0 | 0 | 0 | 0 | 0 | 0 | 0 | 0 |

The underline indicates that the value is outside the scope of the present invention.

TABLE 4A-1

| | Chemical composition (mass %) | | | | | | | | | | | | | | |
|---|---|---|---|---|---|---|---|---|---|---|---|---|---|---|---|
| | | Element group D | | | | | | | | | | | | | |
| No. | Fe | Sr | Sb | Pb | B | Li | Zr | Mo | W | Ag | P | ΣD | Si-Sn | Mg/Si | Al/Mg |
| 1 | 0.5 | 0 | 0 | 0 | 0 | 0 | 0 | 0 | 0 | 0 | 0 | 0 | 0.20 | 30.0 | 2.42 |
| 2 | 0.3 | 0 | 0 | 0 | 0 | 0 | 0 | 0 | 0 | 0 | 0 | 0 | 0.05 | 70.0 | 2.21 |
| 3 | 0.3 | 0 | 0 | 0 | 0 | 0 | 0 | 0 | 0 | 0 | 0 | 0 | 0.20 | 28.0 | 2.36 |
| 4 | 0.4 | 0 | 0 | 0 | 0 | 0 | 0 | 0 | 0 | 0 | 0 | 0 | 0.20 | 28.0 | 2.50 |
| 5 | 0.3 | 0 | 0 | 0 | 0 | 0 | 0 | 0 | 0 | 0 | 0 | 0 | 0.20 | 28.0 | 2.64 |
| 6 | 0.4 | 0 | 0 | 0 | 0 | 0 | 0 | 0 | 0 | 0 | 0 | 0 | 0.20 | 28.0 | 2.79 |
| 7 | 0.5 | 0 | 0 | 0 | 0 | 0 | 0 | 0 | 0 | 0 | 0 | 0 | 0.20 | 28.0 | 2.93 |
| 8 | 0.3 | 0 | 0 | 0 | 0 | 0 | 0 | 0 | 0 | 0 | 0 | 0 | 0.20 | 28.0 | 3.07 |
| 9 | 0.2 | 0 | 0 | 0 | 0 | 0 | 0 | 0 | 0 | 0 | 0 | 0 | 0.20 | 28.0 | 3.21 |
| 10 | 0.1 | 0 | 0 | 0 | 0 | 0 | 0 | 0 | 0 | 0 | 0 | 0 | 0.20 | 28.0 | 3.36 |
| 11 | 0.4 | 0 | 0 | 0 | 0 | 0 | 0 | 0 | 0 | 0 | 0 | 0 | 0.20 | 28.0 | 3.50 |
| 12 | 0.3 | 0 | 0 | 0 | 0 | 0 | 0 | 0 | 0 | 0 | 0 | 0 | 0.20 | 28.0 | 3.64 |
| 13 | 0.3 | 0 | 0 | 0 | 0 | 0 | 0 | 0 | 0 | 0 | 0 | 0 | 0.20 | 28.0 | 3.79 |
| 14 | 0.3 | 0 | 0 | 0 | 0 | 0 | 0 | 0 | 0 | 0 | 0 | 0 | 0.20 | 28.0 | 3.93 |
| 15 | 0.3 | 0 | 0 | 0 | 0 | 0 | 0 | 0 | 0 | 0 | 0 | 0 | 0.20 | 28.0 | 4.07 |
| 16 | 0.5 | 0 | 0 | 0 | 0 | 0 | 0 | 0 | 0 | 0 | 0 | 0 | 0.20 | 28.0 | 4.21 |
| 17 | 0.5 | 0 | 0 | 0 | 0 | 0 | 0 | 0 | 0 | 0 | 0 | 0 | 0.20 | 28.0 | 4.36 |
| 18 | 0.5 | 0 | 0 | 0 | 0 | 0 | 0 | 0 | 0 | 0 | 0 | 0 | 0.20 | 25.5 | 3.92 |
| 19 | 0.5 | 0 | 0 | 0 | 0 | 0 | 0 | 0 | 0 | 0 | 0 | 0 | 0.20 | 27.5 | 3.64 |
| 20 | 0.5 | 0 | 0 | 0 | 0 | 0 | 0 | 0 | 0 | 0 | 0 | 0 | 0.20 | 32.5 | 3.08 |
| 21 | 0.5 | 0 | 0 | 0 | 0 | 0 | 0 | 0 | 0 | 0 | 0 | 0 | 0.20 | 37.5 | 2.67 |
| 22 | 0.5 | 0 | 0 | 0 | 0 | 0 | 0 | 0 | 0 | 0 | 0 | 0 | 0.20 | 42.5 | 2.35 |
| 23 | 0.5 | 0 | 0 | 0 | 0 | 0 | 0 | 0 | 0 | 0 | 0 | 0 | 0.20 | 47.5 | 2.11 |
| 24 | 0.5 | 0 | 0 | 0 | 0 | 0 | 0 | 0 | 0 | 0 | 0 | 0 | 0.20 | 52.5 | 1.90 |
| 25 | 0.5 | 0 | 0 | 0 | 0 | 0 | 0 | 0 | 0 | 0 | 0 | 0 | 0.20 | 57.5 | 1.74 |
| 26 | 0.5 | 0 | 0 | 0 | 0 | 0 | 0 | 0 | 0 | 0 | 0 | 0 | 0.20 | 62.5 | 1.60 |
| 27 | 0.5 | 0 | 0 | 0 | 0 | 0 | 0 | 0 | 0 | 0 | 0 | 0 | 0.20 | 67.5 | 1.48 |
| 28 | 0.5 | 0 | 0 | 0 | 0 | 0 | 0 | 0 | 0 | 0 | 0 | 0 | 0.20 | 72.5 | 1.38 |
| 29 | 0.5 | 0 | 0 | 0 | 0 | 0 | 0 | 0 | 0 | 0 | 0 | 0 | 0.20 | 77.5 | 1.29 |
| 30 | 0.5 | 0 | 0 | 0 | 0 | 0 | 0 | 0 | 0 | 0 | 0 | 0 | 0.55 | 20.0 | 1.87 |
| 31 | 0.5 | 0 | 0 | 0 | 0 | 0 | 0 | 0 | 0 | 0 | 0 | 0 | 0.45 | 20.0 | 1.87 |
| 32 | 0.5 | 0 | 0 | 0 | 0 | 0 | 0 | 0 | 0 | 0 | 0 | 0 | 0.35 | 20.0 | 1.87 |
| 33 | 0.5 | 0 | 0 | 0 | 0 | 0 | 0 | 0 | 0 | 0 | 0 | 0 | 0.05 | 20.0 | 1.87 |
| 34 | 0.5 | 0 | 0 | 0 | 0 | 0 | 0 | 0 | 0 | 0 | 0 | 0 | 0 | 20.0 | 1.87 |
| 35 | 0.5 | 0 | 0 | 0 | 0 | 0 | 0 | 0 | 0 | 0 | 0 | 0 | 0.40 | 20.0 | 1.87 |

The underline indicates that the value is outside the scope of the present invention.

TABLE 4A-2

| | Chemical composition (mass %) | | | | | | | | | | | | | | |
|---|---|---|---|---|---|---|---|---|---|---|---|---|---|---|---|
| | | Element group D | | | | | | | | | | | | | |
| No. | Fe | Sr | Sb | Pb | B | Li | Zr | Mo | W | Ag | P | ΣD | Si-Sn | Mg/Si | Al/Mg |
| 36 | 0.5 | 0 | 0 | 0 | 0 | 0 | 0 | 0 | 0 | 0 | 0 | 0 | 0.50 | 20.0 | 1.87 |
| 37 | 0.5 | 0 | 0 | 0 | 0 | 0 | 0 | 0 | 0 | 0 | 0 | 0 | 0.40 | 20.0 | 1.87 |
| 38 | 0.5 | 0 | 0 | 0 | 0 | 0 | 0 | 0 | 0 | 0 | 0 | 0 | 0.50 | 20.0 | 1.87 |
| 39 | 0.5 | 0 | 0 | 0 | 0 | 0 | 0 | 0 | 0 | 0 | 0 | 0 | 0.75 | 20.0 | 1.87 |
| 40 | 0.5 | 0 | 0 | 0 | 0 | 0 | 0 | 0 | 0 | 0 | 0 | 0 | 0.75 | 20.0 | 1.87 |
| 41 | 0.5 | 0 | 0 | 0 | 0 | 0 | 0 | 0 | 0 | 0 | 0 | 0 | 0.20 | 75.0 | 1.20 |
| 42 | 0.5 | 0 | 0 | 0 | 0 | 0 | 0 | 0 | 0 | 0 | 0 | 0 | 0.20 | 27.5 | 3.27 |
| 43 | 0.5 | 0 | 0 | 0 | 0 | 0 | 0 | 0 | 0 | 0 | 0 | 0 | 0.20 | 27.5 | 3.27 |
| 44 | 0.5 | 0 | 0 | 0 | 0 | 0 | 0 | 0 | 0 | 0 | 0 | 0 | 0.20 | 27.5 | 3.27 |
| 45 | 0.5 | 0 | 0 | 0 | 0 | 0 | 0 | 0 | 0 | 0 | 0 | 0 | 0.20 | 27.5 | 3.27 |
| 46 | 0.5 | 0 | 0 | 0 | 0 | 0 | 0 | 0 | 0 | 0 | 0 | 0 | 0.20 | 27.5 | 3.27 |
| 47 | 0.5 | 0 | 0 | 0 | 0 | 0 | 0 | 0 | 0 | 0 | 0 | 0 | 0.20 | 27.5 | 3.27 |
| 48 | 0.5 | 0 | 0 | 0 | 0 | 0 | 0 | 0 | 0 | 0 | 0 | 0 | 0.20 | 27.5 | 3.27 |
| 49 | 0.5 | 0 | 0 | 0 | 0 | 0 | 0 | 0 | 0 | 0 | 0 | 0 | 0.20 | 27.5 | 3.27 |
| 50 | 0.5 | 0 | 0 | 0 | 0 | 0 | 0 | 0 | 0 | 0 | 0 | 0 | 0.20 | 27.5 | 3.27 |
| 51 | 0.5 | 0 | 0 | 0 | 0 | 0 | 0 | 0 | 0 | 0 | 0 | 0 | 0 | — | 3.25 |
| 52 | 0.5 | 0 | 0 | 0 | 0 | 0 | 0 | 0 | 0 | 0 | 0 | 0 | 0.01 | 800.0 | 3.25 |
| 53 | 0.5 | 0 | 0 | 0 | 0 | 0 | 0 | 0 | 0 | 0 | 0 | 0 | 0.05 | 160.0 | 3.25 |
| 54 | 0.5 | 0 | 0 | 0 | 0 | 0 | 0 | 0 | 0 | 0 | 0 | 0 | 0.30 | 50.0 | 1.73 |
| 55 | 0.5 | 0 | 0 | 0 | 0 | 0 | 0 | 0 | 0 | 0 | 0 | 0 | 0.45 | 33.3 | 1.73 |
| 56 | 0.5 | 0 | 0 | 0 | 0 | 0 | 0 | 0 | 0 | 0 | 0 | 0 | 0.75 | 20.0 | 1.73 |
| 57 | 0.5 | 0 | 0 | 0 | 0 | 0 | 0 | 0 | 0 | 0 | 0 | 0 | 0.80 | 18.8 | 1.73 |
| 58 | 0.5 | 0 | 0 | 0 | 0 | 0 | 0 | 0 | 0 | 0 | 0 | 0 | 0.10 | 35.0 | 2.29 |
| 59 | 0.5 | 0 | 0 | 0 | 0 | 0 | 0 | 0 | 0 | 0 | 0 | 0 | 0.10 | 35.0 | 2.29 |
| 60 | 0.5 | 0 | 0 | 0 | 0 | 0 | 0 | 0 | 0 | 0 | 0 | 0 | 0.10 | 35.0 | 2.29 |
| 61 | 0.5 | 0 | 0 | 0 | 0 | 0 | 0 | 0 | 0 | 0 | 0 | 0 | 0.10 | 35.0 | 2.29 |
| 62 | 0.5 | 0 | 0 | 0 | 0 | 0 | 0 | 0 | 0 | 0 | 0 | 0 | 0.10 | 35.0 | 2.29 |
| 63 | 0.5 | 0 | 0 | 0 | 0 | 0 | 0 | 0 | 0 | 0 | 0 | 0 | 0.10 | 35.0 | 2.29 |
| 64 | 0.5 | 0 | 0 | 0 | 0 | 0 | 0 | 0 | 0 | 0 | 0 | 0 | 0.10 | 35.0 | 2.29 |
| 65 | 0.5 | 0 | 0 | 0 | 0 | 0 | 0 | 0 | 0 | 0 | 0 | 0 | 0.10 | 35.0 | 2.29 |
| 66 | 0.5 | 0 | 0 | 0 | 0 | 0 | 0 | 0 | 0 | 0 | 0 | 0 | 0.10 | 35.0 | 2.29 |
| 67 | 0.5 | 0 | 0 | 0 | 0 | 0 | 0 | 0 | 0 | 0 | 0 | 0 | 0.10 | 35.0 | 2.29 |
| 68 | 0.5 | 0 | 0 | 0 | 0 | 0 | 0 | 0 | 0 | 0 | 0 | 0 | 0.10 | 35.0 | 2.29 |
| 69 | 0.5 | 0 | 0 | 0 | 0 | 0 | 0 | 0 | 0 | 0 | 0 | 0 | 0.10 | 35.0 | 2.29 |
| 70 | 0.5 | 0 | 0 | 0 | 0 | 0 | 0 | 0 | 0 | 0 | 0 | 0 | 0.10 | 35.0 | 2.29 |

The underline indicates that the value is outside the scope of the present invention.

TABLE 4B-1

| | Chemical composition (mass %) | | | | | | | | | | | | | | |
|---|---|---|---|---|---|---|---|---|---|---|---|---|---|---|---|
| | | Element group D | | | | | | | | | | | | | |
| No. | Fe | Sr | Sb | Pb | B | Li | Zr | Mo | W | Ag | P | ΣD | Si-Sn | Mg/Si | Al/Mg |
| 71 | 0.5 | 0 | 0 | 0 | 0 | 0 | 0 | 0 | 0 | 0 | 0 | 0 | 0.10 | 35.0 | 2.29 |
| 72 | 0.5 | 0 | 0 | 0 | 0 | 0 | 0 | 0 | 0 | 0 | 0 | 0 | 0.10 | 35.0 | 2.29 |
| 73 | 0.5 | 0 | 0 | 0 | 0 | 0 | 0 | 0 | 0 | 0 | 0 | 0 | 0.10 | 35.0 | 2.29 |
| 74 | 5.5 | 0 | 0 | 0 | 0 | 0 | 0 | 0 | 0 | 0 | 0 | 0 | 0.01 | 550.0 | 5.27 |
| 75 | 0.3 | 0.2 | 0 | 0 | 0 | 0 | 0 | 0 | 0 | 0 | 0 | 0.2 | 0.10 | 40.0 | 3.75 |
| 76 | 0.3 | 0.5 | 0 | 0 | 0 | 0 | 0 | 0 | 0 | 0 | 0 | 0.5 | 0.10 | 40.0 | 3.75 |
| 77 | 0.3 | 0.6 | 0 | 0 | 0 | 0 | 0 | 0 | 0 | 0 | 0 | 0.6 | 0.10 | 40.0 | 3.75 |
| 78 | 0.3 | 0 | 0.2 | 0 | 0 | 0 | 0 | 0 | 0 | 0 | 0 | 0.2 | 0.10 | 40.0 | 3.75 |
| 79 | 0.3 | 0 | 0.5 | 0 | 0 | 0 | 0 | 0 | 0 | 0 | 0 | 0.5 | 0.10 | 40.0 | 3.75 |
| 80 | 0.3 | 0 | 0.6 | 0 | 0 | 0 | 0 | 0 | 0 | 0 | 0 | 0.6 | 0.10 | 40.0 | 3.75 |
| 81 | 0.3 | 0 | 0 | 0.2 | 0 | 0 | 0 | 0 | 0 | 0 | 0 | 0.2 | 0.10 | 40.0 | 3.75 |
| 82 | 0.3 | 0 | 0 | 0.5 | 0 | 0 | 0 | 0 | 0 | 0 | 0 | 0.5 | 0.10 | 40.0 | 3.75 |
| 83 | 0.3 | 0 | 0 | 0.6 | 0 | 0 | 0 | 0 | 0 | 0 | 0 | 0.6 | 0.10 | 40.0 | 3.75 |
| 84 | 0.3 | 0 | 0 | 0 | 0.2 | 0 | 0 | 0 | 0 | 0 | 0 | 0.2 | 0.10 | 40.0 | 3.75 |
| 85 | 0.3 | 0 | 0 | 0 | 0.5 | 0 | 0 | 0 | 0 | 0 | 0 | 0.5 | 0.10 | 40.0 | 3.75 |
| 86 | 0.3 | 0 | 0 | 0 | 0.6 | 0 | 0 | 0 | 0 | 0 | 0 | 0.6 | 0.10 | 40.0 | 3.75 |
| 87 | 0.3 | 0 | 0 | 0 | 0 | 0.2 | 0 | 0 | 0 | 0 | 0 | 0.2 | 0.10 | 40.0 | 3.75 |
| 88 | 0.3 | 0 | 0 | 0 | 0 | 0.5 | 0 | 0 | 0 | 0 | 0 | 0.5 | 0.10 | 40.0 | 3.75 |
| 89 | 0.3 | 0 | 0 | 0 | 0 | 0.6 | 0 | 0 | 0 | 0 | 0 | 0.6 | 0.10 | 40.0 | 3.75 |
| 90 | 0.3 | 0 | 0 | 0 | 0 | 0 | 0.2 | 0 | 0 | 0 | 0 | 0.2 | 0.10 | 40.0 | 3.75 |
| 91 | 0.3 | 0 | 0 | 0 | 0 | 0 | 0.5 | 0 | 0 | 0 | 0 | 0.5 | 0.10 | 40.0 | 3.75 |
| 92 | 0.3 | 0 | 0 | 0 | 0 | 0 | 0.6 | 0 | 0 | 0 | 0 | 0.6 | 0.10 | 40.0 | 3.75 |
| 93 | 0.3 | 0 | 0 | 0 | 0 | 0 | 0 | 0.2 | 0 | 0 | 0 | 0.2 | 0.10 | 40.0 | 3.75 |
| 94 | 0.3 | 0 | 0 | 0 | 0 | 0 | 0 | 0.5 | 0 | 0 | 0 | 0.5 | 0.10 | 40.0 | 3.75 |
| 95 | 0.3 | 0 | 0 | 0 | 0 | 0 | 0 | 0.6 | 0 | 0 | 0 | 0.6 | 0.10 | 40.0 | 3.75 |

TABLE 4B-1-continued

| | Chemical composition (mass %) | | | | | | | | | | | | | | |
|---|---|---|---|---|---|---|---|---|---|---|---|---|---|---|---|
| | | Element group D | | | | | | | | | | | | | |
| No. | Fe | Sr | Sb | Pb | B | Li | Zr | Mo | W | Ag | P | ΣD | Si-Sn | Mg/Si | Al/Mg |
| 96 | 0.3 | 0 | 0 | 0 | 0 | 0 | 0 | 0 | 0.2 | 0 | 0 | 0.2 | 0.10 | 40.0 | 3.75 |
| 97 | 0.3 | 0 | 0 | 0 | 0 | 0 | 0 | 0 | 0.5 | 0 | 0 | 0.5 | 0.10 | 40.0 | 3.75 |
| 98 | 0.3 | 0 | 0 | 0 | 0 | 0 | 0 | 0 | 0.6 | 0 | 0 | 0.6 | 0.10 | 40.0 | 3.75 |
| 99 | 0.3 | 0 | 0 | 0 | 0 | 0 | 0 | 0 | 0 | 0.2 | 0 | 0.2 | 0.10 | 40.0 | 3.75 |
| 100 | 0.3 | 0 | 0 | 0 | 0 | 0 | 0 | 0 | 0 | 0.5 | 0 | 0.5 | 0.10 | 40.0 | 3.75 |
| 101 | 0.3 | 0 | 0 | 0 | 0 | 0 | 0 | 0 | 0 | 0.6 | 0 | 0.6 | 0.10 | 40.0 | 3.75 |
| 102 | 0.3 | 0 | 0 | 0 | 0 | 0 | 0 | 0 | 0 | 0 | 0.2 | 0.2 | 0.10 | 40.0 | 3.75 |
| 103 | 0.3 | 0 | 0 | 0 | 0 | 0 | 0 | 0 | 0 | 0 | 0.5 | 0.5 | 0.10 | 40.0 | 3.75 |
| 104 | 0.3 | 0 | 0 | 0 | 0 | 0 | 0 | 0 | 0 | 0 | 0.6 | 0.6 | 0.10 | 40.0 | 3.75 |
| 105 | 1.5 | 0 | 0 | 0 | 0 | 0 | 0 | 0 | 0 | 0 | 0 | 0 | 0.30 | 22.5 | 3.00 |

The underline indicates that the value is outside the scope of the present invention.

TABLE 4B-2

| | Chemical composition (mass %) | | | | | | | | | | | | | | |
|---|---|---|---|---|---|---|---|---|---|---|---|---|---|---|---|
| | | Element group D | | | | | | | | | | | | | |
| No. | Fe | Sr | Sb | Pb | B | Li | Zr | Mo | W | Ag | P | ED | Si-Sn | Mg/Si | Al/Mg |
| 106 | 1.5 | 0 | 0 | 0 | 0 | 0 | 0 | 0 | 0 | 0 | 0 | 0 | −0.01 | 100.0 | 3.00 |
| 107 | 1.5 | 0 | 0 | 0 | 0 | 0 | 0 | 0 | 0 | 0 | 0 | 0 | 0.15 | 28.0 | 2.86 |
| 108 | 1.5 | 0 | 0 | 0 | 0 | 0 | 0 | 0 | 0 | 0 | 0 | 0 | 0.15 | 28.0 | 2.86 |
| 109 | 1.5 | 0 | 0 | 0 | 0.1 | 0 | 0 | 0 | 0 | 0 | 0 | 0.1 | 0.15 | 28.0 | 2.86 |
| 110 | 1.5 | 0 | 0 | 0 | 0 | 0 | 0.1 | 0 | 0 | 0 | 0 | 0.1 | 0.15 | 28.0 | 2.86 |
| 111 | 1.5 | 0 | 0 | 0 | 0 | 0 | 0 | 0 | 0 | 0 | 0 | 0 | 0.15 | 28.0 | 2.86 |
| 112 | 1.5 | 0 | 0 | 0 | 0 | 0 | 0 | 0 | 0 | 0 | 0 | 0 | 0.15 | 28.0 | 2.86 |
| 113 | 1.5 | 0 | 0 | 0 | 0 | 0 | 0 | 0 | 0 | 0 | 0 | 0 | 0.15 | 28.0 | 2.86 |
| 114 | 1.5 | 0 | 0 | 0 | 0 | 0 | 0 | 0 | 0 | 0 | 0 | 0 | 0.15 | 28.0 | 2.86 |
| 115 | 1.5 | 0 | 0 | 0 | 0 | 0 | 0 | 0 | 0 | 0 | 0 | 0 | 0.15 | 28.0 | 2.86 |
| 116 | 1.5 | 0 | 0 | 0 | 0 | 0 | 0 | 0 | 0 | 0 | 0 | 0 | 0.15 | 28.0 | 2.86 |
| 117 | 1.5 | 0 | 0 | 0 | 0 | 0 | 0 | 0 | 0 | 0 | 0 | 0 | 0.15 | 28.0 | 2.86 |
| 118 | 1.5 | 0 | 0 | 0 | 0 | 0 | 0 | 0 | 0 | 0 | 0 | 0 | 0.15 | 28.0 | 2.86 |
| 119 | 1.5 | 0 | 0 | 0 | 0 | 0 | 0 | 0 | 0 | 0 | 0 | 0 | 0.15 | 28.0 | 2.86 |
| 120 | 1.5 | 0 | 0 | 0 | 0 | 0 | 0 | 0 | 0 | 0 | 0 | 0 | 0.15 | 28.0 | 2.86 |
| 121 | 1.5 | 0 | 0 | 0 | 0 | 0 | 0 | 0 | 0 | 0 | 0 | 0 | 0.15 | 28.0 | 2.86 |
| 122 | 1.5 | 0 | 0 | 0 | 0 | 0 | 0 | 0 | 0 | 0 | 0 | 0 | 0.15 | 28.0 | 2.86 |
| 123 | 1.5 | 0 | 0 | 0 | 0 | 0 | 0 | 0 | 0 | 0 | 0 | 0 | 0.15 | 28.0 | 2.86 |
| 124 | 1.5 | 0 | 0 | 0 | 0 | 0 | 0 | 0 | 0 | 0 | 0 | 0 | 0.15 | 28.0 | 2.86 |
| 125 | 1.5 | 0 | 0 | 0 | 0 | 0 | 0 | 0 | 0 | 0 | 0 | 0 | 0.15 | 28.0 | 2.86 |
| 126 | 1.5 | 0 | 0 | 0 | 0 | 0 | 0 | 0 | 0 | 0 | 0 | 0 | 0.15 | 28.0 | 2.86 |
| 127 | 1.5 | 0 | 0 | 0 | 0 | 0 | 0 | 0 | 0 | 0 | 0 | 0 | 0.15 | 28.0 | 2.86 |
| 128 | 1.5 | 0 | 0 | 0 | 0 | 0 | 0 | 0 | 0 | 0 | 0 | 0 | 0.15 | 36.0 | 2.56 |
| 129 | 1.5 | 0 | 0 | 0 | 0 | 0 | 0 | 0 | 0 | 0 | 0 | 0 | 0.15 | 36.0 | 2.56 |
| 130 | 1.5 | 0 | 0 | 0 | 0 | 0 | 0 | 0 | 0 | 0 | 0 | 0 | 0.15 | 36.0 | 2.56 |
| 131 | 1.5 | 0 | 0 | 0 | 0 | 0 | 0 | 0 | 0 | 0 | 0 | 0 | 0.15 | 36.0 | 2.56 |
| 132 | 1.5 | 0 | 0 | 0 | 0 | 0 | 0 | 0 | 0 | 0 | 0 | 0 | 0.15 | 36.0 | 2.56 |
| 133 | 1.5 | 0 | 0 | 0 | 0 | 0 | 0 | 0 | 0 | 0 | 0 | 0 | 0.15 | 28.0 | 2.86 |
| 134 | 1.5 | 0 | 0 | 0 | 0 | 0 | 0 | 0 | 0 | 0 | 0 | 0 | 0.15 | 28.0 | 2.86 |
| 135 | 1.5 | 0 | 0 | 0 | 0 | 0 | 0 | 0 | 0 | 0 | 0 | 0 | 0.15 | 28.0 | 2.86 |
| 136 | 0.5 | 0 | 0 | 0 | 0 | 0 | 0 | 0 | 0 | 0 | 0 | 0 | 0.20 | 22.5 | 4.00 |
| 137 | 1.0 | 0 | 0 | 0 | 0 | 0 | 0 | 0 | 0 | 0 | 0 | 0 | 0.10 | 25.0 | 5.60 |
| 138 | 1.5 | 0 | 0 | 0 | 0 | 0 | 0 | 0 | 0 | 0 | 0 | 0 | 0.15 | 28.0 | 2.86 |

The underline indicates that the value is outside the scope of the present invention.

TABLE 5A-1

| | XRD | | | | | | | | |
|---|---|---|---|---|---|---|---|---|---|
| No. | $I_1$ | $I_2$ | $I_3$ | $I_4$ | (A) | Ca/Si | $I_5$ | $I_6$ | (B) |
| 1 | 1.00 | 1.00 | 1.00 | 1.00 | 4.00 | 1.00 | 1.00 | 1.00 | 2.00 |
| 2 | 1.04 | 1.02 | 1.01 | 1.03 | 4.10 | 0.50 | 1.12 | 1.08 | 2.20 |
| 3 | 1.03 | 1.02 | 1.01 | 1.03 | 4.09 | 1.60 | 1.04 | 1.05 | 2.09 |
| 4 | 1.03 | 1.02 | 1.01 | 1.02 | 4.08 | 1.60 | 1.03 | 1.05 | 2.08 |
| 5 | 1.03 | 1.02 | 1.01 | 1.03 | 4.09 | 1.20 | 1.04 | 1.04 | 2.08 |
| 6 | 1.02 | 1.02 | 1.01 | 1.03 | 4.08 | 0.80 | 1.04 | 1.05 | 2.09 |

TABLE 5A-1-continued

| | XRD | | | | | | | | |
|---|---|---|---|---|---|---|---|---|---|
| No. | $I_1$ | $I_2$ | $I_3$ | $I_4$ | (A) | Ca/Si | $I_5$ | $I_6$ | (B) |
| 7 | 1.03 | 1.02 | 1.01 | 1.03 | 4.09 | 0.80 | 1.03 | 1.05 | 2.08 |
| 8 | 1.02 | 1.02 | 1.01 | 1.03 | 4.08 | 0.80 | 1.05 | 1.06 | 2.11 |
| 9 | 1.03 | 1.01 | 1.01 | 1.03 | 4.08 | 0.80 | 1.05 | 1.04 | 2.09 |
| 10 | 1.03 | 1.02 | 1.01 | 1.03 | 4.09 | 0.80 | 1.05 | 1.03 | 2.08 |
| 11 | 1.03 | 1.02 | 1.01 | 1.03 | 4.09 | 0.80 | 1.05 | 1.05 | 2.10 |
| 12 | 1.01 | 1.03 | 1.01 | 1.03 | 4.08 | 0.80 | 1.04 | 1.05 | 2.09 |

TABLE 5A-1-continued

| No. | XRD $I_1$ | $I_2$ | $I_3$ | $I_4$ | (A) | Ca/Si | $I_5$ | $I_6$ | (B) |
|---|---|---|---|---|---|---|---|---|---|
| 13 | 1.04 | 1.02 | 1.01 | 1.03 | 4.10 | 0.80 | 1.06 | 1.06 | 2.12 |
| 14 | 1.03 | 1.02 | 1.01 | 1.03 | 4.09 | 0.80 | 1.04 | 1.05 | 2.09 |
| 15 | 1.02 | 1.02 | 1.01 | 1.03 | 4.08 | 0.80 | 1.03 | 1.05 | 2.08 |
| 16 | 1.02 | 1.02 | 1.01 | 1.03 | 4.08 | 0.80 | 1.05 | 1.05 | 2.10 |
| 17 | 1.00 | 1.00 | 1.00 | 1.00 | 4.00 | 0.80 | 1.00 | 1.01 | 2.01 |
| 18 | 1.09 | 1.02 | 1.01 | 1.03 | 4.15 | 0.50 | 1.10 | 1.08 | 2.18 |
| 19 | 1.07 | 1.02 | 1.01 | 1.03 | 4.13 | 0.50 | 1.12 | 1.09 | 2.21 |
| 20 | 1.10 | 1.02 | 1.01 | 1.02 | 4.15 | 0.50 | 1.10 | 1.09 | 2.19 |
| 21 | 1.07 | 1.02 | 1.01 | 1.03 | 4.13 | 0.50 | 1.09 | 1.10 | 2.19 |
| 22 | 1.09 | 1.02 | 1.01 | 1.03 | 4.15 | 0.50 | 1.13 | 1.10 | 2.23 |
| 23 | 1.05 | 1.02 | 1.01 | 1.03 | 4.11 | 0.50 | 1.07 | 1.11 | 2.18 |
| 24 | 1.07 | 1.02 | 1.01 | 1.03 | 4.13 | 0.50 | 1.08 | 1.10 | 2.18 |
| 25 | 1.07 | 1.02 | 1.01 | 1.03 | 4.13 | 0.50 | 1.07 | 1.10 | 2.17 |
| 26 | 1.06 | 1.02 | 1.02 | 1.03 | 4.13 | 0.50 | 1.09 | 1.09 | 2.18 |
| 27 | 1.06 | 1.02 | 1.01 | 1.04 | 4.13 | 0.50 | 1.10 | 1.07 | 2.17 |
| 28 | 1.06 | 1.02 | 1.01 | 1.03 | 4.12 | 0.50 | 1.13 | 1.07 | 2.20 |
| 29 | 1.00 | 1.00 | 1.00 | 1.00 | 4.00 | 0.50 | 1.00 | 1.00 | 2.00 |
| 30 | 1.04 | 1.03 | 1.02 | 1.04 | 4.13 | 0.67 | 1.11 | 1.10 | 2.21 |
| 31 | 1.04 | 1.02 | 1.01 | 1.04 | 4.11 | 0.67 | 1.10 | 1.11 | 2.21 |
| 32 | 1.06 | 1.02 | 1.01 | 1.03 | 4.12 | 0.67 | 1.09 | 1.12 | 2.21 |
| 33 | 1.05 | 1.02 | 1.02 | 1.04 | 4.13 | 0.67 | 1.12 | 1.05 | 2.17 |
| 34 | 1.00 | 1.00 | 1.00 | 1.00 | 4.00 | 0.67 | 1.00 | 1.00 | 2.00 |
| 35 | 1.05 | 1.02 | 1.04 | 1.04 | 4.15 | 0.67 | 1.10 | 1.08 | 2.18 |

The underline indicates that the value is outside the scope of the present invention.

TABLE 5A-2

| No. | XRD $I_1$ | $I_2$ | $I_3$ | $I_4$ | (A) | Ca/Si | $I_5$ | $I_6$ | (B) |
|---|---|---|---|---|---|---|---|---|---|
| 36 | 1.00 | 1.00 | 1.00 | 1.00 | 4.00 | 0.67 | 1.00 | 1.00 | 2.00 |
| 37 | 1.05 | 1.04 | 1.02 | 1.04 | 4.15 | 0.67 | 1.10 | 1.08 | 2.18 |
| 38 | 1.00 | 1.00 | 1.00 | 1.00 | 4.00 | 0.67 | 1.00 | 1.00 | 2.00 |
| 39 | 1.00 | 1.00 | 1.00 | 1.00 | 4.00 | 0.67 | 1.00 | 1.00 | 2.00 |
| 40 | 1.00 | 1.00 | 1.00 | 1.00 | 4.00 | 0.67 | 1.00 | 1.00 | 2.00 |
| 41 | 1.00 | 1.00 | 1.00 | 1.00 | 4.00 | 0.00 | 1.00 | 1.00 | 2.00 |
| 42 | 1.02 | 1.02 | 1.01 | 1.03 | 4.08 | 2.50 | 1.04 | 1.05 | 2.09 |
| 43 | 1.03 | 1.02 | 1.01 | 1.03 | 4.09 | 3.00 | 1.04 | 1.04 | 2.08 |
| 44 | 1.00 | 1.00 | 1.00 | 1.00 | 4.00 | 3.50 | 1.00 | 1.00 | 2.00 |
| 45 | 1.02 | 1.02 | 1.01 | 1.03 | 4.08 | 1.50 | 1.04 | 1.04 | 2.08 |
| 46 | 1.00 | 1.00 | 1.00 | 1.00 | 4.00 | 2.00 | 1.01 | 1.00 | 2.01 |
| 47 | 1.00 | 1.00 | 1.00 | 1.00 | 4.00 | 1.00 | 1.01 | 1.00 | 2.01 |
| 48 | 1.03 | 1.02 | 1.01 | 1.03 | 4.09 | 1.50 | 1.05 | 1.04 | 2.09 |
| 49 | 1.02 | 1.02 | 1.01 | 1.03 | 4.08 | 1.50 | 1.05 | 1.03 | 2.08 |
| 50 | 1.02 | 1.02 | 1.01 | 1.03 | 4.08 | 1.50 | 1.05 | 1.05 | 2.10 |
| 51 | 1.00 | 1.00 | 1.00 | 1.00 | 4.00 | — | 1.00 | 1.00 | 2.00 |
| 52 | 1.04 | 1.02 | 1.01 | 1.03 | 4.10 | 60.00 | 1.05 | 1.04 | 2.09 |
| 53 | 1.01 | 1.02 | 1.02 | 1.03 | 4.08 | 12.00 | 1.04 | 1.04 | 2.08 |
| 54 | 1.02 | 1.02 | 1.01 | 1.03 | 4.08 | 2.00 | 1.04 | 1.04 | 2.08 |
| 55 | 1.03 | 1.02 | 1.01 | 1.03 | 4.09 | 1.33 | 1.05 | 1.04 | 2.09 |
| 56 | 1.02 | 1.02 | 1.01 | 1.03 | 4.08 | 0.80 | 1.05 | 1.05 | 2.10 |
| 57 | 1.00 | 1.00 | 1.00 | 1.00 | 4.00 | 0.75 | 1.00 | 1.00 | 2.00 |
| 58 | 1.04 | 1.02 | 1.01 | 1.03 | 4.10 | 1.50 | 1.06 | 1.05 | 2.11 |
| 59 | 1.00 | 1.00 | 1.00 | 1.00 | 4.00 | 1.50 | 1.00 | 1.00 | 2.00 |
| 60 | 1.02 | 1.02 | 1.0 | 1.03 | 4.08 | 1.50 | 1.05 | 1.05 | 2.10 |
| 61 | 1.00 | 1.00 | 1.00 | 1.00 | 4.00 | 1.50 | 1.00 | 1.00 | 2.00 |
| 62 | 1.00 | 1.00 | 1.00 | 1.00 | 4.00 | 1.50 | 1.00 | 1.00 | 2.00 |
| 63 | 1.03 | 1.02 | 1.01 | 1.03 | 4.09 | 1.50 | 1.05 | 1.04 | 2.09 |
| 64 | 1.00 | 1.00 | 1.00 | 1.00 | 4.00 | 1.50 | 1.00 | 1.00 | 2.00 |
| 65 | 1.03 | 1.02 | 1.01 | 1.03 | 4.09 | 1.50 | 1.05 | 1.05 | 2.10 |
| 66 | 1.00 | 1.00 | 1.00 | 1.00 | 4.00 | 1.50 | 1.00 | 1.00 | 2.00 |
| 67 | 1.02 | 1.02 | 1.01 | 1.03 | 4.08 | 1.50 | 1.06 | 1.04 | 2.10 |
| 68 | 1.00 | 1.00 | 1.00 | 1.00 | 4.00 | 1.50 | 1.00 | 1.01 | 2.01 |
| 69 | 1.02 | 1.02 | 1.01 | 1.03 | 4.08 | 1.50 | 1.05 | 1.05 | 2.10 |
| 70 | 1.00 | 1.00 | 1.00 | 1.00 | 4.00 | 1.50 | 1.00 | 1.01 | 2.01 |

The underline indicates that the value is outside the scope of the present invention.

TABLE 5B-1

| No. | XRD $I_1$ | $I_2$ | $I_3$ | $I_4$ | (A) | Ca/Si | $I_5$ | $I_6$ | (B) |
|---|---|---|---|---|---|---|---|---|---|
| 71 | 1.03 | 1.02 | 1.01 | 1.03 | 4.09 | 1.50 | 1.05 | 1.05 | 2.10 |
| 72 | 1.00 | 1.00 | 1.00 | 1.00 | 4.00 | 1.50 | 1.00 | 1.00 | 2.00 |
| 73 | 1.00 | 1.00 | 1.00 | 1.00 | 4.00 | 1.50 | 1.00 | 1.00 | 2.00 |
| 74 | 1.00 | 1.00 | 1.00 | 1.00 | 4.00 | 3.00 | 1.00 | 1.00 | 2.00 |
| 75 | 1.06 | 1.02 | 1.01 | 1.03 | 4.12 | 0.67 | 1.09 | 1.09 | 2.18 |
| 76 | 1.07 | 1.02 | 1.01 | 1.03 | 4.13 | 0.67 | 1.08 | 1.07 | 2.15 |
| 77 | 1.00 | 1.00 | 1.00 | 1.00 | 4.00 | 0.67 | 1.00 | 1.00 | 2.00 |
| 78 | 1.07 | 1.02 | 1.01 | 1.03 | 4.13 | 0.67 | 1.08 | 1.08 | 2.16 |
| 79 | 1.06 | 1.02 | 1.02 | 1.03 | 4.13 | 0.67 | 1.08 | 1.07 | 2.15 |
| 80 | 1.00 | 1.00 | 1.00 | 1.00 | 4.00 | 0.67 | 1.00 | 1.00 | 2.00 |
| 81 | 1.07 | 1.02 | 1.01 | 1.03 | 4.13 | 0.67 | 1.09 | 1.08 | 2.17 |
| 82 | 1.08 | 1.02 | 1.01 | 1.03 | 4.14 | 0.67 | 1.08 | 1.08 | 2.16 |
| 83 | 1.00 | 1.00 | 1.00 | 1.00 | 4.00 | 0.67 | 1.00 | 1.00 | 2.00 |
| 84 | 1.05 | 1.02 | 1.02 | 1.03 | 4.12 | 0.67 | 1.10 | 1.08 | 2.18 |
| 85 | 1.05 | 1.02 | 1.02 | 1.03 | 4.12 | 0.67 | 1.08 | 1.10 | 2.18 |
| 86 | 1.00 | 1.00 | 1.00 | 1.00 | 4.00 | 0.67 | 1.00 | 1.00 | 2.00 |
| 87 | 1.06 | 1.02 | 1.02 | 1.03 | 4.13 | 0.67 | 1.07 | 1.10 | 2.17 |
| 88 | 1.06 | 1.02 | 1.02 | 1.03 | 4.13 | 0.67 | 1.08 | 1.08 | 2.16 |
| 89 | 1.00 | 1.00 | 1.00 | 1.00 | 4.00 | 0.67 | 1.00 | 1.00 | 2.00 |
| 90 | 1.06 | 1.02 | 1.02 | 1.03 | 4.13 | 0.67 | 1.07 | 1.08 | 2.15 |
| 91 | 1.05 | 1.02 | 1.02 | 1.03 | 4.12 | 0.67 | 1.09 | 1.08 | 2.17 |
| 92 | 1.00 | 1.00 | 1.00 | 1.00 | 4.00 | 0.67 | 1.00 | 1.00 | 2.00 |
| 93 | 1.04 | 1.02 | 1.02 | 1.03 | 4.11 | 0.67 | 1.10 | 1.08 | 2.18 |
| 94 | 1.03 | 1.02 | 1.02 | 1.03 | 4.10 | 0.67 | 1.10 | 1.08 | 2.18 |
| 95 | 1.00 | 1.00 | 1.00 | 1.00 | 4.00 | 0.67 | 1.00 | 1.00 | 2.00 |
| 96 | 1.05 | 1.02 | 1.02 | 1.03 | 4.12 | 0.67 | 1.10 | 1.08 | 2.18 |
| 97 | 1.05 | 1.02 | 1.02 | 1.03 | 4.12 | 0.67 | 1.09 | 1.08 | 2.17 |
| 98 | 1.00 | 1.00 | 1.00 | 1.00 | 4.00 | 0.67 | 1.00 | 1.00 | 2.00 |
| 99 | 1.03 | 1.02 | 1.02 | 1.03 | 4.10 | 0.67 | 1.09 | 1.08 | 2.17 |
| 100 | 1.04 | 1.02 | 1.02 | 1.03 | 4.11 | 0.67 | 1.08 | 1.08 | 2.16 |
| 101 | 1.00 | 1.00 | 1.00 | 1.00 | 4.00 | 0.67 | 1.00 | 1.00 | 2.00 |
| 102 | 1.04 | 1.03 | 1.02 | 1.03 | 4.12 | 0.67 | 1.10 | 1.08 | 2.18 |
| 103 | 1.05 | 1.02 | 1.02 | 1.03 | 4.12 | 0.67 | 1.08 | 1.08 | 2.16 |
| 104 | 1.00 | 1.00 | 1.00 | 1.00 | 4.00 | 0.67 | 1.00 | 1.00 | 2.00 |
| 105 | 1.01 | 1.03 | 1.02 | 1.03 | 4.09 | 0.25 | 1.06 | 1.04 | 2.10 |

The underline indicates that the value is outside the scope of the present invention.

TABLE 5B-2

| No. | XRD $I_1$ | $I_2$ | $I_3$ | $I_4$ | (A) | Ca/Si | $I_5$ | $I_6$ | (B) |
|---|---|---|---|---|---|---|---|---|---|
| 106 | 1.00 | 1.00 | 1.00 | 1.00 | 4.00 | 1.11 | 1.00 | 1.00 | 2.00 |
| 107 | 1.00 | 1.00 | 1.00 | 1.00 | 4.00 | 0.40 | 1.00 | 1.00 | 2.00 |
| 108 | 1.00 | 1.00 | 1.00 | 1.00 | 4.00 | 0.40 | 1.00 | 1.00 | 2.00 |
| 109 | 1.01 | 1.01 | 1.02 | 1.03 | 4.07 | 0.40 | 1.03 | 1.03 | 2.06 |
| 110 | 1.02 | 1.02 | 1.02 | 1.01 | 4.07 | 0.40 | 1.04 | 1.02 | 2.06 |
| 111 | 1.01 | 1.01 | 1.02 | 1.03 | 4.07 | 0.40 | 1.04 | 1.03 | 2.07 |
| 112 | 1.01 | 1.01 | 1.02 | 1.03 | 4.07 | 0.40 | 1.04 | 1.03 | 2.07 |
| 113 | 1.01 | 1.02 | 1.02 | 1.01 | 4.06 | 0.40 | 1.03 | 1.03 | 2.06 |
| 114 | 1.01 | 1.02 | 1.02 | 1.01 | 4.06 | 0.40 | 1.03 | 1.03 | 2.06 |
| 115 | 1.00 | 1.00 | 1.00 | 1.00 | 4.00 | 0.40 | 1.00 | 1.00 | 2.00 |
| 116 | 1.00 | 1.00 | 1.00 | 1.00 | 4.00 | 0.40 | 1.00 | 1.00 | 2.00 |
| 117 | 1.02 | 1.02 | 1.02 | 1.01 | 4.07 | 0.40 | 1.03 | 1.03 | 2.06 |
| 118 | 1.02 | 1.02 | 1.02 | 1.01 | 4.07 | 0.40 | 1.03 | 1.03 | 2.06 |
| 119 | 1.00 | 1.00 | 1.00 | 1.00 | 4.00 | 0.40 | 1.00 | 1.00 | 2.00 |
| 120 | 1.08 | 1.02 | 1.02 | 1.01 | 4.13 | 0.40 | 1.09 | 1.08 | 2.17 |
| 121 | 1.08 | 1.02 | 1.02 | 1.01 | 4.13 | 0.40 | 1.09 | 1.08 | 2.17 |
| 122 | 1.02 | 1.02 | 1.02 | 1.01 | 4.07 | 0.40 | 1.04 | 1.03 | 2.07 |
| 123 | 1.00 | 1.02 | 1.02 | 1.03 | 4.07 | 0.40 | 1.03 | 1.03 | 2.06 |
| 124 | 1.02 | 1.02 | 1.02 | 1.01 | 4.07 | 0.40 | 1.02 | 1.03 | 2.05 |
| 125 | 1.00 | 1.00 | 1.00 | 1.00 | 4.00 | 0.40 | 1.00 | 1.00 | 2.00 |
| 126 | 1.00 | 1.00 | 1.00 | 1.00 | 4.00 | 0.40 | 1.00 | 1.00 | 2.00 |
| 127 | 1.00 | 1.00 | 1.00 | 1.00 | 4.00 | 0.40 | 1.00 | 1.00 | 2.00 |
| 128 | 1.06 | 1.02 | 1.02 | 1.03 | 4.13 | 0.40 | 1.09 | 1.08 | 2.17 |
| 129 | 1.03 | 1.02 | 1.04 | 1.03 | 4.12 | 0.40 | 1.09 | 1.08 | 2.17 |
| 130 | 1.03 | 1.02 | 1.02 | 1.01 | 4.08 | 0.40 | 1.04 | 1.04 | 2.08 |
| 131 | 1.00 | 1.02 | 1.02 | 1.03 | 4.07 | 0.40 | 1.04 | 1.03 | 2.07 |
| 132 | 1.00 | 1.02 | 1.02 | 1.01 | 4.05 | 0.40 | 1.02 | 1.03 | 2.05 |
| 133 | 1.00 | 1.00 | 1.00 | 1.00 | 4.00 | 0.40 | 1.00 | 1.00 | 2.00 |
| 134 | 1.00 | 1.00 | 1.00 | 1.00 | 4.00 | 0.40 | 1.00 | 1.00 | 2.00 |

TABLE 5B-2-continued

| | XRD | | | | | | | | |
|---|---|---|---|---|---|---|---|---|---|
| No. | $I_1$ | $I_2$ | $I_3$ | $I_4$ | (A) | Ca/Si | $I_5$ | $I_6$ | (B) |
| 135 | 1.00 | 1.00 | 1.00 | 1.00 | 4.00 | 0.40 | 1.00 | 1.00 | 2.00 |
| 136 | 1.00 | 1.00 | 1.00 | 1.00 | 4.00 | 1.00 | 1.00 | 1.00 | 2.00 |

TABLE 5B-2-continued

| | XRD | | | | | | | | |
|---|---|---|---|---|---|---|---|---|---|
| No. | $I_1$ | $I_2$ | $I_3$ | $I_4$ | (A) | Ca/Si | $I_5$ | $I_6$ | (B) |
| 137 | 1.00 | 1.00 | 1.00 | 1.00 | 4.00 | 1.00 | 1.00 | 1.01 | 2.00 |
| 138 | 1.00 | 1.00 | 1.00 | 1.00 | 4.00 | 1.00 | 1.00 | 1.00 | 2.00 |

The underline indicates that the value is outside the scope of the present invention.

TABLE 6A-1

| | XRD | | | | | | | | |
|---|---|---|---|---|---|---|---|---|---|
| No. | $I_7$ | $I_8$ | $I_9$ | (C) | $I_{10}$ (D) | $I_{11}$ | $I_{12}$ | $I_{13}$ | (E) |
| 1 | 1.00 | 1.00 | 1.00 | 3.00 | 1.00 | 1.00 | 1.00 | 1.00 | 3.00 |
| 2 | 1.01 | 1.00 | 1.02 | 3.03 | 1.05 | 1.01 | 1.01 | 1.02 | 3.04 |
| 3 | 1.01 | 1.00 | 1.00 | 3.01 | 1.05 | 1.02 | 1.01 | 1.02 | 3.05 |
| 4 | 1.01 | 1.00 | 1.00 | 3.01 | 1.04 | 1.02 | 1.02 | 1.02 | 3.06 |
| 5 | 1.01 | 1.00 | 1.00 | 3.01 | 1.04 | 1.02 | 1.03 | 1.01 | 3.06 |
| 6 | 1.01 | 1.00 | 1.02 | 3.03 | 1.04 | 1.03 | 1.01 | 1.01 | 3.05 |
| 7 | 1.01 | 1.00 | 1.00 | 3.01 | 1.04 | 1.02 | 1.01 | 1.02 | 3.05 |
| 8 | 1.02 | 1.02 | 1.03 | 3.07 | 1.04 | 1.02 | 1.02 | 1.02 | 3.06 |
| 9 | 1.02 | 1.02 | 1.03 | 3.07 | 1.04 | 1.02 | 1.03 | 1.01 | 3.06 |
| 10 | 1.02 | 1.02 | 1.03 | 3.07 | 1.05 | 1.02 | 1.02 | 1.02 | 3.06 |
| 11 | 1.02 | 1.02 | 1.03 | 3.07 | 1.04 | 1.02 | 1.03 | 1.01 | 3.06 |
| 12 | 1.02 | 1.02 | 1.02 | 3.06 | 1.04 | 1.03 | 1.01 | 1.01 | 3.05 |
| 13 | 1.02 | 1.01 | 1.04 | 3.07 | 1.04 | 1.02 | 1.01 | 1.02 | 3.05 |
| 14 | 1.01 | 1.00 | 1.00 | 3.01 | 1.04 | 1.02 | 1.03 | 1.01 | 3.06 |
| 15 | 1.01 | 1.00 | 1.00 | 3.01 | 1.05 | 1.03 | 1.01 | 1.01 | 3.05 |
| 16 | 1.01 | 1.00 | 1.00 | 3.01 | 1.05 | 1.03 | 1.01 | 1.01 | 3.05 |
| 17 | 1.00 | 1.00 | 1.00 | 3.00 | 1.00 | 1.00 | 1.00 | 1.00 | 3.00 |
| 18 | 1.01 | 1.00 | 1.02 | 3.03 | 1.00 | 1.03 | 1.01 | 1.01 | 3.05 |
| 19 | 1.02 | 1.03 | 1.01 | 3.06 | 1.00 | 1.02 | 1.03 | 1.01 | 3.06 |
| 20 | 1.01 | 1.02 | 1.02 | 3.05 | 1.00 | 1.01 | 1.01 | 1.02 | 3.04 |
| 21 | 1.01 | 1.00 | 1.02 | 3.03 | 1.00 | 1.02 | 1.01 | 1.02 | 3.05 |
| 22 | 1.01 | 1.00 | 1.00 | 3.01 | 1.00 | 1.03 | 1.01 | 1.01 | 3.05 |
| 23 | 1.00 | 1.00 | 1.02 | 3.02 | 1.00 | 1.02 | 1.02 | 1.02 | 3.06 |
| 24 | 1.00 | 1.01 | 1.03 | 3.04 | 1.00 | 1.03 | 1.01 | 1.01 | 3.05 |
| 25 | 1.00 | 1.00 | 1.01 | 3.01 | 1.00 | 1.02 | 1.03 | 1.01 | 3.06 |
| 26 | 1.00 | 1.00 | 1.01 | 3.01 | 1.00 | 1.03 | 1.01 | 1.01 | 3.05 |
| 27 | 1.00 | 1.01 | 0.99 | 3.00 | 1.00 | 1.02 | 1.02 | 1.02 | 3.06 |
| 28 | 1.00 | 1.00 | 1.00 | 3.00 | 1.00 | 1.03 | 1.01 | 1.01 | 3.05 |
| 29 | 1.00 | 1.00 | 1.00 | 3.00 | 1.00 | 1.00 | 1.00 | 1.00 | 3.00 |
| 30 | 1.00 | 1.00 | 1.00 | 3.00 | 1.08 | 1.03 | 1.01 | 1.01 | 3.05 |
| 31 | 1.00 | 1.00 | 1.00 | 3.00 | 1.08 | 1.01 | 1.01 | 1.02 | 3.04 |
| 32 | 1.01 | 1.00 | 1.02 | 3.03 | 1.09 | 1.02 | 1.01 | 1.02 | 3.05 |
| 33 | 1.00 | 1.00 | 1.00 | 3.00 | 1.10 | 1.02 | 1.03 | 1.01 | 3.06 |
| 34 | 1.00 | 1.00 | 1.00 | 3.00 | 1.00 | 1.00 | 1.00 | 1.00 | 3.00 |
| 35 | 1.00 | 1.00 | 1.00 | 3.00 | 1.09 | 1.02 | 1.02 | 1.02 | 3.06 |

TABLE 6A-2

| | XRD | | | | | | | | |
|---|---|---|---|---|---|---|---|---|---|
| No. | $I_7$ | $I_8$ | $I_9$ | (C) | $I_{10}$ (D) | $I_{11}$ | $I_{12}$ | $I_{13}$ | (E) |
| 36 | 1.00 | 1.00 | 1.00 | 3.00 | 1.00 | 1.00 | 1.00 | 1.00 | 3.00 |
| 37 | 1.00 | 1.00 | 1.00 | 3.00 | 1.02 | 1.02 | 1.02 | 1.02 | 3.06 |
| 38 | 1.00 | 1.00 | 1.00 | 3.00 | 1.00 | 1.00 | 1.00 | 1.00 | 3.00 |
| 39 | 1.00 | 1.00 | 1.00 | 3.00 | 1.00 | 1.00 | 1.00 | 1.00 | 3.00 |
| 40 | 1.00 | 1.00 | 1.00 | 3.00 | 1.00 | 1.00 | 1.00 | 1.00 | 3.00 |
| 41 | 1.00 | 1.00 | 1.00 | 3.00 | 1.00 | 1.00 | 1.00 | 1.00 | 3.00 |
| 42 | 1.02 | 1.00 | 1.04 | 3.06 | 1.00 | 1.03 | 1.01 | 1.01 | 3.05 |
| 43 | 1.02 | 1.02 | 1.03 | 3.07 | 1.00 | 1.02 | 1.03 | 1.01 | 3.06 |
| 44 | 1.00 | 1.00 | 1.00 | 3.00 | 1.00 | 1.00 | 1.00 | 1.00 | 3.00 |
| 45 | 1.03 | 1.01 | 1.03 | 3.07 | 1.00 | 1.02 | 1.02 | 1.02 | 3.06 |
| 46 | 1.00 | 1.00 | 1.00 | 3.00 | 1.00 | 1.00 | 1.00 | 1.00 | 3.00 |
| 47 | 1.00 | 1.00 | 1.00 | 3.00 | 1.00 | 1.00 | 1.00 | 1.00 | 3.00 |
| 48 | 1.02 | 1.02 | 1.03 | 3.07 | 1.00 | 1.01 | 1.01 | 1.02 | 3.04 |
| 49 | 1.02 | 1.02 | 1.03 | 3.07 | 1.00 | 1.02 | 1.01 | 1.02 | 3.05 |
| 50 | 1.01 | 1.00 | 1.02 | 3.03 | 1.00 | 1.03 | 1.01 | 1.01 | 3.05 |
| 51 | 1.00 | 1.00 | 1.00 | 3.00 | 1.00 | 1.00 | 1.00 | 1.00 | 3.00 |
| 52 | 1.00 | 1.00 | 1.00 | 3.00 | 1.00 | 1.02 | 1.02 | 1.02 | 3.06 |
| 53 | 1.00 | 1.00 | 1.00 | 3.00 | 1.00 | 1.02 | 1.01 | 1.02 | 3.05 |
| 54 | 1.00 | 1.00 | 1.00 | 3.00 | 1.00 | 1.01 | 1.02 | 1.02 | 3.05 |

TABLE 6A-2-continued

| No. | XRD | | | | | | | | |
|---|---|---|---|---|---|---|---|---|---|
| | $I_7$ | $I_8$ | $I_9$ | (C) | $I_{10}$ (D) | $I_{11}$ | $I_{12}$ | $I_{13}$ | (E) |
| 55 | 1.01 | 1.00 | 1.02 | 3.03 | 1.00 | 1.01 | 1.01 | 1.02 | 3.04 |
| 56 | 1.00 | 1.00 | 1.00 | 3.00 | 1.00 | 1.02 | 1.01 | 1.02 | 3.05 |
| 57 | 1.00 | 1.00 | 1.00 | 3.00 | 1.00 | 1.00 | 1.00 | 1.00 | 3.00 |
| 58 | 1.00 | 1.00 | 1.00 | 3.00 | 1.06 | 1.02 | 1.02 | 1.02 | 3.06 |
| 59 | 1.00 | 1.00 | 1.00 | 3.00 | 1.00 | 1.00 | 1.00 | 1.00 | 3.00 |
| 60 | 1.00 | 1.00 | 1.00 | 3.00 | 1.05 | 1.03 | 1.01 | 1.01 | 3.05 |
| 61 | 1.00 | 1.00 | 1.00 | 3.00 | 1.00 | 1.00 | 1.00 | 1.00 | 3.00 |
| 62 | 1.00 | 1.00 | 1.00 | 3.00 | 1.00 | 1.00 | 1.00 | 1.00 | 3.00 |
| 63 | 1.00 | 1.00 | 1.00 | 3.00 | 1.05 | 1.03 | 1.01 | 1.01 | 3.05 |
| 64 | 1.00 | 1.00 | 1.00 | 3.00 | 1.00 | 1.00 | 1.00 | 1.00 | 3.00 |
| 65 | 1.00 | 1.00 | 1.00 | 3.00 | 1.05 | 1.02 | 1.02 | 1.02 | 3.06 |
| 66 | 1.00 | 1.00 | 1.00 | 3.00 | 1.00 | 1.00 | 1.00 | 1.00 | 3.00 |
| 67 | 1.00 | 1.00 | 1.00 | 3.00 | 1.06 | 1.03 | 1.01 | 1.01 | 3.05 |
| 68 | 1.00 | 1.00 | 1.00 | 3.00 | 1.00 | 1.00 | 1.00 | 1.00 | 3.00 |
| 69 | 1.00 | 1.00 | 1.00 | 3.00 | 1.07 | 1.03 | 1.01 | 1.01 | 3.05 |
| 70 | 1.00 | 1.00 | 1.00 | 3.00 | 1.00 | 1.00 | 1.00 | 1.00 | 3.00 |

20

TABLE 6B-1

| No. | XRD | | | | | | | | |
|---|---|---|---|---|---|---|---|---|---|
| | $I_7$ | $I_8$ | $I_9$ | (C) | $I_{10}$ (D) | $I_{11}$ | $I_{12}$ | $I_{13}$ | (E) |
| 71 | 1.00 | 1.00 | 1.00 | 3.00 | 1.05 | 1.02 | 1.02 | 1.02 | 3.06 |
| 72 | 1.00 | 1.00 | 1.00 | 3.00 | 1.00 | 1.00 | 1.00 | 1.00 | 3.00 |
| 73 | 1.00 | 1.00 | 1.00 | 3.00 | 1.00 | 1.00 | 1.00 | 1.00 | 3.00 |
| 74 | 1.00 | 1.00 | 1.00 | 3.00 | 1.00 | 1.00 | 1.00 | 1.00 | 3.00 |
| 75 | 1.00 | 1.00 | 1.00 | 3.00 | 1.06 | 1.00 | 1.00 | 1.00 | 3.00 |
| 76 | 1.00 | 1.00 | 1.00 | 3.00 | 1.07 | 1.00 | 1.00 | 1.00 | 3.00 |
| 77 | 1.00 | 1.00 | 1.00 | 3.00 | 1.00 | 1.00 | 1.00 | 1.00 | 3.00 |
| 78 | 1.00 | 1.00 | 1.00 | 3.00 | 1.07 | 1.00 | 1.00 | 1.00 | 3.00 |
| 79 | 1.00 | 1.00 | 1.00 | 3.00 | 1.07 | 1.00 | 1.00 | 1.00 | 3.00 |
| 80 | 1.00 | 1.00 | 1.00 | 3.00 | 1.00 | 1.00 | 1.00 | 1.00 | 3.00 |
| 81 | 1.00 | 1.00 | 1.00 | 3.00 | 1.06 | 1.00 | 1.00 | 1.00 | 3.00 |
| 82 | 1.00 | 1.00 | 1.00 | 3.00 | 1.08 | 1.00 | 1.00 | 1.00 | 3.00 |
| 83 | 1.00 | 1.00 | 1.00 | 3.00 | 1.00 | 1.00 | 1.00 | 1.00 | 3.00 |
| 84 | 1.00 | 1.00 | 1.00 | 3.00 | 1.07 | 1.00 | 1.00 | 1.00 | 3.00 |
| 85 | 1.00 | 1.00 | 1.00 | 3.00 | 1.07 | 1.00 | 1.00 | 1.00 | 3.00 |
| 86 | 1.00 | 1.00 | 1.00 | 3.00 | 1.00 | 1.00 | 1.00 | 1.00 | 3.00 |
| 87 | 1.00 | 1.00 | 1.00 | 3.00 | 1.07 | 1.00 | 1.00 | 1.00 | 3.00 |
| 88 | 1.00 | 1.00 | 1.00 | 3.00 | 1.07 | 1.00 | 1.00 | 1.00 | 3.00 |
| 89 | 1.00 | 1.00 | 1.00 | 3.00 | 1.00 | 1.00 | 1.00 | 1.00 | 3.00 |
| 90 | 1.01 | 1.00 | 1.02 | 3.03 | 1.08 | 1.00 | 1.00 | 1.00 | 3.00 |
| 91 | 1.00 | 1.00 | 1.00 | 3.00 | 1.08 | 1.00 | 1.00 | 1.00 | 3.00 |
| 92 | 1.00 | 1.00 | 1.00 | 3.00 | 1.00 | 1.00 | 1.00 | 1.00 | 3.00 |
| 93 | 1.02 | 1.00 | 1.01 | 3.03 | 1.07 | 1.00 | 1.00 | 1.00 | 3.00 |
| 94 | 1.00 | 1.00 | 1.00 | 3.00 | 1.07 | 1.00 | 1.00 | 1.00 | 3.00 |
| 95 | 1.00 | 1.00 | 1.00 | 3.00 | 1.00 | 1.00 | 1.00 | 1.00 | 3.00 |
| 96 | 1.02 | 1.00 | 1.01 | 3.03 | 1.08 | 1.00 | 1.00 | 1.00 | 3.00 |
| 97 | 1.00 | 1.00 | 1.00 | 3.00 | 1.05 | 1.00 | 1.00 | 1.00 | 3.00 |
| 98 | 1.00 | 1.00 | 1.00 | 3.00 | 1.00 | 1.00 | 1.00 | 1.00 | 3.00 |
| 99 | 1.02 | 1.00 | 1.01 | 3.03 | 1.05 | 1.00 | 1.00 | 1.00 | 3.00 |
| 100 | 1.00 | 1.00 | 1.00 | 3.00 | 1.05 | 1.00 | 1.00 | 1.00 | 3.00 |
| 101 | 1.00 | 1.00 | 1.00 | 3.00 | 1.00 | 1.00 | 1.00 | 1.00 | 3.00 |
| 102 | 1.02 | 1.00 | 1.01 | 3.03 | 1.05 | 1.00 | 1.00 | 1.00 | 3.00 |
| 103 | 1.00 | 1.00 | 1.00 | 3.00 | 1.05 | 1.00 | 1.00 | 1.00 | 3.00 |
| 104 | 1.00 | 1.00 | 1.00 | 3.00 | 1.00 | 1.00 | 1.00 | 1.00 | 3.00 |
| 105 | 1.02 | 1.02 | 1.03 | 3.07 | 1.05 | 1.00 | 1.00 | 1.00 | 3.00 |

TABLE 6B-2

| No. | XRD | | | | | | | | |
|---|---|---|---|---|---|---|---|---|---|
| | $I_7$ | $I_8$ | $I_9$ | (C) | $I_{10}$ (D) | $I_{11}$ | $I_{12}$ | $I_{13}$ | (E) |
| 106 | 1.00 | 1.00 | 1.00 | 3.00 | 1.00 | 1.00 | 1.00 | 1.00 | 3.00 |
| 107 | 1.00 | 1.00 | 1.00 | 3.00 | 1.00 | 1.00 | 1.00 | 1.00 | 3.00 |
| 108 | 1.00 | 1.00 | 1.00 | 3.00 | 1.00 | 1.00 | 1.00 | 1.00 | 3.00 |
| 109 | 1.02 | 1.00 | 1.01 | 3.03 | 1.07 | 1.00 | 1.00 | 1.00 | 3.00 |
| 110 | 1.00 | 1.00 | 1.00 | 3.00 | 1.07 | 1.00 | 1.00 | 1.00 | 3.00 |
| 111 | 1.02 | 1.00 | 1.01 | 3.03 | 1.08 | 1.00 | 1.00 | 1.00 | 3.00 |
| 112 | 1.00 | 1.00 | 1.00 | 3.00 | 1.05 | 1.00 | 1.00 | 1.00 | 3.00 |
| 113 | 1.01 | 1.01 | 1.01 | 3.03 | 1.06 | 1.00 | 1.00 | 1.00 | 3.00 |
| 114 | 1.00 | 1.00 | 1.00 | 3.00 | 1.05 | 1.00 | 1.00 | 1.00 | 3.00 |
| 115 | 1.00 | 1.00 | 1.00 | 3.00 | 1.00 | 1.00 | 1.00 | 1.00 | 3.00 |
| 116 | 1.00 | 1.00 | 1.00 | 3.00 | 1.00 | 1.00 | 1.00 | 1.00 | 3.00 |
| 117 | 1.01 | 1.00 | 1.00 | 3.01 | 1.05 | 1.00 | 1.00 | 1.00 | 3.00 |
| 118 | 1.00 | 1.00 | 1.00 | 3.00 | 1.05 | 1.00 | 1.00 | 1.00 | 3.00 |
| 119 | 1.00 | 1.00 | 1.00 | 3.00 | 1.00 | 1.00 | 1.00 | 1.00 | 3.00 |
| 120 | 1.01 | 1.00 | 1.00 | 3.01 | 1.05 | 1.00 | 1.00 | 1.00 | 3.00 |
| 121 | 1.00 | 1.00 | 1.00 | 3.00 | 1.05 | 1.00 | 1.00 | 1.00 | 3.00 |
| 122 | 1.00 | 1.00 | 1.00 | 3.00 | 1.07 | 1.00 | 1.00 | 1.00 | 3.00 |
| 123 | 1.01 | 1.00 | 1.00 | 3.01 | 1.05 | 1.00 | 1.00 | 1.00 | 3.00 |
| 124 | 1.00 | 1.00 | 1.00 | 3.00 | 1.05 | 1.00 | 1.00 | 1.00 | 3.00 |
| 125 | 1.00 | 1.00 | 1.00 | 3.00 | 1.00 | 1.00 | 1.00 | 1.00 | 3.00 |
| 126 | 1.00 | 1.00 | 1.00 | 3.00 | 1.00 | 1.00 | 1.00 | 1.00 | 3.00 |
| 127 | 1.00 | 1.00 | 1.00 | 3.00 | 1.00 | 1.00 | 1.00 | 1.00 | 3.00 |
| 128 | 1.01 | 1.00 | 1.00 | 3.01 | 1.05 | 1.00 | 1.00 | 1.00 | 3.00 |
| 129 | 1.00 | 1.00 | 1.00 | 3.00 | 1.06 | 1.00 | 1.00 | 1.00 | 3.00 |
| 130 | 1.00 | 1.00 | 1.00 | 3.00 | 1.06 | 1.00 | 1.00 | 1.00 | 3.00 |
| 131 | 1.01 | 1.00 | 1.00 | 3.01 | 1.06 | 1.00 | 1.00 | 1.00 | 3.00 |
| 132 | 1.00 | 1.00 | 1.00 | 3.00 | 1.05 | 1.00 | 1.00 | 1.00 | 3.00 |
| 133 | 1.00 | 1.00 | 1.00 | 3.00 | 1.00 | 1.00 | 1.00 | 1.00 | 3.00 |
| 134 | 1.00 | 1.00 | 1.00 | 3.00 | 1.00 | 1.00 | 1.00 | 1.00 | 3.00 |
| 135 | 1.00 | 1.00 | 1.00 | 3.00 | 1.00 | 1.00 | 1.00 | 1.00 | 3.00 |
| 136 | 1.00 | 1.00 | 1.00 | 3.00 | 1.00 | 1.00 | 1.00 | 1.00 | 3.00 |
| 137 | 1.00 | 1.00 | 1.00 | 3.00 | 1.00 | 1.00 | 1.00 | 1.00 | 3.00 |
| 138 | 1.00 | 1.00 | 1.00 | 3.00 | 1.05 | 1.00 | 1.00 | 1.00 | 3.00 |

TABLE 7A-1

| No. | Properties | |
|---|---|---|
| | Corrosion resistance on acid side | Alkali corrosion resistance |
| 1 | E | E |
| 2 | S+ | S |
| 3 | S | A+ |
| 4 | S | A+ |
| 5 | S | A+ |
| 6 | S | A+ |
| 7 | S | A+ |
| 8 | S | S+ |
| 9 | S | S+ |
| 10 | S | S+ |
| 11 | S | S+ |
| 12 | S | S+ |
| 13 | S | S+ |
| 14 | S | S+ |
| 15 | S | A+ |
| 16 | A+ | A+ |
| 17 | E | E |
| 18 | S+ | A |
| 19 | S+ | S |
| 20 | S+ | S |
| 21 | S+ | A |
| 22 | S+ | A |
| 23 | S+ | A |
| 24 | S+ | A |
| 25 | S+ | A |
| 26 | S+ | A |
| 27 | S | A |
| 28 | S | A |
| 29 | E | E |
| 30 | S | S |
| 31 | S | S |

TABLE 7A-1-continued

| No. | Properties | |
|---|---|---|
| | Corrosion resistance on acid side | Alkali corrosion resistance |
| 32 | S | S |
| 33 | S | S |
| 34 | E | E |
| 35 | S | S |

TABLE 7A-2

| No. | Properties | |
|---|---|---|
| | Corrosion resistance on acid side | Alkali corrosion resistance |
| 36 | E | E |
| 37 | S | S |
| 38 | E | E |
| 39 | E | E |
| 40 | F | E |
| 41 | E | E |
| 42 | A+ | A+ |
| 43 | A+ | A+ |
| 44 | E | E |
| 45 | A+ | A+ |
| 46 | E | E |
| 47 | E | E |
| 48 | A+ | A+ |
| 49 | A+ | A+ |
| 50 | A+ | A+ |
| 51 | E | E |

TABLE 7A-2-continued

| No. | Properties | |
|---|---|---|
| | Corrosion resistance on acid side | Alkali corrosion resistance |
| 52 | A+ | B |
| 53 | A+ | B |
| 54 | A+ | B |
| 55 | A+ | B |
| 56 | A+ | B |
| 57 | E | E |
| 58 | S | A |
| 59 | E | E |
| 60 | S | A+ |
| 61 | E | E |
| 62 | E | E |
| 63 | S | A+ |
| 64 | E | E |
| 65 | S | A+ |
| 66 | E | E |
| 67 | S | A+ |
| 68 | E | E |
| 69 | S | A+ |
| 70 | E | E |

TABLE 7B-1

| No. | Properties | |
|---|---|---|
| | Corrosion resistance on acid side | Alkali corrosion resistance |
| 71 | S | A+ |
| 72 | E | E |
| 73 | E | E |
| 74 | E | E |
| 75 | A | S |
| 76 | A | S |
| 77 | E | E |
| 78 | A | S |
| 79 | A | S |
| 80 | E | E |
| 81 | A | S |
| 82 | A | S |
| 83 | E | E |
| 84 | A | S |
| 85 | A | S |
| 86 | E | E |
| 87 | A | S |
| 88 | A | S |
| 89 | E | E |
| 90 | A | S |
| 91 | A | S |
| 92 | E | E |
| 93 | A | S |
| 94 | A | S |
| 95 | E | E |
| 96 | A | S |
| 97 | A | S |
| 98 | E | E |
| 99 | A | S |
| 100 | A | S |
| 101 | E | E |
| 102 | A | S |
| 103 | A | S |
| 104 | E | E |
| 105 | S | S+ |

TABLE 7B-2

| No. | Properties | |
|---|---|---|
| | Corrosion resistance on acid side | Alkali corrosion resistance |
| 106 | E | E |
| 107 | E | E |
| 108 | E | E |
| 109 | B | C |
| 110 | B | C |
| 111 | B | B |
| 112 | B | B |
| 113 | C | C |
| 114 | C | C |
| 115 | E | E |
| 116 | E | E |
| 117 | C | C |
| 118 | C | C |
| 119 | E | E |
| 120 | S | S |
| 121 | S | S |
| 122 | B | B |
| 123 | C | C |
| 124 | D | D |
| 125 | E | E |
| 126 | E | E |
| 127 | E | E |
| 128 | S | S |
| 129 | S | S |
| 130 | B | B |
| 131 | C | C |
| 132 | D | D |
| 133 | E | E |
| 134 | E | E |
| 135 | E | E |
| 136 | E | E |
| 137 | E | E |
| 138 | E | E |

The invention claimed is:

1. A plated steel sheet comprising a plated layer on a surface of a steel sheet, wherein the plated layer has an average chemical composition comprising, in mass %, Al: more than 15.0% and 30.0% or less, Mg: more than 5.0% and 15.0% or less, Sn: 0 to 0.70%, Bi: 0 to 0.35%, In: 0 to 0.35%, Ca: 0.03 to 0.60%, Y: 0 to 0.30%, La: 0 to 0.30%, Ce: 0 to 0.30%, Si: 0.01 to 0.75%, Cr: 0 to 0.25%, Ti: 0 to 0.25%, Ni: 0 to 1.00%, Co: 0 to 0.25%, V: 0 to 0.25%, Nb: 0 to 0.25%, Cu: 0 to 0.25%, Mn: 0 to 0.25%, Fe: 0 to 5.0%, Sr: 0 to 0.5%, Sb: 0 to 0.5%, Pb: 0 to 0.5%, B: 0 to 0.5%, Li: 0 to 0.5%, Zr: 0 to 0.5%, Mo: 0 to 0.5%,
W: 0 to 0.5%,
Ag: 0 to 0.5%,
P: 0 to 0.5%, and
a remainder of Zn and impurities,
a total amount ΣA of Sn, Bi and In is 0% or more and less than 0.75%,
a total amount ΣB of Ca, Y, La, and Ce is 0.03 to 0.60%,
a total amount ΣC of Cr, Ti, Ni, Co, V, Nb, Cu, and Mn is 0 to 1.00%,
Sn≤Si and 20.0≤Mg/Si are satisfied, and
when $I_1$ to $I_3$ determined from X-ray diffraction peaks of $Al_{2.15}Zn_{1.85}Ca$, 14 determined from an X-ray diffraction peak of $CaZn_2$, and 15 and 16 determined from X-ray diffraction peaks of η'-$MgZn_2$ are defined by the following Formulas (1) to (6) in an X-ray diffraction pattern of a surface of the plated layer, measured under conditions of an X-ray output of 40 kV and 150 mA using a Cu-Kα ray, the following Formulas (A) and (B) are satisfied:

$$I_1 = \frac{I\max(22.54 \sim 23.30°)}{I(22.54°) + 0.474\{|I(23.30°) - I(22.54°)|\}} \quad (1)$$

$$I_2 = \frac{I\max(31.00 \sim 32.00°)}{I(31.00°) + 0.62\{|I(32.00°) - I(31.00°)|\}} \quad (2)$$

$$I_3 = \frac{I\max(43.80 \sim 44.30°)}{I(43.50°) + 0.48\{|I(44.30°) - I(43.80°)|\}} \quad (3)$$

$$I_4 = \frac{I\max(33.00 \sim 33.80°)}{I(33.00°) + 0.4375\{|I(33.80°) - I(33.00°)|\}} \quad (4)$$

$$I_5 = \frac{I\max(26.00 \sim 26.40°)}{I(26.00°) + 0.375\{|I(26.40°) - I(26.00°)|\}} \quad (5)$$

$$I_6 = \frac{I\max(49.00 \sim 49.60°)}{I(49.00°) + 0.367\{|I(49.60°) - I(49.00°)|\}} \quad (6)$$

$$4.05 \le I_1 + I_2 + I_3 + I_4 \quad (A)$$

$$2.05 \le I_5 + I_6 \quad (B)$$

wherein, in Formulas (1) to (6), Imax (k to m°) is a maximum value of an X-ray diffraction intensity at a diffraction angle 2θ between k to m°, I (n°) is an X-ray diffraction intensity at a diffraction angle 2θ of n°, and k, m, and n are diffraction angles 2θ each shown in Formulas (1) to (6).

2. The plated steel sheet according to claim 1, wherein the average chemical composition of the plated layer satisfies 20.0≤Mg/Si≤38.0 and 3.00≤Al/Mg≤4.00, and when $I_7$ to $I_9$ determined from X-ray diffraction peaks of MgAlSi are defined by the following Formulas (7) to (8) in an X-ray diffraction pattern of a surface of the plated layer, measured under conditions of an X-ray output of 40 kV and 150 mA using a Cu-Kα ray, the following Formula (C) is satisfied:

$$I_7 = \frac{I\max(24.30 \sim 24.90°)}{I(24.30°) + 0.60\{|I(24.90°) - I(24.30°)|\}} \quad (7)$$

$$I_8 = \frac{I\max(46.10 \sim 46.40°)}{I(46.10°) + 0.60\{|I(46.40°) - I(46.10°)|\}} \quad (8)$$

$$I_9 = \frac{I\max(49.00 \sim 49.60°)}{I(49.00°) + 0.25\{|I(49.60°) - I(49.00°)|\}} \quad (9)$$

$$3.05 \le I_7 + I_8 + I_9 \quad (C)$$

wherein, in Formulas (7) to (9), Imax (k to m°) is a maximum value of an X-ray diffraction intensity at a diffraction angle 2θ between k to m°, I (n°) is an X-ray diffraction intensity at a diffraction angle 2θ of n°, and k, m, and n are diffraction angles 2θ each shown in Formulas (7) to (9).

3. The plated steel sheet according to claim 1, wherein the average chemical composition of the plated layer satisfies 0.01≤Sn, and
when $I_{10}$ determined from an X-ray diffraction peak of $Mg_9Sn_5$ is defined by the following Formula (10) in an X-ray diffraction pattern of a surface of the plated layer, measured under conditions of an X-ray output of 40 kV and 150 mA using a Cu-Kα ray, the following Formula (D) is satisfied:

$$I_{10} = \frac{I\max(23.10 \sim 23.80°)}{I(23.10°) + 0.43\{|I(23.80°) - I(23.10°)|\}} \quad (10)$$

$$1.04 \le I_{10} \quad (D)$$

wherein, in Formula (10), Imax (23.10 to 23.80°) is a maximum value of an X-ray diffraction intensity at a diffraction angle 2θ between 23.10 to 23.80°, I (23.10°) is an X-ray diffraction intensity at a diffraction angle 2θ of 23.10°, and I (23.80°) is an X-ray diffraction intensity at a diffraction angle 2θ of 23.80°.

4. The plated steel sheet according to claim 2, wherein the average chemical composition of the plated layer satisfies 0.01≤Sn, and
when $I_{10}$ determined from an X-ray diffraction peak of $Mg_9Sn_5$ is defined by the following Formula (10) in an X-ray diffraction pattern of a surface of the plated layer, measured under conditions of an X-ray output of 40 kV and 150 mA using a Cu-Kα ray, the following Formula (D) is satisfied:

$$I_{10} = \frac{I\max(23.10 \sim 23.80°)}{I(23.10°) + 0.43\{|I(23.80°) - I(23.10°)|\}} \quad (10)$$

$$1.04 \le I_{10} \quad (D)$$

wherein, in Formula (10), Imax (23.10 to 23.80°) is a maximum value of an X-ray diffraction intensity at a diffraction angle 2θ between 23.10 to 23.80°, I (23.10°) is an X-ray diffraction intensity at a diffraction angle 2θ of 23.10°, and I (23.80°) is an X-ray diffraction intensity at a diffraction angle 2θ of 23.80°.

5. The plated steel sheet according to claim 1, wherein when $I_{11}$ to $I_{13}$ determined from X-ray diffraction peaks of a metal oxide are defined by the following Formulas (11) to (13) in an X-ray diffraction pattern of a surface of the plated layer, measured under conditions of an X-ray output of 40 kV and 150 mA using a Cu-Kα ray, the following Formula (E) is satisfied:

$$I_{11} = \frac{I\max(10.30 \sim 10.70°)}{I(10.30°) + 0.375\{|1(10.70°) - I(10.30°)|\}} \quad (11)$$

$$I_{12} = \frac{I\max(12.30 \sim 13.30°)}{I(12.30°) + 0.53\{|I(13.30°) - I(12.30°)|\}} \quad (12)$$

-continued $$I_{13} = \frac{I\max(17.10 \sim 17.50°)}{I(17.10°) + 0.65\{|I(17.50°) - I(17.10°)|\}} \quad (13)$$

$$3.04 \leq I_{11} + I_{12} + I_{13} \quad (E)$$

wherein, in Formulas (11) to (13), Imax (k to m°) is a maximum value of an X-ray diffraction intensity at a diffraction angle 2θ between k to m°, I (n°) is an X-ray diffraction intensity at a diffraction angle 2θ of n°, and k, m, and n are diffraction angles 2θ each shown in Formulas (11) to (13).

6. The plated steel sheet according to claim 1, wherein the plated layer contains a Zn phase, an Al phase, an Al—Zn phase, an η'-$MgZn_2$ phase, and a $MgZn_2$ phase.

7. The plated steel sheet according to claim 5, wherein the plated layer contains a Zn phase, an Al phase, an Al—Zn phase, an η'-$MgZn_2$ phase, and a $MgZn_2$ phase.

* * * * *